US008998540B2

(12) United States Patent
Swingler et al.

(10) Patent No.: US 8,998,540 B2
(45) Date of Patent: Apr. 7, 2015

(54) METHOD, APPARATUS AND SYSTEM FOR ATTACHING AN ANCHOR MEMBER TO A FLOOR OF A BODY OF WATER

(75) Inventors: John Swingler, Rio de Janiero (BR); Neil McNaughton, Cumminstown (GB)

(73) Assignee: Blade Offshore Services Ltd.., Darlington, County Durham (GB)

( * ) Notice: Subject to any disclaimer, the term of this patent is extended or adjusted under 35 U.S.C. 154(b) by 213 days.

(21) Appl. No.: 13/395,785

(22) PCT Filed: Sep. 14, 2010

(86) PCT No.: PCT/GB2010/051534

§ 371 (c)(1),
(2), (4) Date: May 23, 2012

(87) PCT Pub. No.: WO2011/030167

PCT Pub. Date: Mar. 17, 2011

(65) Prior Publication Data

US 2012/0243945 A1 Sep. 27, 2012

(30) Foreign Application Priority Data

| | | |
|---|---|---|
| Sep. 14, 2009 | (EP) | 09275075 |
| Feb. 23, 2010 | (GB) | 1003026.0 |
| Mar. 24, 2010 | (GB) | 1004910.4 |
| Aug. 20, 2010 | (GB) | 1013936.8 |

(51) Int. Cl.
*E02D 5/54* (2006.01)
*E02D 27/42* (2006.01)
(Continued)

(52) U.S. Cl.
CPC *E02D 27/42* (2013.01); *E02D 7/10* (2013.01); *E21B 7/124* (2013.01)

(58) Field of Classification Search
CPC B63B 21/50; B63B 21/502; B63B 2021/505; E02D 13/04; E02D 7/10; E02D 27/42; E21B 7/20; E21B 33/143; E21B 7/124
USPC ..... 405/224, 225, 227, 228, 231–233; 175/5, 6
See application file for complete search history.

(56) References Cited

U.S. PATENT DOCUMENTS 3,779,322 A * 12/1973 Stevens ..... 175/162
3,984,991 A 10/1976 Kagler, Jr.
(Continued)

FOREIGN PATENT DOCUMENTS

EP 0 265 344 A1 4/1988
FR 2018085 * 3/1970 ..... E21B 7/124
(Continued)

OTHER PUBLICATIONS

International Search Report under date of Feb. 16, 2011 in connection with PCT/GB2010/051534.
(Continued)

*Primary Examiner* — Benjamin Fiorello
*Assistant Examiner* — Carib Oquendo
(74) *Attorney, Agent, or Firm* — Quales & Brady LLP

(57) ABSTRACT

A remotely operable drilling apparatus (6) comprises a body such as frame (10) and drive means arranged to drill annular pile (8), which is loaded in the drilling apparatus (6) into the floor of a body of water. The annular pile comprises a cutting shoe (24). The drive means comprises a power swivel (12) which attaches to the top of the annular pile (8) by means of a drive head. Delivery means is also provided which comprises at least one nozzle to enable flushing fluid and grout to be injected around annular pile (8). The power swivel (12) is raised and lowered by rack and pinion means 14 disposed on either side of the power swivel (12).

35 Claims, 38 Drawing Sheets

FIG. 26B

(51) Int. Cl.
*E02D 7/10* (2006.01)
*E21B 7/124* (2006.01)

(56) References Cited

U.S. PATENT DOCUMENTS

| | | | | |
|---|---|---|---|---|
| 6,536,993 | B2 * | 3/2003 | Strong et al. | 405/228 |
| 2005/0152749 | A1 * | 7/2005 | Anres et al. | 405/224 |
| 2008/0226398 | A1 * | 9/2008 | Gibberd et al. | 405/223 |

FOREIGN PATENT DOCUMENTS

| | | | | |
|---|---|---|---|---|
| GB | 2 436 320 | A | 9/2007 | |
| GB | 2 448 358 | A | 10/2008 | |
| JP | 2007247218 | * | 9/2007 | E21B 7/124 |
| WO | 86/01556 | A1 | 3/1986 | |
| WO | 2004/015207 | A1 | 2/2004 | |
| WO | 2008/125830 | A1 | 10/2008 | |

OTHER PUBLICATIONS

Extended Search Report under date of Mar. 8, 2010 in connection with EP Application No. 09275075.1-2303.
Search Report under date of Nov. 17, 2010 in connection with GB Application 1013936.8.
Search Report under date of May 12, 2010 in connection with GB Application 1003026.0.
Search Report under date of May 26, 2010 in connection with GB Application 1003026.0.

* cited by examiner

64

64

FIG. 35
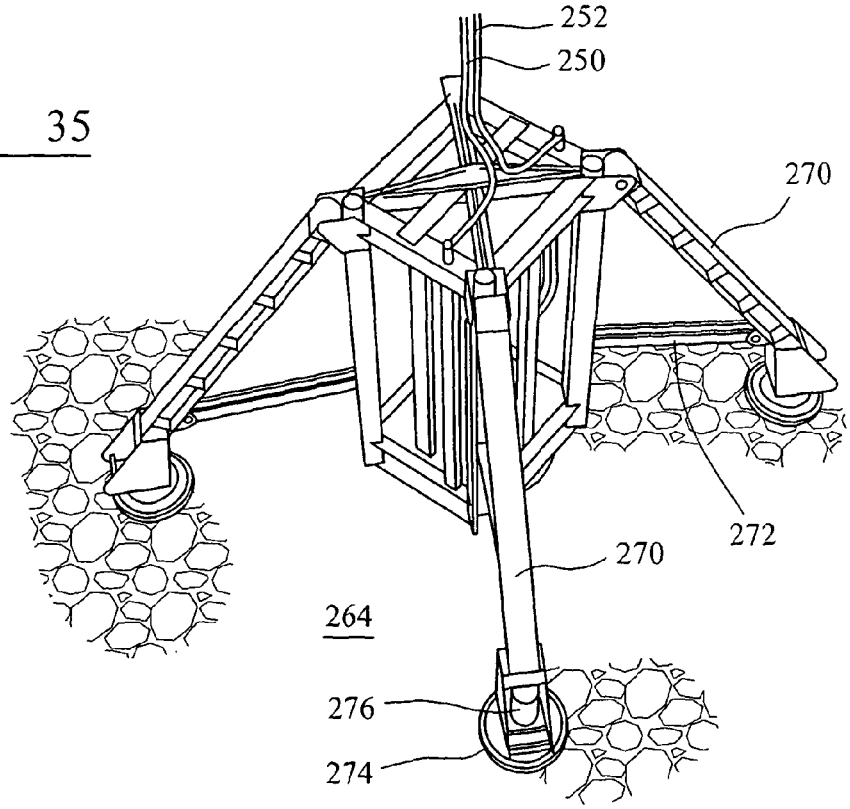
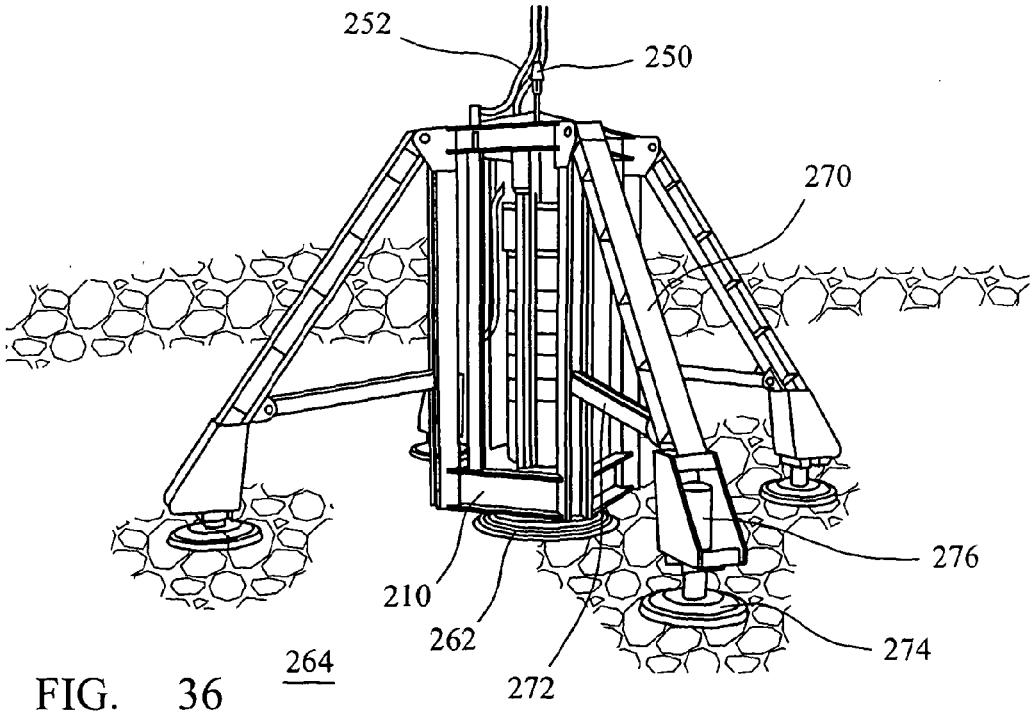
FIG. 36

METHOD, APPARATUS AND SYSTEM FOR ATTACHING AN ANCHOR MEMBER TO A FLOOR OF A BODY OF WATER

CROSS-REFERENCE TO RELATED APPLICATIONS

This application claims priority to PCT International Application No. PCT/GB2010/051534 filed on Sep. 14, 2010, which claims priority to European Patent Application No. 09275075.1 filed on Sep. 14, 2009, Great Britain Patent Application No. 1003026.0 filed on Feb. 23, 2010, Great Britain Patent Application 1004910.4 filed on Mar. 24, 2010 and Great Britain Patent Application 1013936.8 filed on Aug. 20, 2010, all of which are fully incorporated by reference herein.

FIELD OF THE INVENTION

The present invention relates to a method, apparatus and system for attaching an anchor member to a floor of a body of water, and relates particularly, but not exclusively, to an anchor member for attaching to a floor of a body of water to enable submerged structures to be pinned or tethered to a floor of a body of water.

BACKGROUND OF THE INVENTION

It is desirable to utilise fast flowing water to generate electricity from submerged power generating turbines. In fast flowing water, these turbines require high integrity submerged turbine supports that will not be moved by the high current.

In most high current areas, a floor of a body of water, such as the seabed can be formed from a particularly hard rock formation rather than soft mud or sand. This is partly as a result of the fact that the fast current tends to scour soft mud and sand away from the seabed to reveal the base rock formation.

The combination of fast flowing water and a hard seabed precludes the use of jack-up type vessels. Jack-up vessels comprise a plurality of support legs on which a platform is mounted. The platform is vertically moveable up and down the support legs to account for changing water levels. This type of vessel generally uses a drill string to drill bores in the seabed. Piles can then be grouted into the drilled bores in order to attach a turbine support structure to the seabed.

However, a problem arises when the legs of a jack-up vessel initially contact a hard seabed because the legs tend to bounce on the hard rock floor and as a result can become damaged and even fracture. Consequently, it is extremely difficult to locate and secure a jack-up vessel in a region where there is a hard seabed formation such that they tend not to be used in such circumstances.

The use of a dynamically positioned (DP) vessel is also generally precluded in areas with particularly high current because it is difficult to ensure that the DP vessel remains on station in areas of high current. Furthermore, because of the amount of fuel necessary to stabilise a DP vessel at high current speeds, this option is particularly expensive and therefore undesirable.

Areas of high current speed also pose another problem for securing a subsea structure to the seabed. It is generally only practical to install a pile during the slack water time window when the tide is slowest. This time window can be of the order of less than one hour and it is therefore extremely difficult, if not impossible, to perform multiple drillings in such a time window.

A solution to the above problems is proposed in WO2008/125830. This document describes a surface vessel on which a structure to be attached to the seabed is located. An example of such a structure is a tripod support for an underwater power generating turbine. When the structure is on the surface vessel, individual drilling rigs are attached to each leg of the tripod which is to be piled to the seabed. A crane is then used to lower the structure, with drilling rigs attached to the seabed.

At the seabed, each drilling rig is then activated. Each drilling rig comprises a percussion drill which drills into the seabed and pulls down a pile behind the drill bit into the drilled socket. When the socket is drilled to its maximum depth, the drill bit is retracted leaving the pile in the seabed. The drilling rig is then detached and withdrawn to the surface. Grout is then pumped into the annulus between the tripod foot and the outside of the pile and also into the cylindrical hole defined by the centre of the pile to seal the pile into the seabed.

The method of WO2008/125830 suffers from several drawbacks:

1) The surface vessel must be particularly large to be able to support and lower a tripod structure to the seabed. Consequently, heavy lifting equipment such as a large crane is required on the vessel.

2) Once drilling is complete, the percussion drill must be retracted in order to pump grout into the pile and seal the pile in the seabed.

3) The only thing that holds the submerged structure to the pile is the grout disposed in the annulus between the structure foot and the outside of the pile. This joint could be prone to failure, particularly if high current washes grout away before it fully sets.

4) Repeated use of the percussion drill will result in wear and tear on the drill leading to increased maintenance and operation costs.

5) This system may require the use of an ROV. An ROV can generally only operate in currents of less than 1.5 knots which restricts the areas in which this system can be used.

6) If one of the drilling rigs fails, it is a complicated and costly operation to replace the rig on the seabed and conduct the piling operation.

GB2436320 proposes an alternative method. This document describes a method of lowering a structure to be attached to the seabed from a surface vessel to the seabed. The structure comprises several legs in which drill bits are disposed. The drill bits are pre-mounted in the legs on the surface and are then drilled into the seabed to attach the structure to the seabed. The drilling of the drill bits is accomplished by an arm which is lowered on to the structure and comprises a drill motor to drive the individual drill bits into the seabed. The arm is then rotated around the structure to drill each bit in sequence. An alternative embodiment describes mounting a structure having a plurality of arms and drill motors on to the structure to be attached to the seabed. Grout reservoirs are also provided on each leg of the host structure to enable the drill bits to be grouted into the seabed once they have been drilled.

The method and apparatus of GB2436320 suffers from the drawback that the surface vessel must be able to lift both the structure to be submerged and the drilling assembly together down to the seabed. This increases the size of surface vessel required and therefore the cost and complexity of a drilling operation. Furthermore, the only thing that holds the submerged structure to the drill bits is the grout disposed in the area between the feet of the structure and the outer surface of the drill bits. This joint could be prone to failure, particularly if high current washes the grout away before it fully sets. Also, the weight and complexity of the assembly is increased by providing grout reservoirs on the structure to be attached to the seabed.

SUMMARY OF THE INVENTION

Preferred embodiments of the present invention seek to overcome the above disadvantages of the prior art.

According to an aspect of the present invention, there is provided a method of attaching an anchor member to a floor of a body of water, the method characterised by:

locating a remotely operable drilling apparatus adjacent a floor of a body of water, wherein the remotely operable drilling apparatus is adapted to drive an anchor member comprising an annular pile having a substantially hollow shaft portion, an annular bit at a first end thereof and anchor means at a second end thereof, the annular bit being arranged to drill an annulus into the floor into which the annular pile is to be driven and the anchor means being adapted to restrict movement of a structure relative to the anchor member;

operating the remotely operable drilling apparatus to drill said annular pile into the floor of the body of water by the annular bit cutting an annulus into the floor of the body of water such that the anchor means projects above the floor of the body of water; and filling said annulus with grout in order to retain the annular pile in said annulus and resist removal of the annular pile from the floor of the body of water.

The step of locating a remotely operable drilling apparatus adjacent a floor of a body of water provides the advantage that a surface vessel is not required to lift a structure to be attached to the seabed down to the seabed. This greatly reduces the size of vessel required and the associated running costs to attach an anchor member to the floor of a body of water.

Use of an anchor member comprising an annular pile having an integral annular bit provides the advantage of simplifying the remotely operable drilling apparatus because it does not require a drill bit and is merely required to rotate the annular pile. This reduces the cost and complexity of the drilling apparatus.

This also provides the advantage that an annulus can be drilled in the seabed rather than a cylindrical socket because the drill bit does not have to be retracted. This means that grout can be used to fill the regions in the annulus outside of and inside of the annular pile to form an annular grout seal in the seabed which is particularly strong. This also requires less grout than filling an entire cylindrical hole.

This also provides the advantage that a reduced amount of formation has to be drilled and removed from the hole compared with methods that drill a cylindrical socket in rock formations. Drilling an annulus rather than a cylinder also speeds up the drilling procedure.

As a result of the fact that the drilling and grouting operations are both conducted by the remotely operable drilling apparatus without withdrawal of a drill bit, this provides the advantage of reducing the time taken to place an anchor member in the seabed.

The step of locating the remotely operable drilling apparatus adjacent a floor of a body of water may comprise locating the remotely operable drilling apparatus adjacent an aperture formed on a submerged structure, wherein the aperture is arranged to receive a pile; and wherein the step of operating the remotely operable drilling apparatus may include driving said annular pile through the aperture and into the floor of the body of water by the annular bit cutting an annulus into the floor of the body of water to an extent to which the anchor means, which comprises a locking member, is driven against a portion of the submerged structure around said aperture to resist removal of the submerged structure from the floor of the body of water.

Use of an annular pile comprising a locking member provides the advantage of a positive downward force being applied by the pile to the submerged structure, rather than simply relying on an annular grout seal above the seabed.

The step of locating a remotely operable drilling apparatus on the submerged structure adjacent an aperture arranged to receive a pile may comprise one or more of the following steps:

a) slidably interconnecting the remotely operable drilling apparatus to at least one guide line, wherein at least one said guideline is attached to the submerged structure at a location adjacent an aperture arranged to receive a pile, and lowering the remotely operable drilling apparatus along at least one said guideline whilst the at least one said guide line is pulled taut;

b) moving guide means disposed on the base of the remotely operable drilling apparatus into contact with a portion of the submerged structure adjacent an aperture arranged to receive a pile to align said annular bit with said aperture; or c) operating first clamping means to clamp said remotely operable drilling apparatus to the submerged structure adjacent said aperture.

By slidably interconnecting the remotely operable drilling apparatus to at least one guideline, this provides the advantage of simplifying deployment of the drilling apparatus down to an aperture of the submerged structure on the seabed. This greatly reduces the time taken to perform a piling operation. The submerged structure can be deployed on the seabed with the guidelines attached to buoys which float on the surface to enable easy location and retrieval by the vessel conducting the drilling and piling operation.

By moving guide means disposed on the base of the remotely operable drilling apparatus into contact with a portion of the submerged structure adjacent an aperture arranged to receive a pile to align said annular bit with said aperture, this provides the advantage of further simplifying location of the remotely operable drilling apparatus on the submerged structure which saves time and increases the amount of piling operations that can be conducted in a predetermined time period.

By operating first clamping means to clamp said remotely operable drilling apparatus to the submerged structure adjacent said aperture, this provides the advantage of providing reaction means for the drilling operation.

The step of locating a remotely operable drilling apparatus adjacent a floor of a body of water may comprise contacting the floor of the body of water with support means of the remotely operable drilling apparatus, wherein the support means is adjustable to enable levelling of the remotely operable drilling apparatus to a condition in which a longitudinal axis of the annular pile is substantially perpendicular to the floor of the body of water.

This provides the advantage of a standalone drilling apparatus that does not require a host structure to conduct a piling operation. The anchor member can be left in the floor of a body of water and a structure anchored to the anchor member at a later time.

The step of operating the remotely operable drilling apparatus may include drill said annular pile into the floor of the body of water by the annular bit cutting an annulus into the floor of the body of water such that the anchor means, which comprises attachment means for attachment to a submerged structure, projects above the floor of the body of water.

This provides the advantage of enabling the anchor member to be left in the floor of a body of water to enable a structure chained or tethered to the anchor member at a later time.

The step of locating the remotely operable drilling apparatus adjacent a floor of a body of water may comprise operating traction means of the remotely operable drilling apparatus to move the remotely operable drilling apparatus along a floor of a body of water to a location to which an anchor member is to be drilled into the floor of the body of water.

This provides the advantage that a structure to be attached to a floor of a body of water can be deployed having annular piles mounted in the structure ready to be drilled into the seabed. This means that the remotely operable drilling apparatus, which in this case is a vehicle, is only required to be deployed from a surface vessel once to pin the entire structure to the floor of the body of water. Consequently, there is no need to recover the vehicle to reload it with annular piles. It has been found that the drilling operation time can therefore be reduced by approximately 60% which significantly reduces cost.

This also provides the advantage of only requiring two supply lines from a surface vessel, i.e. an integrated hoisting, electrical power and signal cable and a grouting hose. The deployment of only two lines from the surface allows for much greater movement of the surface vessel. Accurate station keeping, which is difficult in high current conditions, is therefore not required and umbilical management is therefore very much simplified.

The in-situ deployment of annular piles enabled by this method provides additional weight to the host structure to prevent sliding as a result of the current forces against the structure prior to the pinning operation being completed.

Furthermore, use of traction means, such as caterpillar tracks or wheels, enables the apparatus to move along the floor of the body of water and provides a reaction force during drilling by gripping the floor of the body of water. This cannot be accomplished with a buoyant remotely operated vehicle.

In a preferred embodiment, the step of operating the remotely operable drilling apparatus to drill said annular pile into the floor of the body of water comprises one or more of the following steps:

d) attaching drive means of the remotely operable drilling apparatus to the annular pile and operating the drive means to rotate and push the annular pile into the floor of the body of water; or e) pumping flushing fluid through said annular pile to remove cuttings from a drilled annulus and provide lubrication and cooling to said annular bit.

The step of filling said annulus with grout in order to retain the annular pile in said annulus may comprise operating delivery means of the remotely operable drilling apparatus to fill said annulus with grout.

This provides the advantage of reducing the time taken to conduct a piling operation.

The method may further comprise one or more of the following steps:

f) disconnecting the remotely operable drilling apparatus from the submerged structure and retrieving the remotely operable drilling apparatus to a surface vessel;

g) loading a further annular pile on said remotely operable drilling apparatus and repeating the method as defined above.

According to another aspect of the present invention, there is provided a method of anchoring a structure to a floor of a body of water, the method comprising:

attaching an anchor member to a floor of a body of water as defined above; and attaching a structure to the anchor means of the anchor member.

This provides the advantage of a relatively fast and straightforward method of rigidly anchoring a structure to a floor of a body of water. This method is particularly advantageous in areas of high current speed.

The anchor means may comprise attachment means having a first latching means and the structure may comprise a second latching means arranged to latch with the first latching means, and wherein the step of attaching the structure to the anchor means of the anchor member comprises latching said first latching means with said second latching means.

According to another aspect of the present invention, there is provided a remotely operable drilling apparatus characterised by:

a body arranged to be remotely located adjacent a floor of a body of water; and drive means arranged to drill an anchor member into a floor of a body of water, wherein the anchor member comprises an annular pile having a substantially hollow shaft portion, an annular bit at a first end thereof and anchor means at a second end thereof, the annular bit being arranged to drill an annulus into the floor into which the annular pile is to be drilled and the anchor means being adapted to restrict movement of a structure relative to the anchor member.

This provides the advantage that a surface vessel is not required to lift a structure that is to be installed on the seabed down to the seabed. This greatly reduces the size of vessel required and the associated running costs for anchoring a structure to the seabed.

Use of an annular pile comprising an integral annular bit provides the advantage of simplifying the remotely operable drilling apparatus because it does not require a drill bit and is merely required to rotate the annular pile. This reduces the cost and complexity of the drilling apparatus.

This also provides the advantage that an annulus can be drilled in the seabed rather than a cylindrical socket because the drill bit does not have to be retracted. This means that grout can be used to fill the regions in the annulus outside of and inside of the annular pile to form an annular grout seal in the seabed which is particularly strong. This also requires less grout than filling an entire cylindrical hole.

This also provides the advantage that a reduced amount of formation has to be drilled and removed from the hole compared with methods that drill a cylindrical socket in rock formations. Drilling an annulus rather than a cylinder also speeds up the drilling procedure.

In a preferred embodiment, the apparatus further comprises delivery means arranged to fill said annulus with grout in order to retain the annular pile in said annulus and resist removal of a structure from the floor of the body of water.

This provides the advantage of reducing the time taken to place a pile in the seabed because drilling and grouting is performed without removal of a drill bit.

The apparatus may further comprise one or more of the following features:

h) guide means disposed on the base of the remotely operable drilling apparatus, the guide means arranged to align said annular bit with an aperture of a submerged structure, wherein the aperture is arranged to receive the pile; or i) clamping means for clamping said remotely operable drilling apparatus to a submerged structure adjacent an aperture arranged to receive a pile.

By providing guide means disposed on the base of the remotely operable drilling apparatus, this provides the advantage of simplifying alignment of the remotely operable drilling apparatus with an aperture of the submerged structure. This saves time and increases the amount of piling operations that can be conducted in a predetermined time period.

Said guide means may comprise a female conical portion arranged to abut a corresponding male conical portion disposed around said aperture arranged to receive a pile.

This provides a guide means which is relatively straightforward to manufacture and is also self-centring.

The apparatus may further comprise support means arranged to contact the floor of a body of water, wherein the support means is adjustable to enable levelling of the remotely operable drilling apparatus to a condition in which a longitudinal axis of the annular pile is substantially perpendicular to the floor of the body of water.

This provides the advantage of a standalone drilling apparatus that does not require a host structure to conduct a piling operation. The anchor member can be left in the floor of a body of water and a structure anchored to the anchor member at a later time.

Said support means may comprise a plurality of retractable legs, each said retractable leg comprising a shoe portion that is adjustable to change the length from which and/or the angle at which the respective shoe extends from the corresponding leg.

The apparatus may further comprise traction means adapted to move the body along the floor of a body of water.

Furthermore, use of traction means, such as caterpillar tracks or wheels, enables the apparatus to move along the floor of the body of water and provides a reaction force during drilling by gripping the floor of the body of water. This cannot be accomplished with a buoyant remotely operated vehicle.

This provides the advantage that a structure to be attached to a floor of a body of water can be deployed having annular piles mounted in the structure ready to be drilled into the seabed. This means that the remotely operable drilling apparatus, which in this case is a vehicle, is only required to be deployed from a surface vessel once to pin the entire structure to the floor of the body of water. Consequently, there is no need to recover the vehicle to reload it with annular piles. It has been found that the drilling operation time can therefore be reduced by approximately 60% which significantly reduces cost.

This apparatus also provides the advantage of only requiring two supply lines from a surface vessel, i.e. an integrated hoisting, electrical power and signal cable and a grouting hose. The deployment of only two lines from the surface allows for much greater movement of the surface vessel. Accurate station keeping, which is difficult in high current conditions, is therefore not required and umbilical management is therefore very much simplified.

The in-situ deployment of annular piles enabled by this vehicle provides additional weight to the host structure to prevent sliding as a result of the current forces against the structure prior to the pinning operation being completed.

The drive means may be pivotable relative to the body.

This provides the advantage of facilitating drilling on uneven surfaces.

The piling apparatus may be arranged to be loaded with a plurality of annular piles.

This provides the advantage that piles do not have to be pre-loaded in a support structure prior to deployment to the seabed.

The apparatus may further comprise at least one hydraulic arm arranged to move an annular pile into alignment with said drive means.

The drive means may comprise one or more of the following features:

j) a power swivel comprising a drive head arranged to releasably engage with and rotate said annular pile;

k) rack and pinion means or at least one hydraulic cylinder arranged to move said power swivel towards the floor of a body of water; or l) retractable support clamping means arranged to hold said annular pile in the remotely operable drilling apparatus before drilling and provide stability during drilling.

The power swivel in combination with rack and pinion means provides the advantage of a drive means that is relatively straightforward to manufacture and quick to reload to facilitate performing further piling operations.

The apparatus may further comprise an anchor member loaded in the apparatus, wherein the anchor member comprises:

an annular pile having a substantially hollow shaft portion, an annular bit at a first end thereof and anchor means at a second end thereof, the annular bit being arranged to drill an annulus into the floor into which the annular pile is to be drilled and the anchor means being adapted to restrict movement of a structure relative to the anchor member.

According to another aspect of the present invention, there is provided a system for attaching an anchor member to a floor of a body of water, the system characterised by:

a remotely operable drilling apparatus as defined above; and umbilical means arranged to provide hydraulic and/or electrical power from a surface vessel to said remotely operable drilling apparatus and to provide flushing fluid and/or grout to said delivery means from a surface vessel.

The system provides the advantage that a process of anchoring a structure to the floor of a body of water can be operated from the surface in a relatively rapid and straightforward procedure. An annular pile is loaded into the drilling apparatus on the surface and the drilling apparatus is then submerged and lowered to the seabed. The annular pile is then drilled into the seabed and grouted in a simple procedure without the need for divers or ROVs.

In a preferred embodiment, the system further comprises one or more of the following features:

m) adapter means arranged to enable the umbilical means to be disconnected from the surface vessel and attached to a buoy;

n) pumping means arranged to pump flushing fluid and/or grout to said delivery means via said umbilical means; or o) at least one guide line attached to the submerged structure at a location adjacent an aperture arranged to receive a pile, at least one said guide line arranged to be interconnected to said remotely operable drilling apparatus to guide the remotely operable drilling apparatus to a location on said submerged structure adjacent an aperture arranged to receive a pile whilst the at least one said guide line is pulled taut.

By providing adapter means arranged to enable the umbilical means to be disconnected from the surface vessel and attached to a buoy, this provides the advantage that in the event of bad weather and rough seas, or in the event of the surface vessel being unable to maintain position on location, the piling operation can be quickly interrupted and detached from the surface vessel for safety. The buoy can then be retrieved and piling recommenced relatively quickly when conditions permit.

The at least one guideline provides the advantage of simplifying deployment of the drilling apparatus down to the aperture of the submerged structure on the seabed. This greatly reduces the time taken to perform a piling operation.

The submerged structure can be deployed on the seabed with the guidelines attached to buoys which float on the surface to enable easy location and retrieval by the vessel conducting the drilling and piling operation.

The system may further comprise tensioning means arrange to pull at least one said guide line taut.

According to a further aspect of the present invention, there is provided an anchor member characterised by:

an annular pile having a substantially hollow shaft portion, an annular bit at a first end thereof and anchor means at a second end thereof, the annular bit being arranged to drill an annulus into the floor into which the annular pile is to be drilled and the anchor means being adapted to restrict movement of a structure relative to the anchor member.

This provides the advantage of an anchor member that can be drilled into submerged hard rock formations and used to attach structures to the formation. A separate drilling operation is not required because the bit is integral to the pile.

The substantially hollow shaft portion may comprise a shaft having outer and inner concentric cylindrical sleeves defining an annular channel therebetween, and wherein the annular bit is mounted to a first end of the shaft and the anchor means is mounted to a second end of the shaft; and wherein a path for fluid flow is defined from a first opening in the anchor means, through said annular channel and through a second opening defined by said inner sleeve.

This provides the advantage of providing a channel in the pile for flushing fluid and grout. This is particularly useful when drilling in formations where there is a risk that the drilled annulus may collapse. This therefore ensures a rigid piling operation will be completed in such formations.

Said annular bit may be mounted to said outer sleeve and the second opening may be defined by an end of the inner sleeve.

Said anchor means may comprise a locking member arranged to be driven against a portion of a submerged structure around an aperture to resist removal of the submerged structure from the floor of the body of water.

This provides the advantage of being able to apply a positive retaining force to a submerged structure.

Said anchor means may comprise attachment means for attachment to an at least partially submerged structure.

Said attachment means may comprise a sleeve rotatably mounted on the anchor member, wherein the sleeve comprises at least one eye.

This provides the advantage of being able to conduct a piling operation and the return at a later time to anchor a submerged structure to the anchor member. The rotating sleeve provides the advantage that the at least one eye can rotate in any direction thereby allowing a surface vessel tethered to the eye to move under prevailing environmental forces without causing a snarl or tangle in the mooring line.

Said attachment means may comprise a first latching means arranged to be latched with a second latching means of a structure attachable to said attachment means.

Said attachment means may comprise a first flange arranged to be bolted to a second flange of a structure attachable to said attachment means.

According to another aspect of the present invention, there is provided an assembly comprising a structure attached to the anchor means of an anchor member as defined above.

In a preferred embodiment, the assembly further comprises a flexible skirt located adjacent a drilled annulus, the flexible skirt being arranged to prevent removal of grout from the annulus during and after drilling.

This provides the advantage of a cofferdam located around the outer surface of the annulus to prevent scouring of grout during and after drilling.

BRIEF DESCRIPTION OF THE DRAWINGS

Preferred embodiments of the present invention will now be described, by way of example only and not in any limitative sense, with reference to the accompanying drawings, in which:

FIG. 35 is a perspective view from above showing the remotely operable drilling apparatus in contact with a floor of a body of water;

FIG. 36 is a perspective view from the side of FIG. 35;

FIG. 64 shows the vehicle manoeuvring between legs of the support structure;

DETAILED DESCRIPTION OF THE PREFERRED EMBODIMENTS

Figure 1:
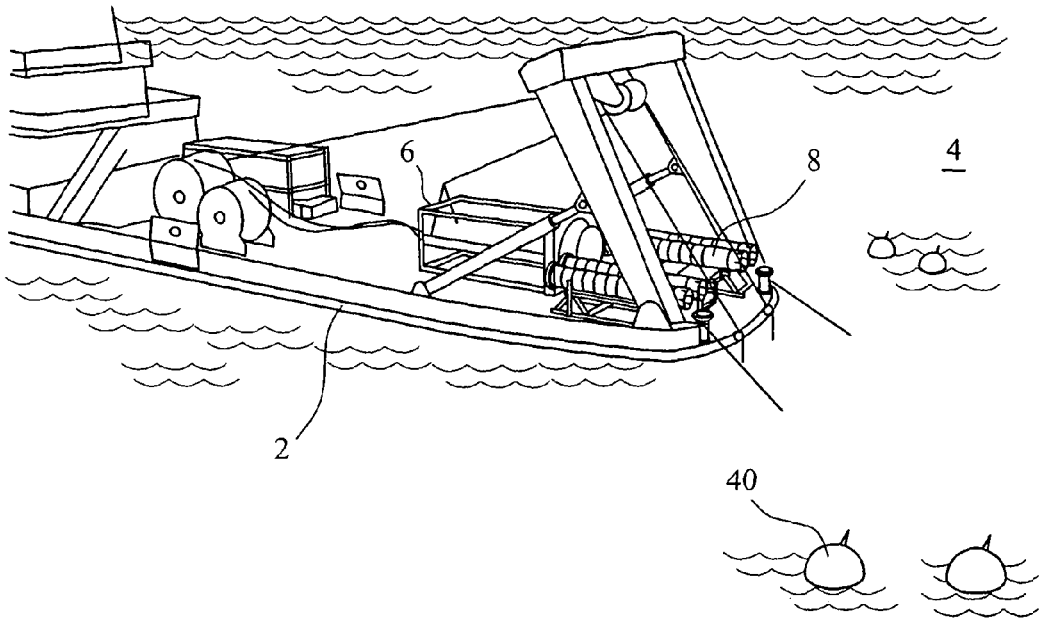
FIG. 1 is a perspective view of a surface vessel used in a method of attaching an anchor member to a floor of a body of water in accordance with a first embodiment of the present invention.

Referring to FIG. 1, a surface vessel such as a ship 2 is located on a body of water 4 such as a sea, river or estuary having a floor to which a structure is to be attached or anchored. A remotely operable drilling apparatus 6 is disposed on vessel 2. A plurality of anchor members which comprise annular piles, also known as pin piles 8 are also located on vessel 2.

Figure 2:
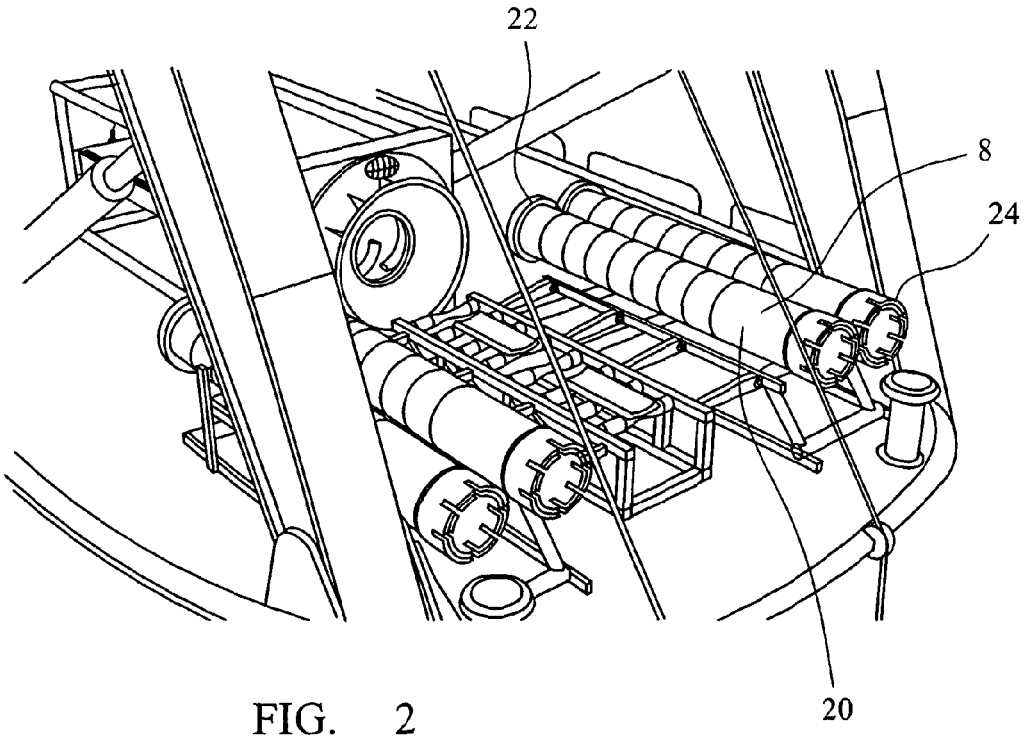
FIG. 2 is a close up perspective view of the base of a remotely operable drilling apparatus and several annular piles used in a method of attaching an anchor member to a floor of a body of water in accordance with a first embodiment of the present invention.
Figure 3:
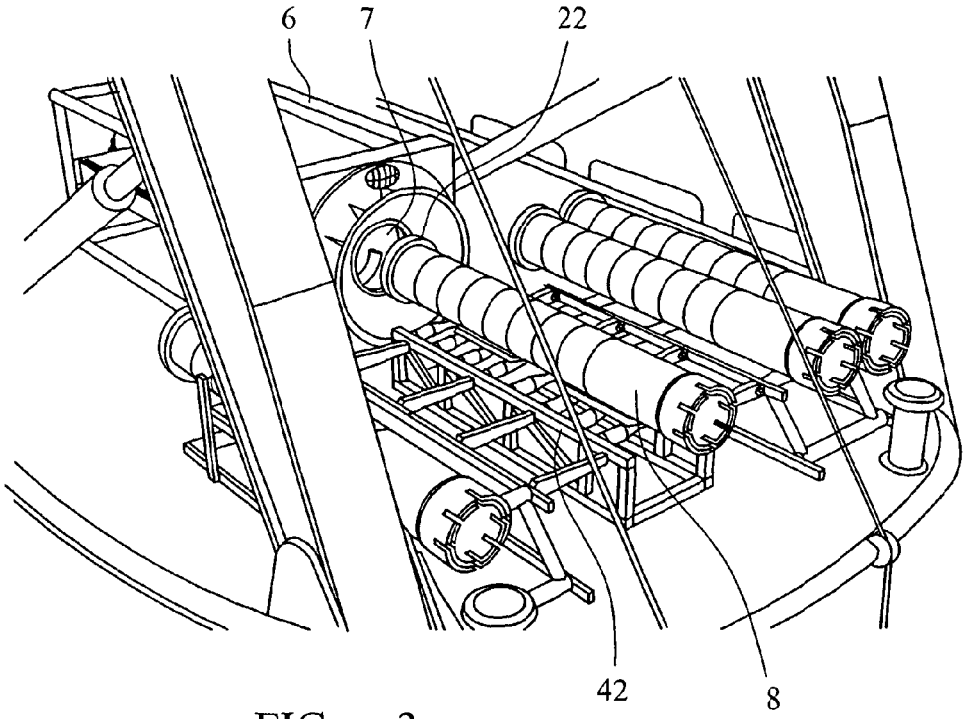
FIG. 3 is a perspective view of a first stage of loading an annular pile to the remotely operable drilling apparatus.
Figure 11:
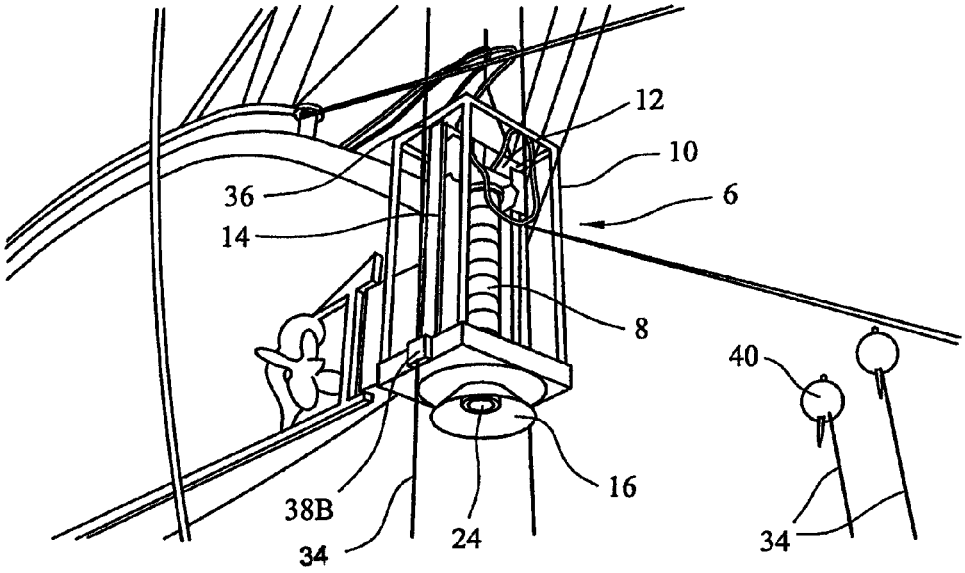
FIG. 11 is a perspective view of a fourth stage of the deployment of the remotely operable drilling apparatus.
Figure 12:
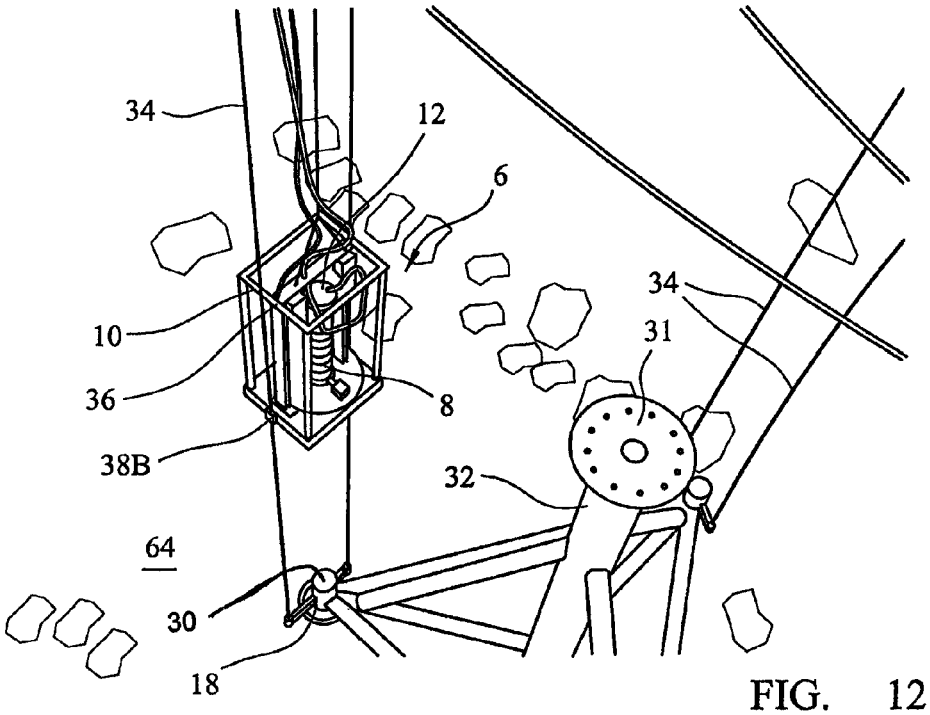
FIG. 12 is a perspective view of a fifth stage of the deployment of the remotely operable drilling apparatus showing the apparatus descending along guidelines towards the submerged structure to be pinned to a floor of a body of water, such as the seabed.
Figure 22:
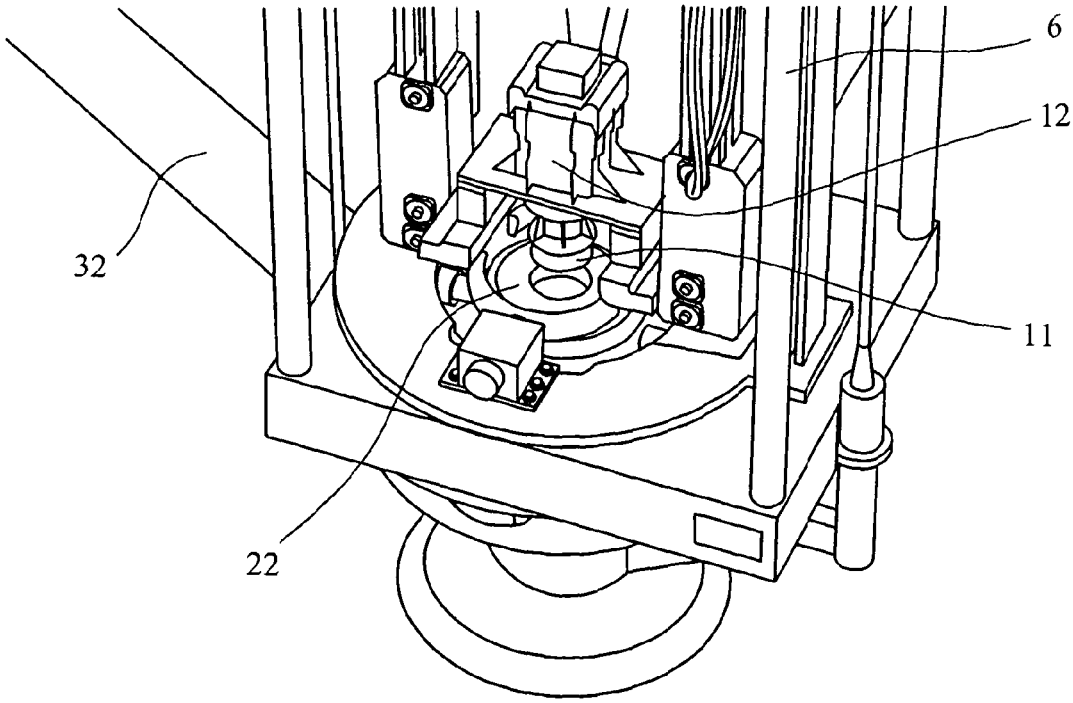
FIG. 22 is view corresponding to FIG. 21 in which the annular pile has been released from the remotely operable drilling apparatus.
Figure 23:
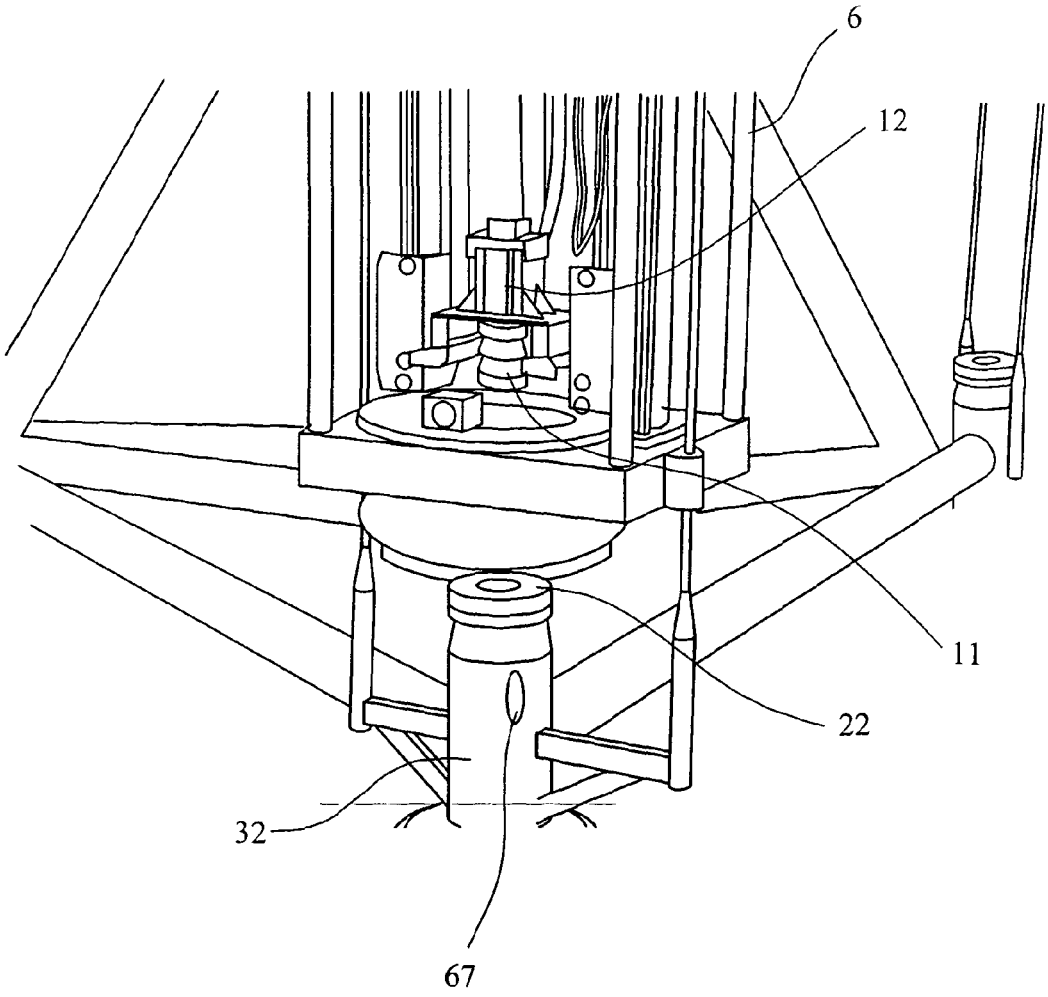
FIG. 23 is a view corresponding to FIG. 22 showing the remotely operable drilling apparatus released from the submerged structure and in a condition to be raised to the surface.

Referring to FIGS. 11 and 12, remotely operable drilling apparatus 6 comprises a body formed from a frame 10 and drive means arranged to drill or drive annular pile 8, which is loaded in the remotely operable drilling apparatus 6, into the floor of a body of water. The drive means comprises a power swivel 12 which attaches to the top of the pin pile by means of a drive head 11 (FIG. 22). The drive head 11 contains drive pins (not shown) arranged at equally space points around the outer diameter of the drive head. The drive head engages with machined locating slots (not shown) which are located in the annular pile locking collar 22 (FIG. 2). The drive head 11 can be released from the pin pile by rotating the power swivel in a reverse direction. The power swivel can be rotated in either a forward or reverse direction with an equal amount of torque being available in either direction. Delivery means is also provided which comprises a fluid conduit (not shown) located adjacent drive head 11 to enable flushing fluid and grout to be injected around annular pile 8.

The power swivel 12 is raised and lowered by rack and pinion means 14 disposed on either side of the power swivel 12. Different pin pile lengths can be accommodated in the drilling apparatus 6 by means of insertion of additional shortened pre-manufactured sections of the integrated frame and rack and pinion sections. As an alternative to rack and pinion means, at one least hydraulic cylinder (not shown) could be used.

In the first embodiment of the present invention, centring and location of the remotely operable drilling apparatus onto the submerged structure to be pinned is assisted by guide means located on the remotely operable drilling apparatus. The guide means may comprise a female cone portion 16 disposed on the base of drilling apparatus 6. The female cone portion 16 is arranged to contact a male cone portion 18 disposed adjacent aperture 30 of submerged structure 32. Submerged structure 32 in the present example is a tripod having a platform 31 on to which a submerged turbine (not shown) is to be mounted. The tripod comprises three apertures or collars 30 through which piles are to be passed to pin the structure 32 to the seabed.

Referring to FIG. 2, annular pile 8 comprises a substantially hollow shaft portion 20, an anchor means which in the first embodiment is a locking member for providing a locking force, for example a locking collar 22 at a first end, and an annular bit 24 at a second end. The annular bit forms a ring-like cutting shoe and is wider than the cylindrical portion 20 such that when annular bit 24 is drilled into the seabed an annulus is formed behind the annular bit 24. The locking member 22 is arranged to engage the edges of aperture 30 (FIG. 12) to resist removal of a portion of submerged structure 32 from the seabed.

Alternatively, FIGS. 26A to 26D show an alternative embodiment of an anchor member that can be used with remotely operable drilling apparatus 6. This embodiment is useful in formations where there is a risk that a cut annulus will collapse. The anchor member comprises an annular pile 308 having a shaft 320 formed from outer 320A and inner 320B concentric cylindrical sleeves defining an annular channel 323 therebetween. An annular bit 324 is mounted to a first end of the shaft and anchor means such as a locking member 322 is mounted to a second end of the shaft 320. Alternatively, instead of locking member 322, an attachment means for enabling a submerged structure to be tethered or attached to the annular pile may be mounted to the second end of the shaft.

A path for fluid flow is defined from a first opening 322A in the locking member, through the annular channel 323 and through a second opening 323A defined by said inner sleeve. The annular bit 324 is mounted to the outer sleeve 320A and the second opening 323A is defined by the end of the inner sleeve. Alternatively, second openings may be formed at different points through the length of inner sleeve 320B. Pile 308 can be formed by welding a length of pipe to form an inner sleeve 320B in an existing annular pile. Pile 308 is very useful for overcoming a problem of annulus blockage.

Figure 26A:
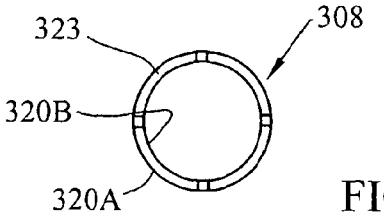
FIG. 26A is a cross section taken through a shaft of an annular pile according to an embodiment of the present invention.
Figure 26B:
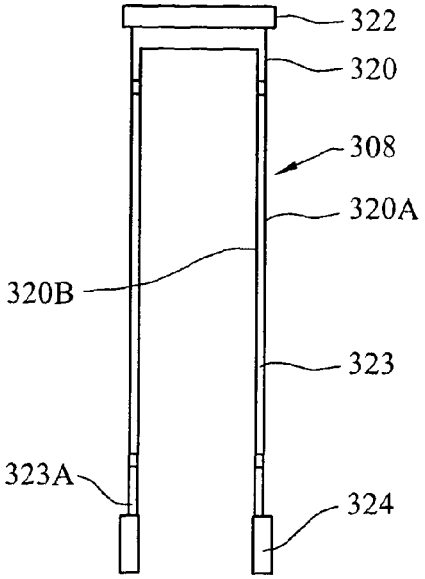
FIG. 26B is a longitudinal cross sectional view of the annular pile of FIG. 26A.
Figure 26C:
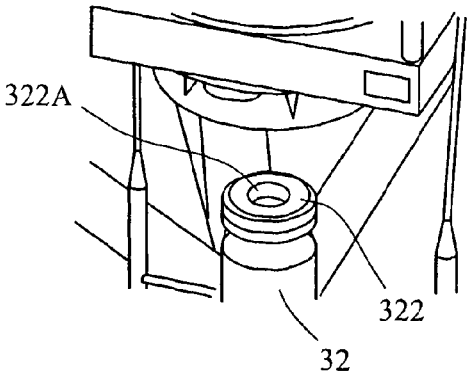
FIG. 26C is a perspective view showing an annular pile installed through a collar of a submerged structure.
Figure 26D:
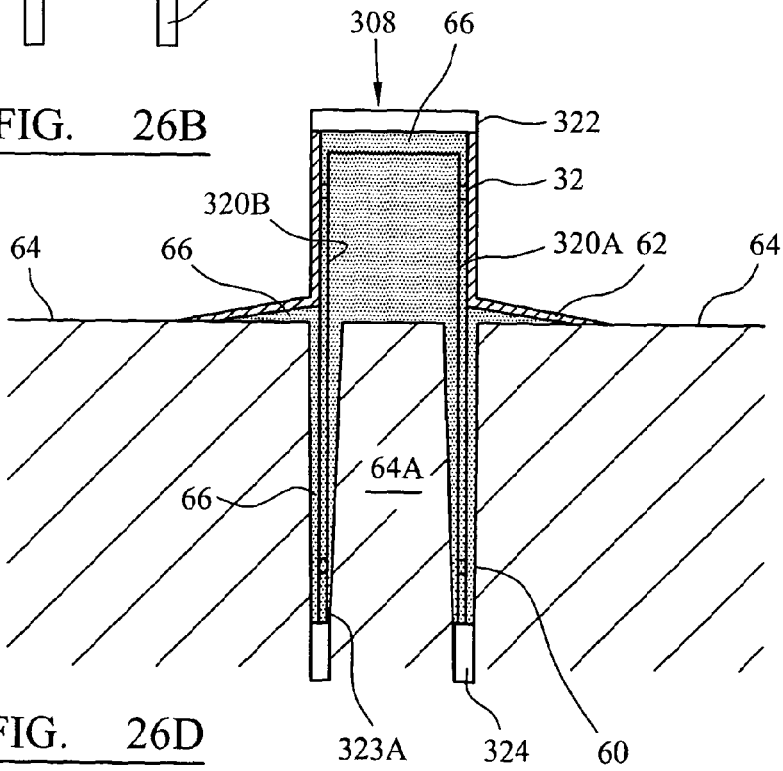
FIG. 26D shows a cross-section of the annular pile drilled into the floor of a body of water and holding a support structure to the floor of the body of water.

Referring to FIG. 26*d*, once drilling has been completed and the annular pile 308 is fully advanced into the seabed 64 such that the locking collar 322 pushes downwardly on support structure 32, grout 66 is pumped through delivery means and into the annular pile, down between sleeves 320A and 320B of the annular pile, up annulus 60 and into flexible skirt 62. The skirt 62 forms a cofferdam which helps to prevent currents from washing away the unset grout 66. Consequently, it can be seen that a central cylindrical rock plug 64A is form which helps to retain the pile 308 in the seabed. In prior art methods, a cylindrical bore is formed in the seabed rather than an annulus. The cylindrical bore must be filled entirely with a grout or a solid pin which can be weaker. It should also be noted that cylindrical rock plug 64A is also formed by the single sleeve annular pile 8 of the first embodiment.

In order to guide the remotely operable drilling apparatus 6 to aperture 30, at least one guideline 34 is attached to an arm 38 and guide post 38A of submerged structure 32. Corresponding eyelets 36 and a post guide 36B are arranged on the drilling apparatus 6 through which the guidelines 34 can be fed. Prior to being attached to the drilling apparatus 6, guidelines 34 are floated to the surface by buoys 40 (FIGS. 1 and 11). Consequently, referring to FIG. 1, buoys 40 identify locations on the surface of the water 4 to which the remotely operable drilling apparatus 6 is to be submerged to perform a piling operation.

Figure 9:
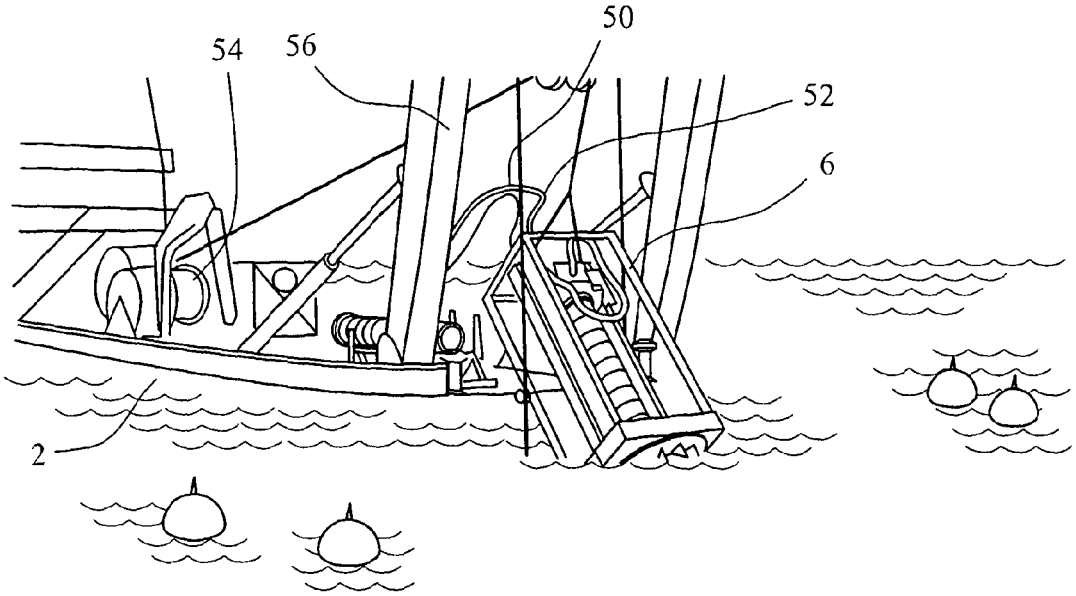
FIG. 9 is a perspective view of a second stage of the deployment of the remotely operable drilling apparatus.
Figure 10:
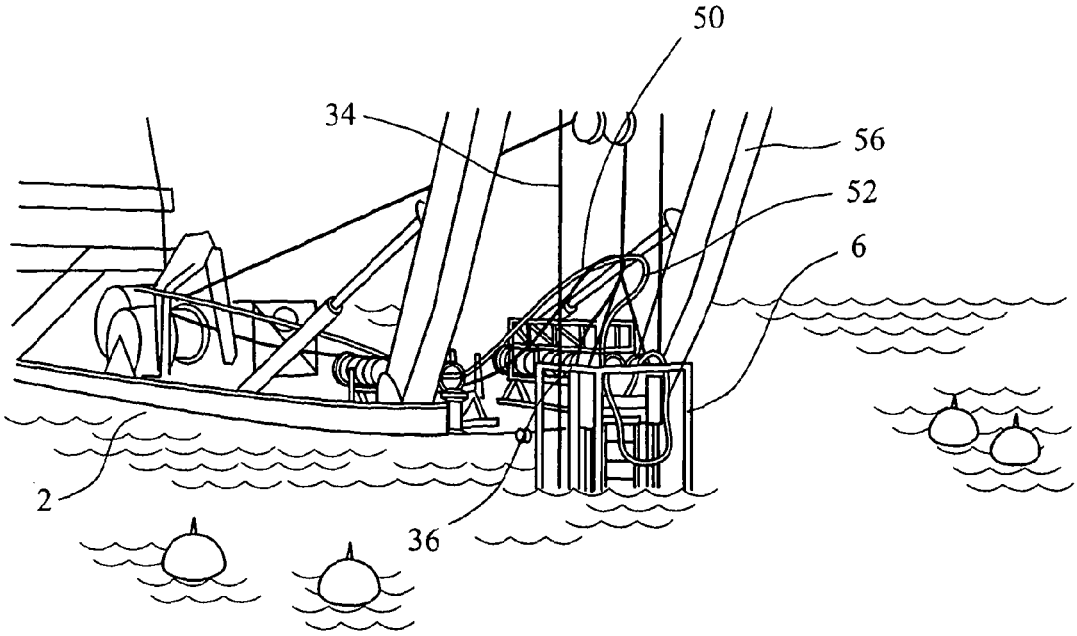
FIG. 10 is a perspective view of a third stage of the deployment of the remotely operable drilling apparatus showing the submersion of the remotely operable drilling apparatus.

Referring to FIGS. 9 and 10, umbilical means comprises at least one cable 50 to provide hydraulic or electrical power to the remotely operable drilling apparatus 6 from the surface vessel 2. The umbilical means may also include at least one hose 52 through which flushing fluid and/or grout can be provided to the delivery means as will be explained in further detail below. Pumping means (not shown) is located on vessel 2 to pump flushing fluid and/or grout through hose 52. Alternatively, instead of pumping flushing fluid from the surface, the pumping means may comprise a flushing pump unit (not shown) mounted on drilling apparatus 6. This would mean that only a small hose for grout would be required from the surface, rather than a larger hose assembly for grout and flushing fluid.

The umbilical 50, 52 may also comprise adapter means (not shown) arranged to enable the umbilical means to be disconnected from the surface vessel and attached to a buoy in the event of adverse weather conditions. This provides the advantage that in the event of bad weather and rough seas, the piling operation can be quickly interrupted and detached from the surface vessel 2 for safety. The buoy can then be retrieved and piling recommenced relatively quickly when conditions permit.

Referring to FIG. 2 to 7, a method of loading an annular pile 8 in the remotely operable drilling apparatus 6 will be described.

Figure 4:
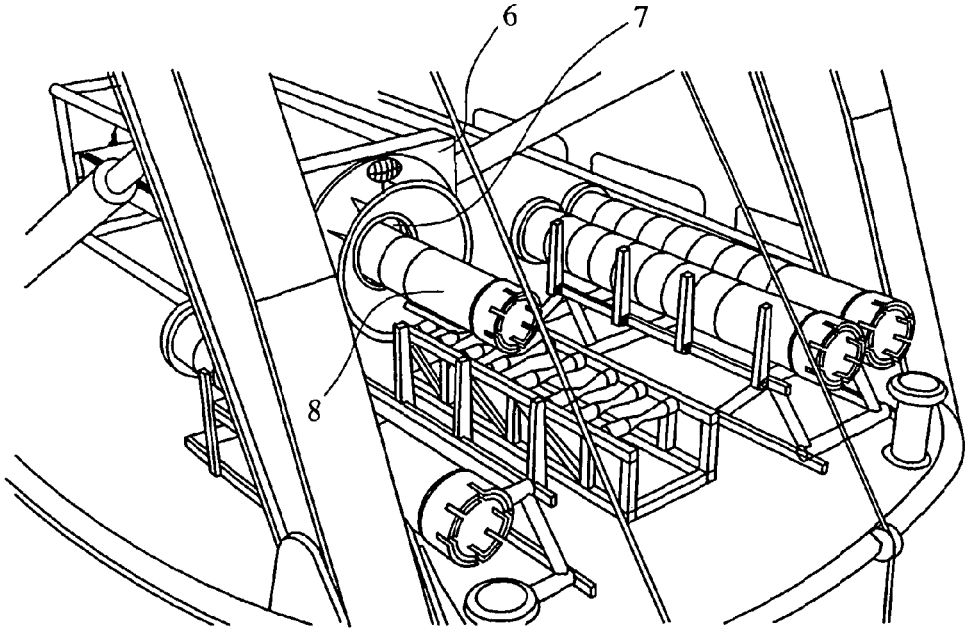
FIG. 4 is a view corresponding to FIG. 3 showing the second stage of loading an annular pile into the remotely operable drilling apparatus.

A roller assembly 42 is provided on the surface of vessel 2. An annular pile 8 is loaded on the roller assembly 42 such that the locking collar 22 is arranged adjacent lower drilling aperture 7 of the drilling assembly 6. Annular pile 8 is then installed by running locking collar 22 rearwardly into aperture 7 such that the locking collar 22 engages the drive head 11 of power swivel 12. The power swivel 12 is then retracted along the rack and pinion means 14 to draw the annular pile 8 into the drilling apparatus 6 as shown in FIG. 4.

Figure 5:
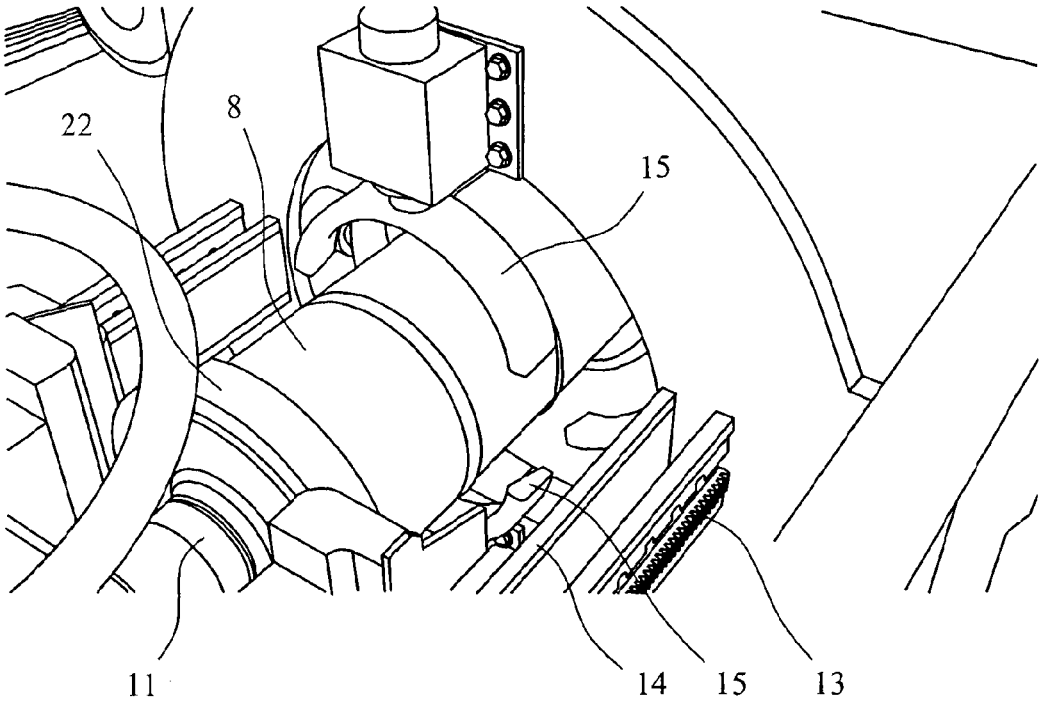
FIG. 5 is a close up perspective view of a third stage of loading an annular pile into the remotely operable drilling apparatus.
Figure 6:
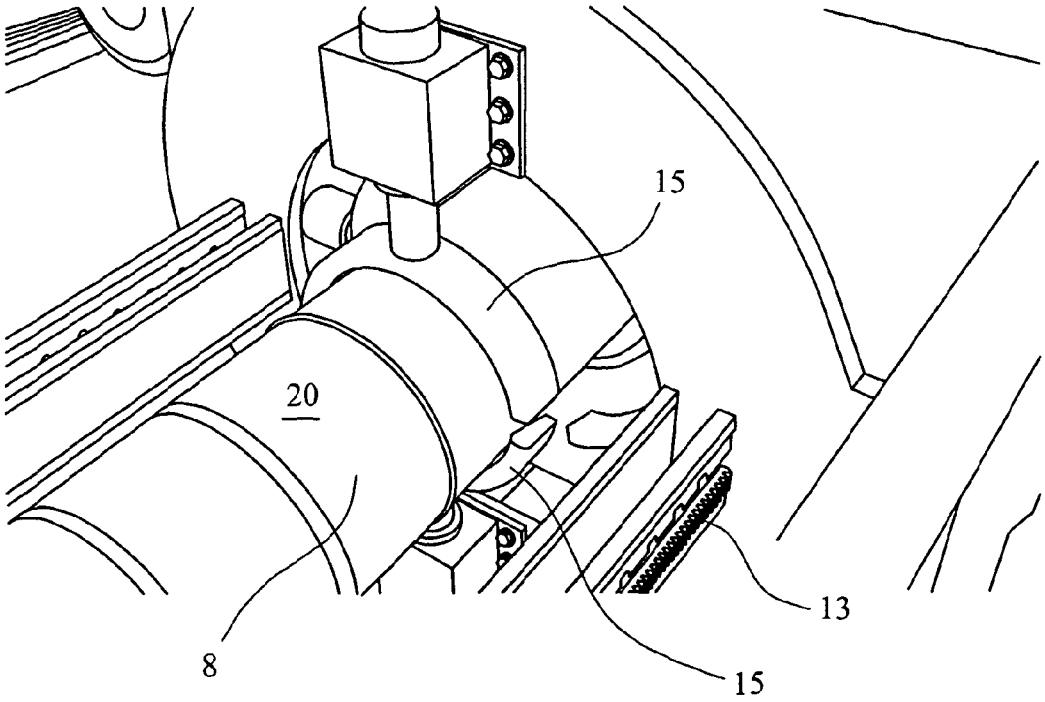
FIG. 6 is a close up perspective view of a fourth stage in loading the annular pile into the remotely operable drilling apparatus.
Figure 7:
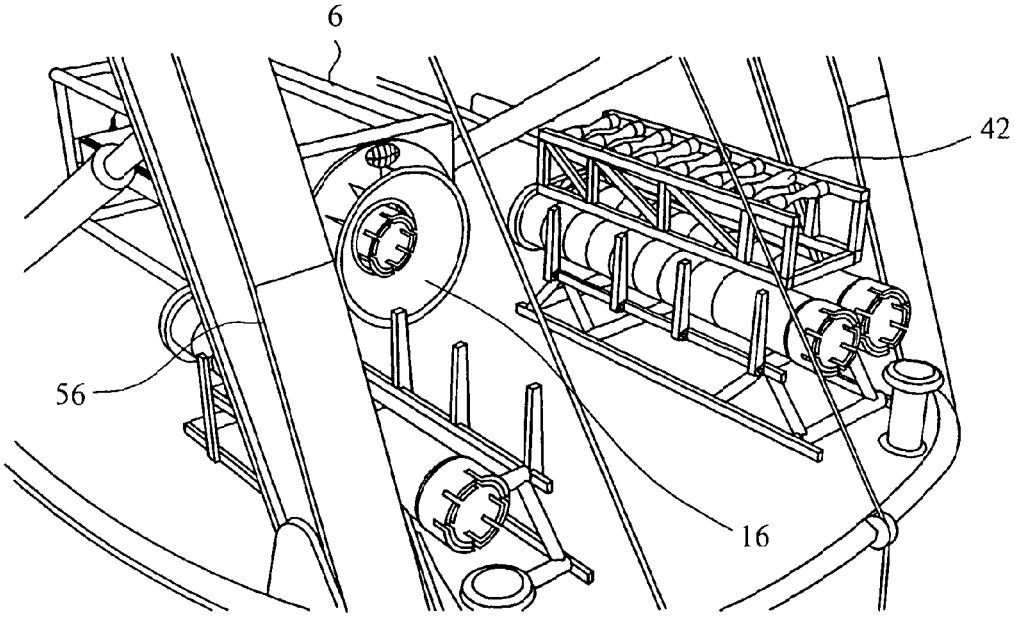
FIG. 7 is a perspective view of the remotely operable drilling apparatus located on a surface vessel and loaded with an annular pile.

Referring to FIGS. 5 and 6, once drive head 11 of the power swivel is connected to locking collar 22, retractable support clamping means such as upper locking clamps 15 are deployed to contact outer cylindrical surface 20 of annular pile 8 as shown in FIG. 6. Upper locking clamps 15 serve two functions. Firstly, they hold annular pile 8 on the centre line of the drilling apparatus 6 whilst being deployed. Secondly, upper clamps 15 also give initial stability whilst drilling to establish a spud of a hole until such time a predetermined hole depth as been established. At this point the upper clamps are retracted clear of the pin pile 8.

Referring to FIG. 7 to 14, submersion of the remotely operable drilling apparatus 6 to an aperture 30 of submerged structure 32 will be described. The method of interconnecting the remotely operable drilling apparatus 6 to the submerged structure 32 adjacent an aperture 30 will also be described.

Figure 8:
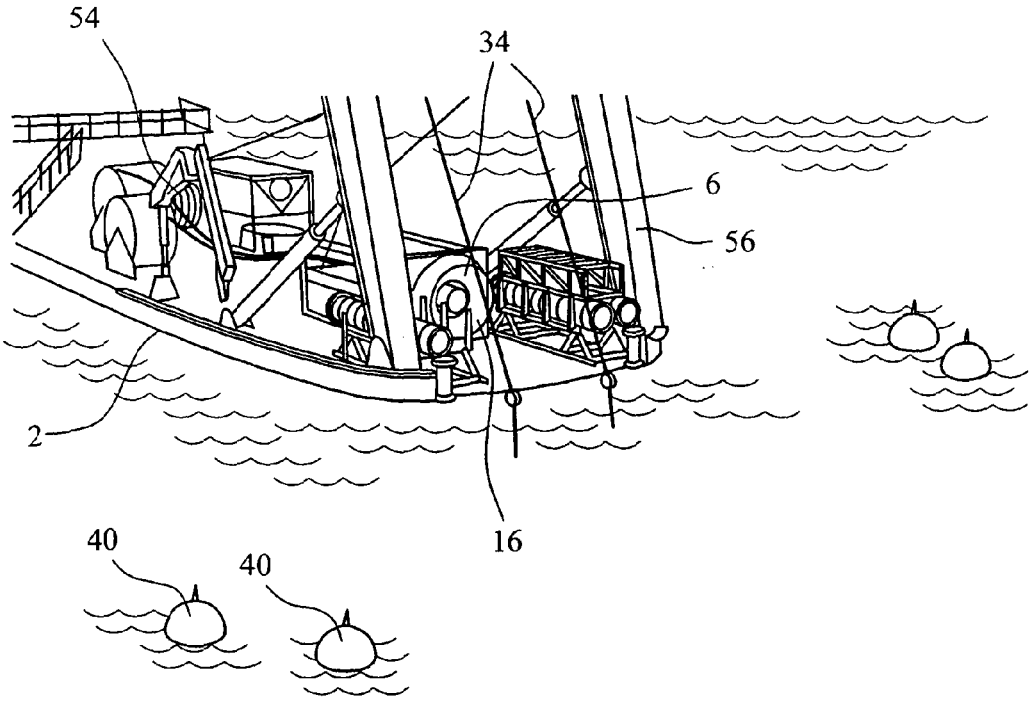
FIG. 8 is a perspective view of a first stage of deployment of the remotely operable drilling apparatus.
Figure 20:
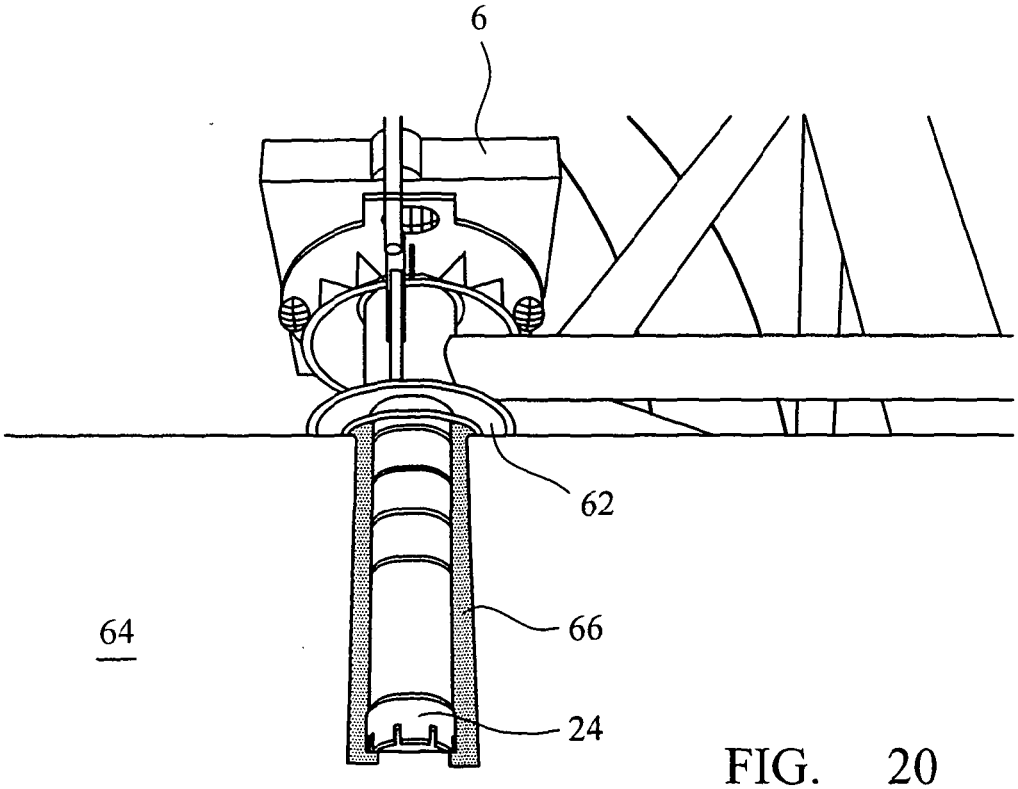
FIG. 20 is a view corresponding to FIG. 19 showing grout after it has been pumped into the annulus.

Firstly, buoys 40 are retrieved and guidelines 34 to which a predetermined pair of buoys 40 are attached are connected to surface vessel 2 by tensioning means. Tensioning means may for example comprise compensation air winches 54. Tension is set in guidelines 34 and this can be slackened during operations if required. The taut guidelines 34 can also be disconnected and buoyed off in the event of an emergency. An A-frame assembly 56 is used to raise the remotely operable drilling apparatus 6 into a vertical configuration and into the water as shown in FIGS. 8 through 10. Guidelines 34 can then be connected to eyelet 36 and post guide 38B of drilling apparatus 6 as shown in FIG. 20.

Referring to FIGS. 11 and 12, the drilling apparatus 6 is then submerged and lowered down guidelines 34 towards aperture 30 of submerged apparatus 32. Submersion and lowering of the drilling apparatus 6 ideally takes place during slack tide when the current is at its weakest. Guide post 38A comes in to contact with post guide 38B and female conical guide 16 comes into contact with male conical guide 18 to locate the annular bit 24 of annular pile 8 into the aperture 30.

Figure 13:
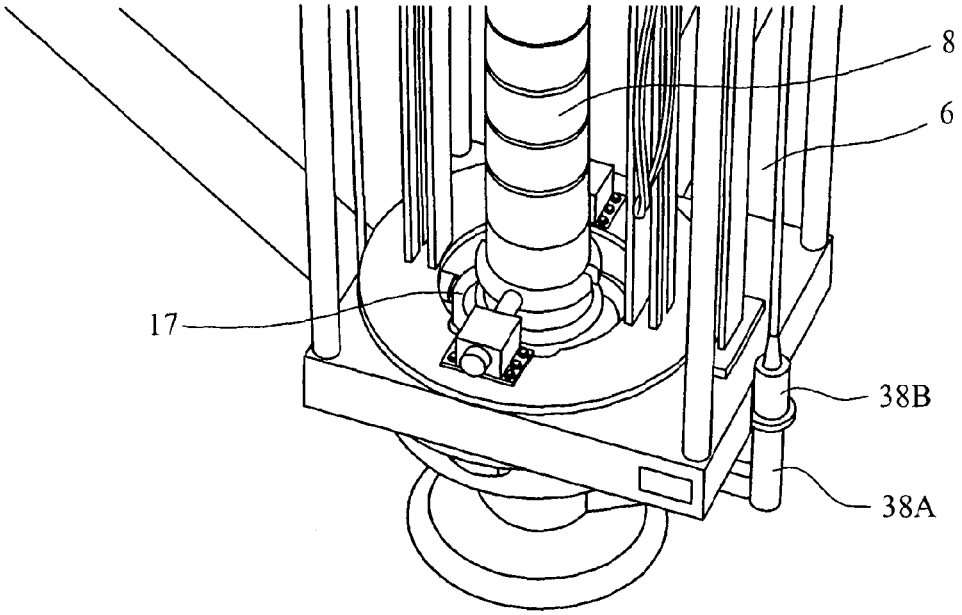
FIG. 13 is a perspective view of the remotely operable drilling apparatus locating itself adjacent an aperture through which the annular pile is to be driven.
Figure 14:
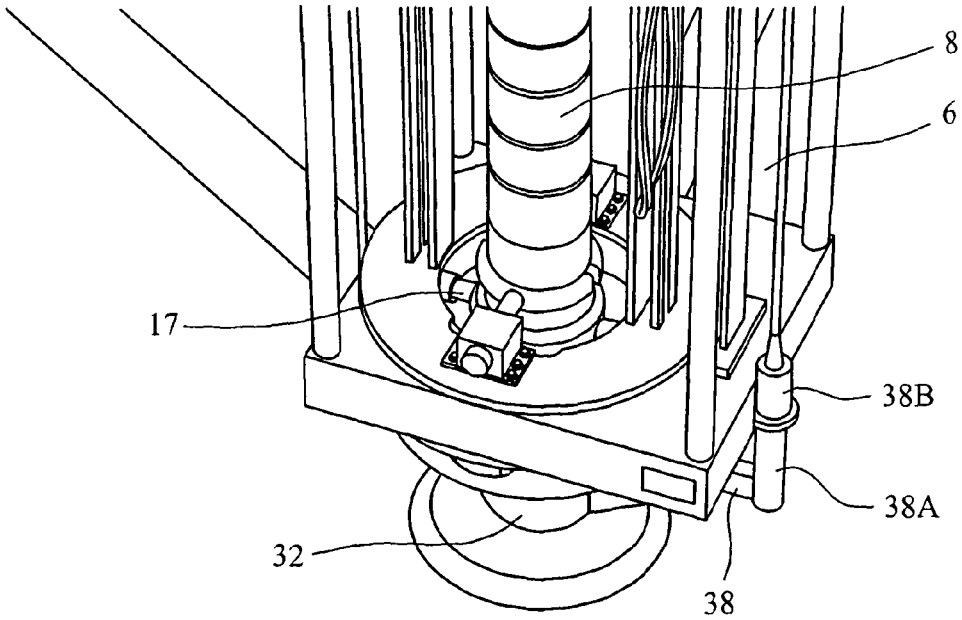
FIG. 14 is a view corresponding to FIG. 13 in which the lower locking clamps have moved into an engaged position around the aperture of the submerged structure to hold the remotely operable drilling apparatus on the structure.

Referring to FIGS. 13 and 14, clamping means such as lower locking clamps 17 are actuated to grip the portion of submerged structure 32 around the aperture. Drilling can now commence in response to delivery of power to the power swivel 12 via umbilical 50 and flushing fluid via the hose 52.

Referring to FIG. 15 to 20, the process of pinning a portion of submerged structure 32 around aperture 30 to the seabed, or a floor of another body of water, will be described.

Figure 15:
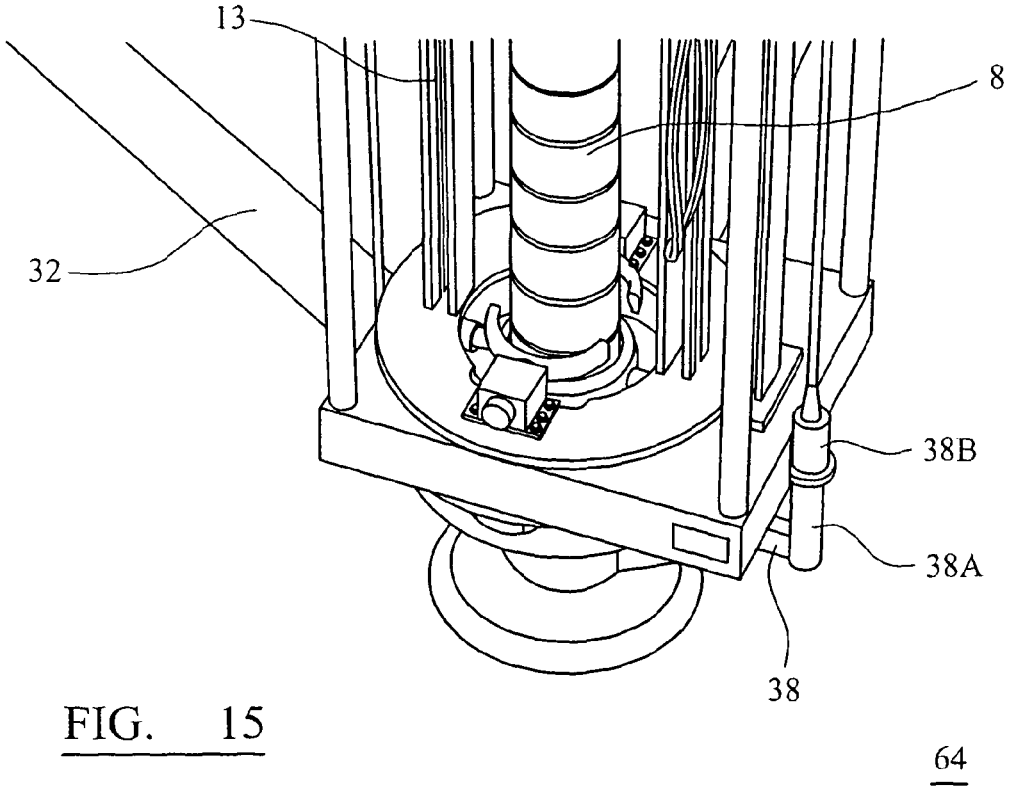
FIG. 15 is a perspective view corresponding to FIGS. 13 and 14 in which drilling has commenced and the upper locking clamps have been retracted in order to allow the locking member to pass through the upper locking clamps.
Figure 16:
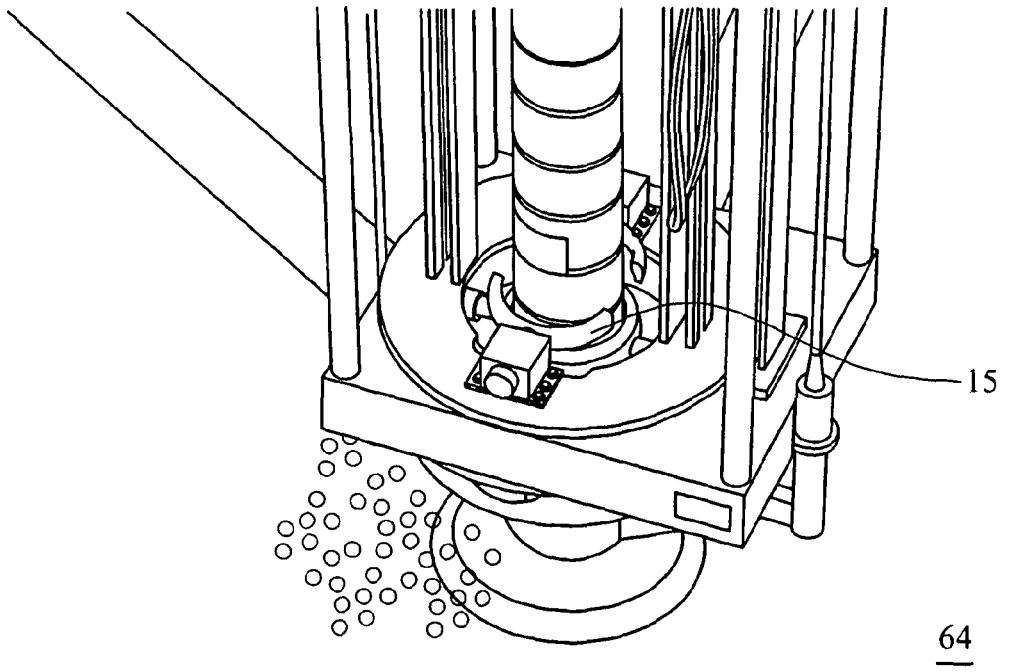
FIG. 16 is a view corresponding to FIG. 15 showing the annular pile being drilled into the seabed.
Figure 17:
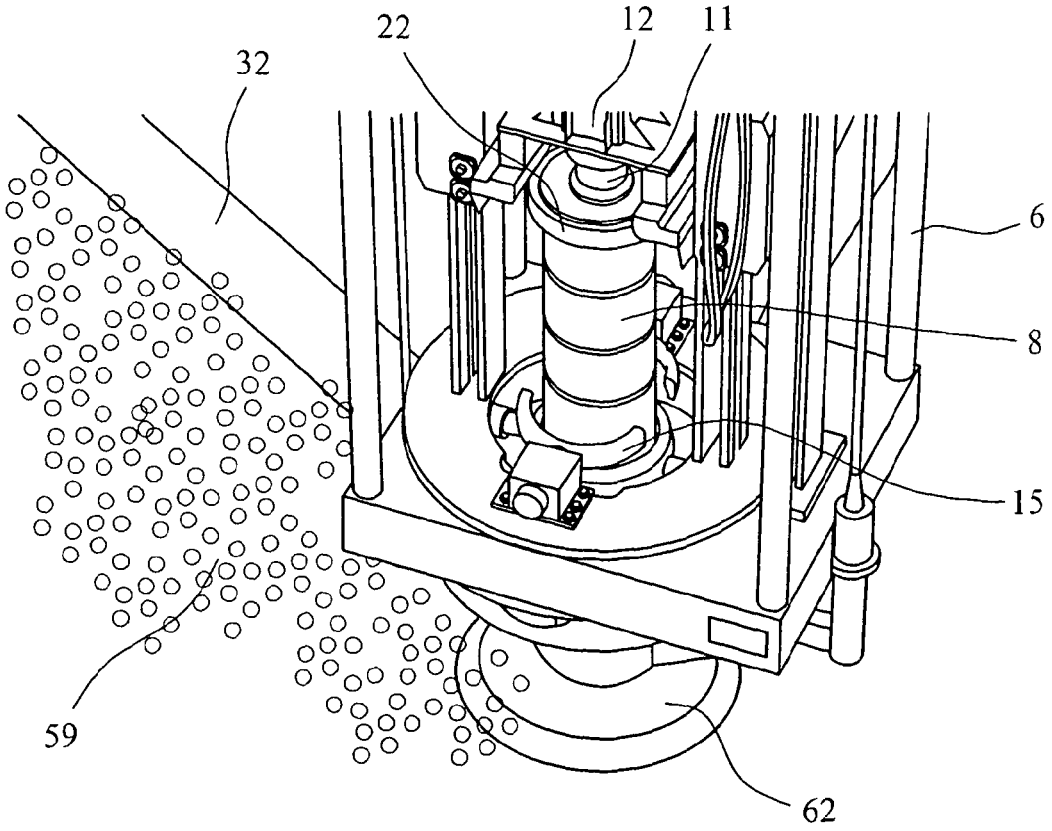
FIG. 17 is a view corresponding to FIG. 16 in a further advanced stage of drilling.

Referring to FIG. 15, drilling commences by powering power swivel (not shown) to rotate drive head 11 (FIG. 22) and therefore rotate annular pile 8. The power swivel is drawn downwardly by a pinion rolling along rack 13. Annular bit 24 is therefore biased against the sea bed and begins to cut an annulus 60 into the rock of seabed 64. After an initial drilling to a predetermined depth, upper clamps 15 are retracted to provide space for locking collar 22 to pass through and into contact with structure 32. The drive bore in collar 22 contains a circumferential sealing arrangement (not shown) to prevent leakage or loss of pressure during either normal flushing fluid or during any grouting operations. Accordingly, flushing fluid is pumped from the service vessel via drilling apparatus 6, through the centre of annular pile 8, up through annulus 60 and out of vent holes 67 to flush out debris 59 produced by the drilling.

Figure 18:
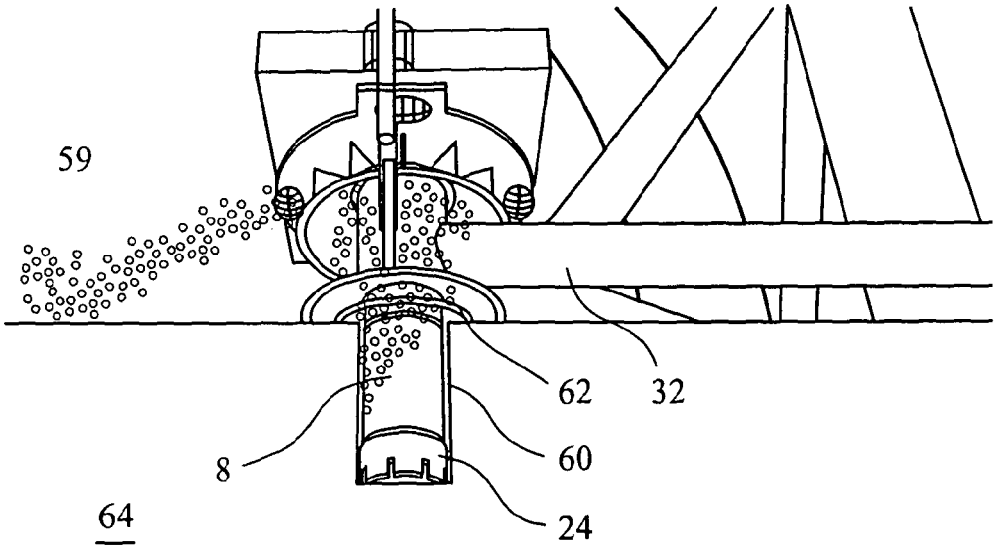
FIG. 18 is a partially cross-sectional perspective view from below showing the annular pile cutting through rock as it is drilled downwardly to form an annulus.

As can be seen from FIG. 18, annular bit 24 creates an annulus 60 through which flushing fluid can pass down the centre of annular pile 8 and out up the sides of annulus 60 to lubricate and cool the annular bit 24 and remove debris 59. Flexible skirt 62 is provided on the base of submerged structure 32 to serve as a cofferdam around the annulus.

Figure 19:
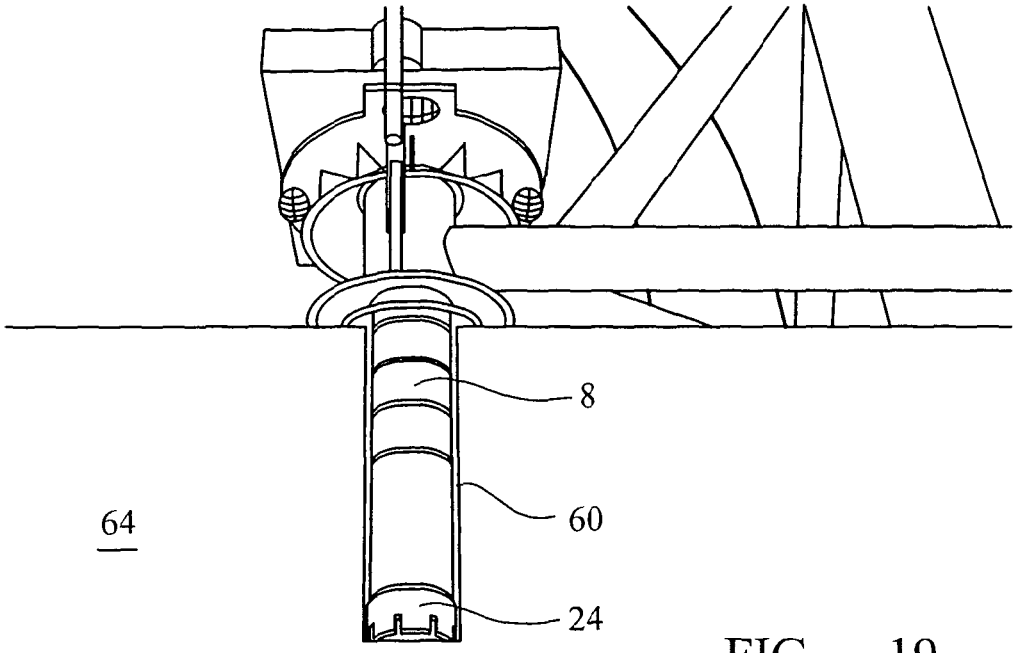
FIG. 19 is a partially cross-sectional perspective view from below showing the final drilling stage.

Referring to FIGS. 19 and 20, when the annular pile 8 is fully drilled into the seabed 64, such that annulus 60 is fully formed, grout 66 can be pumped via hose 52 and out of the delivery means of the apparatus 6 into the centre of annular pile 8. When the grout reaches down as far as the base of annular bit 24, the grout moves up annulus 60 and out into a flexible skirt 62.

FIG. 20 shows the resulting configuration at the end of the grouting operation. During the grouting process, the exhaust to water is via vent holes 67 formed in the circumference of the collar around aperture 30. The vent holes ensure that the grout is pumped into the annulus between the collar and the annular pile. Flexible skirt 62 serves as a cofferdam around the outer surface of the aperture to prevent scouring of the grout should there be any leakage under the footing of the submerged apparatus 32. A rubber flapper (not shown) is also provided inside the top of the pile. This prevents grout being pulled out of the inside of the pile by the vortex effect of the current.

Figure 21:
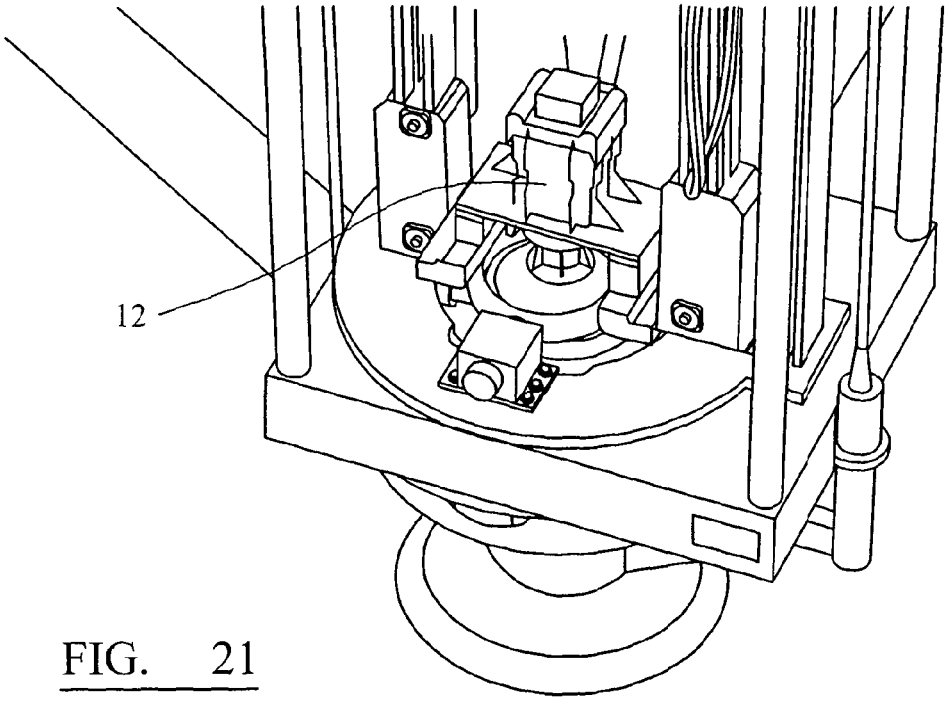
FIG. 21 is a perspective view of the remotely operable drilling apparatus in the condition at the end of drilling.

Referring to FIGS. 21 and 22, drive head 11 of power swivel 12 can then be detached from locking collar 22 and the lower clamps 17 retracted. Drilling apparatus 6 can then be retrieved to the surface leaving annular pile 8 embedded in the seabed and sealed in grout 66 contained in the annulus 60. The locking collar 22 of pin pile 8 therefore pins a portion of structure 32 around aperture 30 to the seabed.

This process can be repeated for other apertures 30 of the structure 32. For example, referring to FIG. 12, submerged structure 32 is a tripod having three apertures. The pinning procedure therefore has to be repeated three times in order to attach structure 32 fully to the seabed. In an alternative embodiment, the remotely operable drilling apparatus may drill the annular pile in to the seabed, and the grouting operation may be performed after by a different apparatus.

The hole drilling operation can be controlled from a control room on vessel 2. Power and hydraulics are provided via the umbilical 50, 52 to the drilling apparatus 6. The umbilical 50, 52 can be disconnected and buoyed off in the event of rough weather and then retrieved to complete the drilling procedure. This can be done even when the drilling apparatus 6 is attached to the structure 32 at the seabed. The drilling apparatus 6 enables the drilling procedure to be conducted throughout the tidal cycle. Deployment and retrieval of the apparatus is preferably conducted during slack tide.

Figure 24:
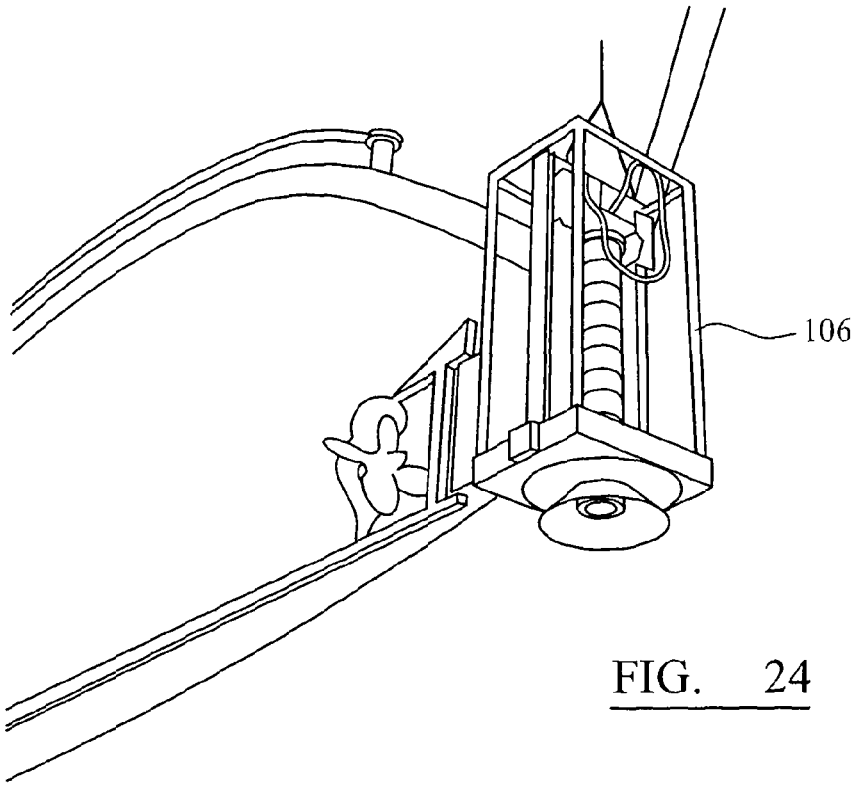
FIG. 24 is a perspective view of a remotely operable drilling apparatus of a second embodiment of the present invention.
Figure 25:
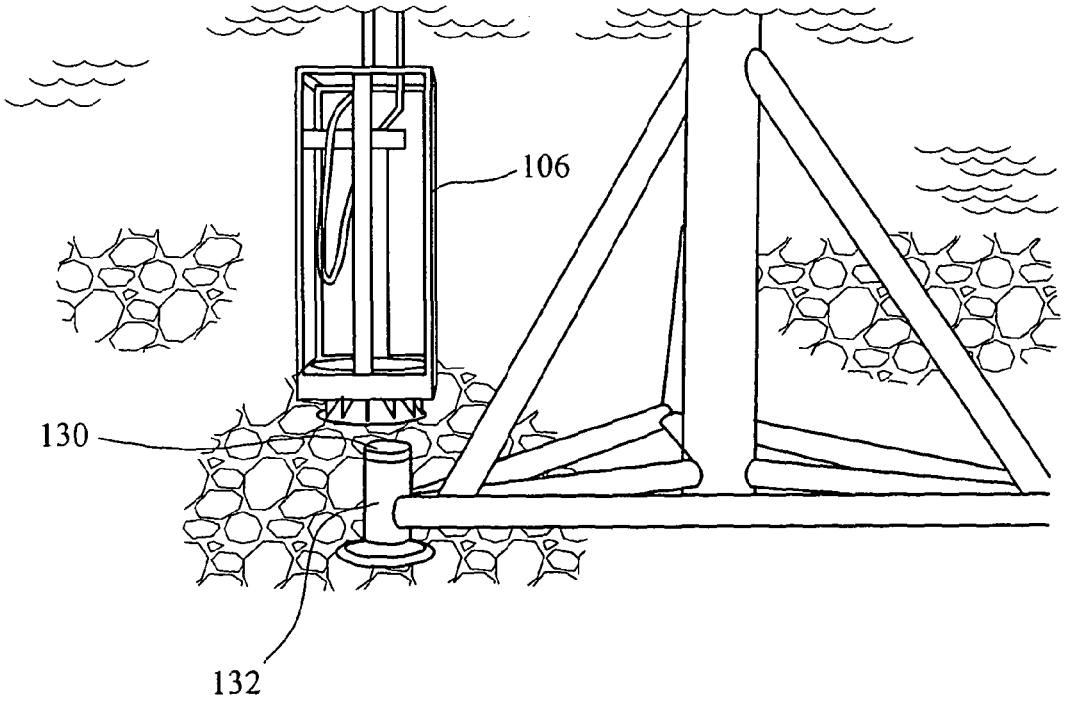
FIG. 25 is a perspective view of the remotely operable drilling apparatus of FIG. 24 located adjacent a structure to be pinned to the seabed.

Referring to FIGS. 24 and 25, a second embodiment of a drilling apparatus 106 does not use guidelines to be located on aperture 130 of structure 132. In this embodiment, the movement of the drilling apparatus 106 can be controlled from the surface using cameras to locate the drilling apparatus 106 on aperture 130.

A method of attaching an anchor member to a floor of a body of water, a remotely operable drilling apparatus, a system for attaching an anchor member to a floor of a body of water and an anchor member of a third embodiment of the invention is shown in FIG. 27 to 50, with parts common to the embodiment of FIG. 1 to 23 shown with like reference numerals but increased by 200.

Figure 28:
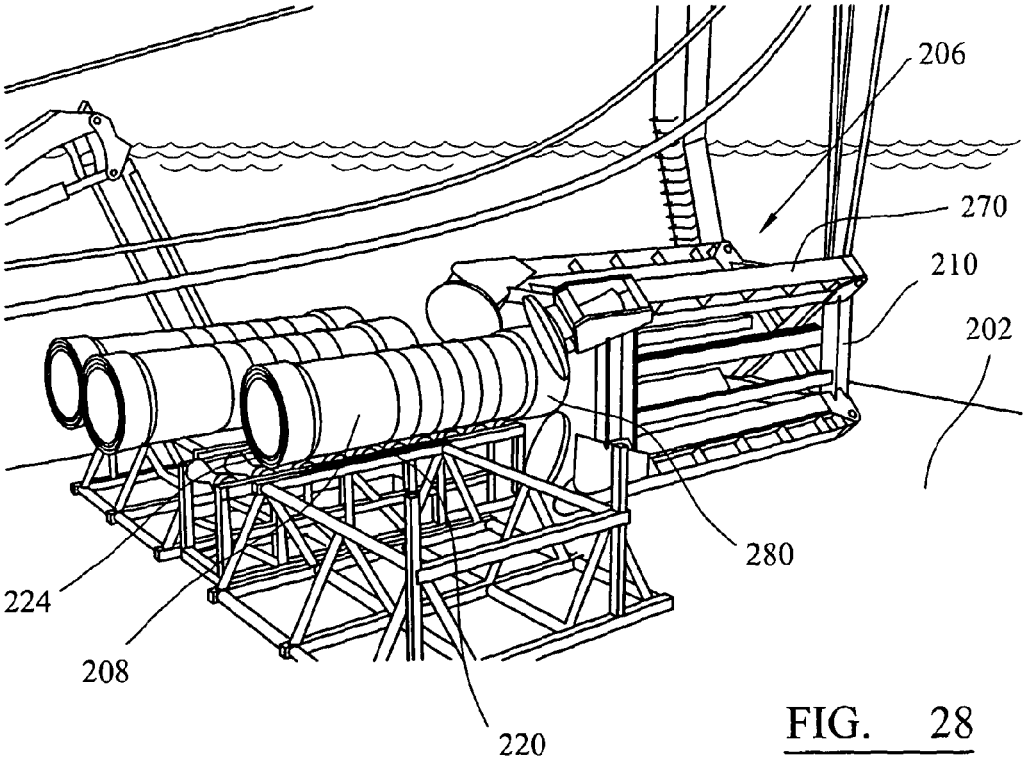
FIG. 28 is a perspective view showing the loading of an anchor member into the remotely operable drilling apparatus of FIG. 27.

A remotely operable drilling apparatus 206 is located on the deck of a vessel 202. A plurality of anchor members each comprising an annular pile 208 are arranged to be loaded into the drilling apparatus 206. FIG. 28 shows the first stage of loading a pile 208 into the remotely operable drilling apparatus 206. The loading process is substantially the same as that of the first embodiment and described with reference to FIG. 1 to 7 above, with the exception that when anchor member 208 has been fully retracted into apparatus 206, flexible skirt 262 is mounted to the underside of the drilling apparatus 206, making flexible skirt 262 the last item to be installed prior to deployment. Flexible skirt 262 can be attached to the drilling apparatus by means of breakaway attachments such as tie wraps. The remotely operable drilling apparatus 206 is now ready for deployment.

Figure 30:
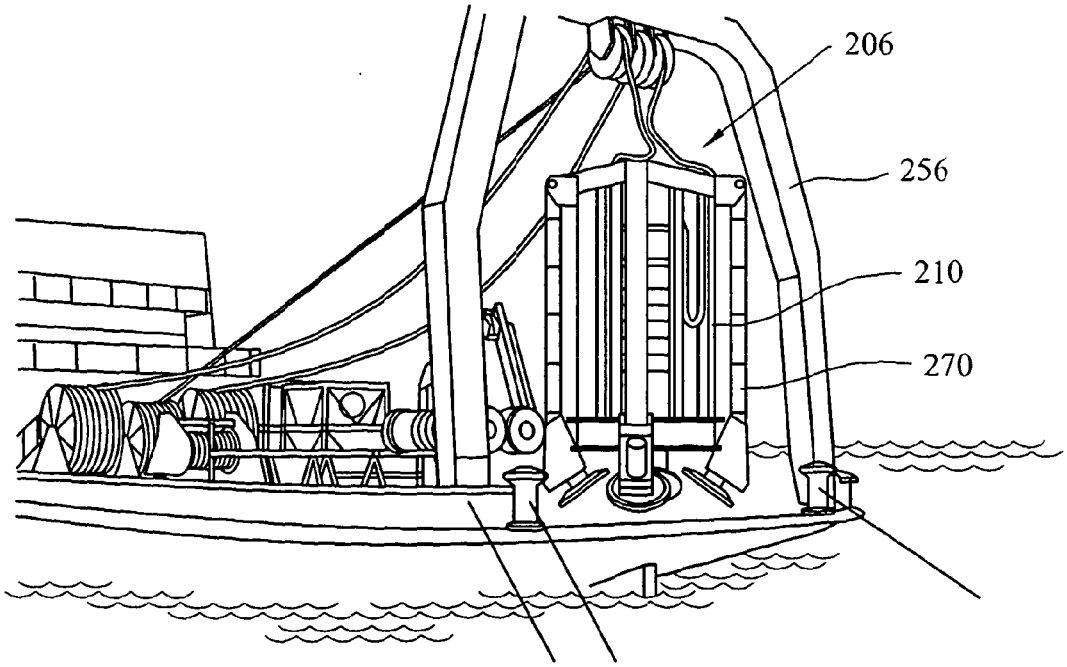
FIG. 30 is a perspective view showing the first stage of lowering the remotely operable drilling apparatus of the second embodiment of the present invention into a body of water.
Figure 31:
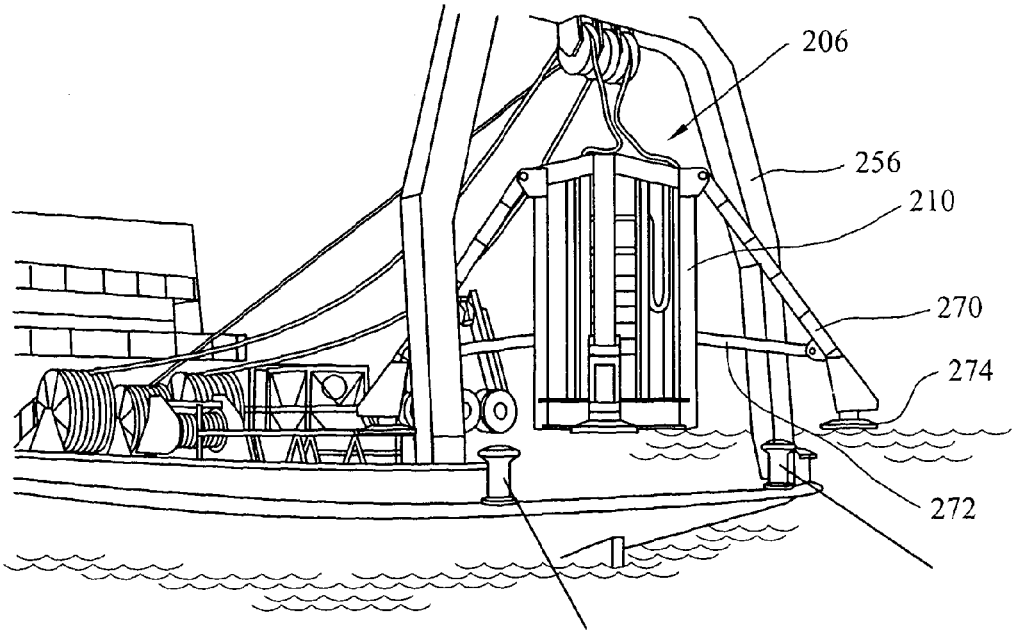
FIG. 31 is the next stage compared to FIG. 29 of lowering the remotely operable drilling apparatus of the second embodiment of the present invention into a body of water in which the legs of the drilling apparatus have been extended.

Referring to FIGS. 30, 31, 37 and 38, the remotely operable drilling apparatus 206 comprises a body formed from a frame 210. A support means is provided to enable the remotely operable drilling apparatus 206 to support itself on a floor of a body of water 264 and provide a reaction force during drilling of the annular pile. The support means comprises a plurality of retractable legs 270 which can be retracted inwardly and outwardly of the frame 210 as shown in FIGS. 30 and 31. The legs 270 may be deployed by hydraulic or electrical means acting on support beams 272.

Figure 37:
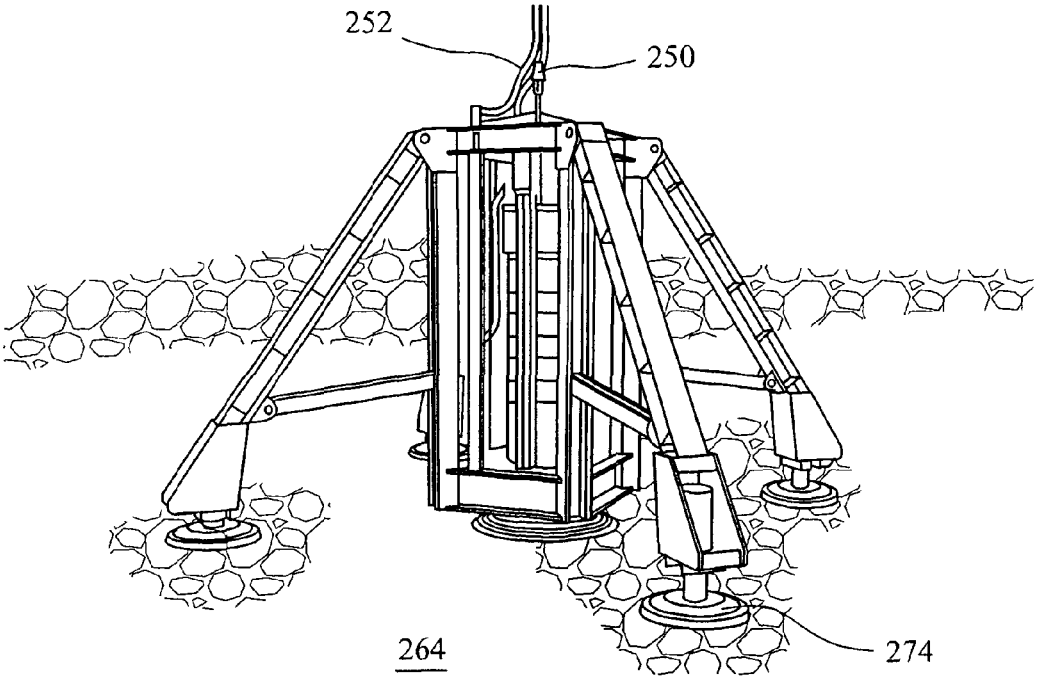
FIG. 37 shows the remotely operable drilling apparatus in a condition in which the longitudinal axis of the annular pile is not perpendicular to the floor of the body of water.
Figure 38:
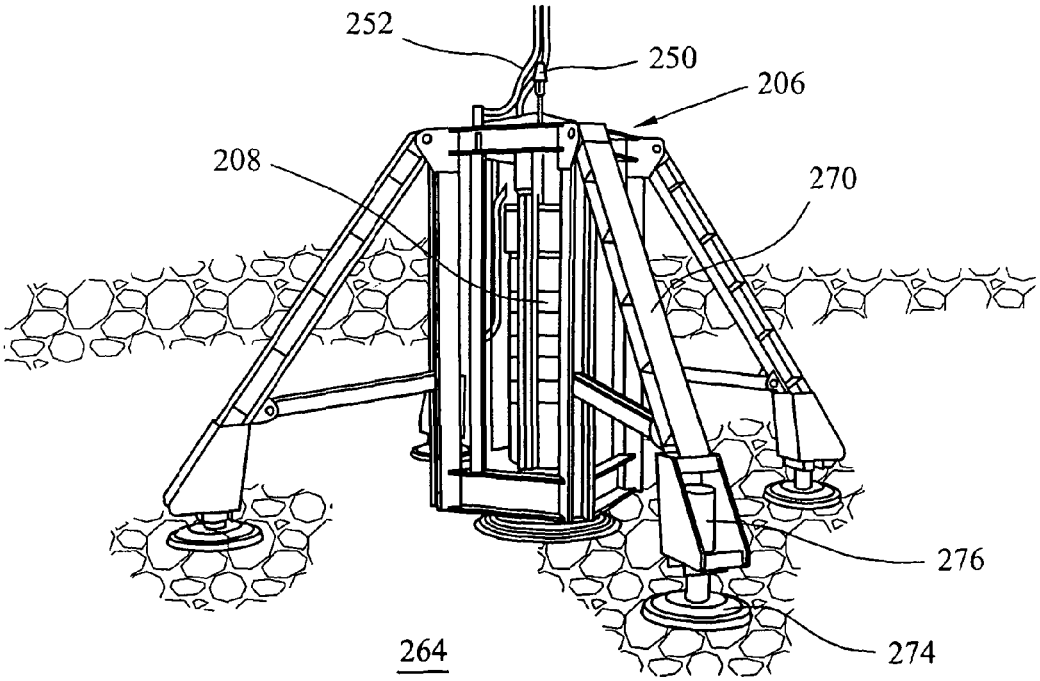
FIG. 38 shows the adjustment of the shoe portions of the remotely operable drilling apparatus to move the longitudinal axis of the annular pile into a position in which it is perpendicular to the floor of the body of water.
Figure 39:
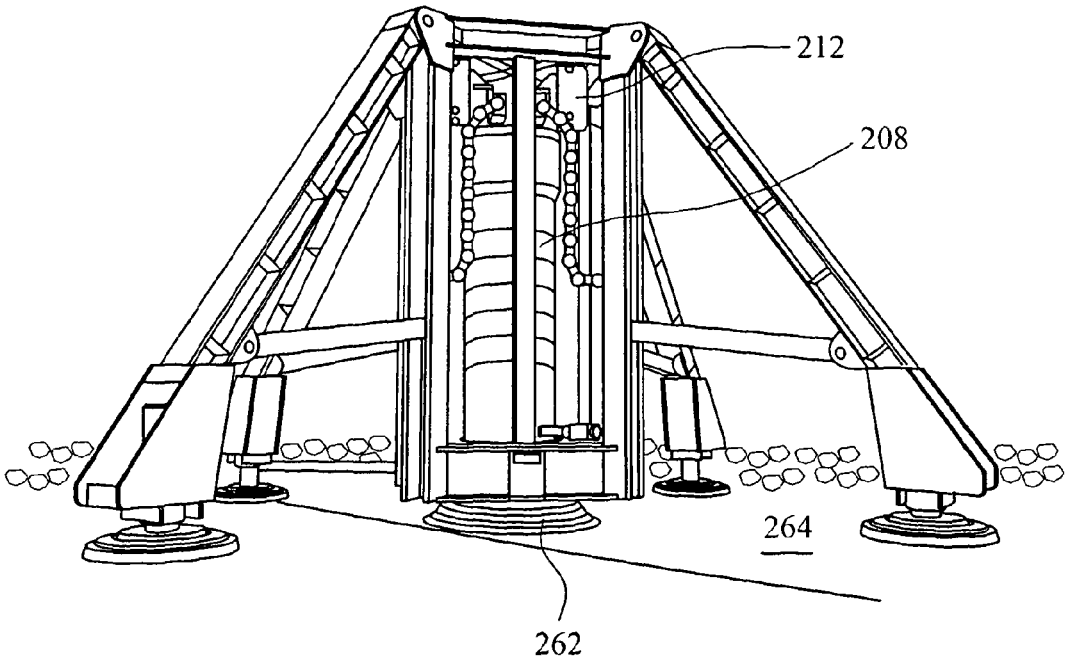
FIG. 39 is a perspective view from the side showing the first stage of drilling with the annular pile.
Figure 40:
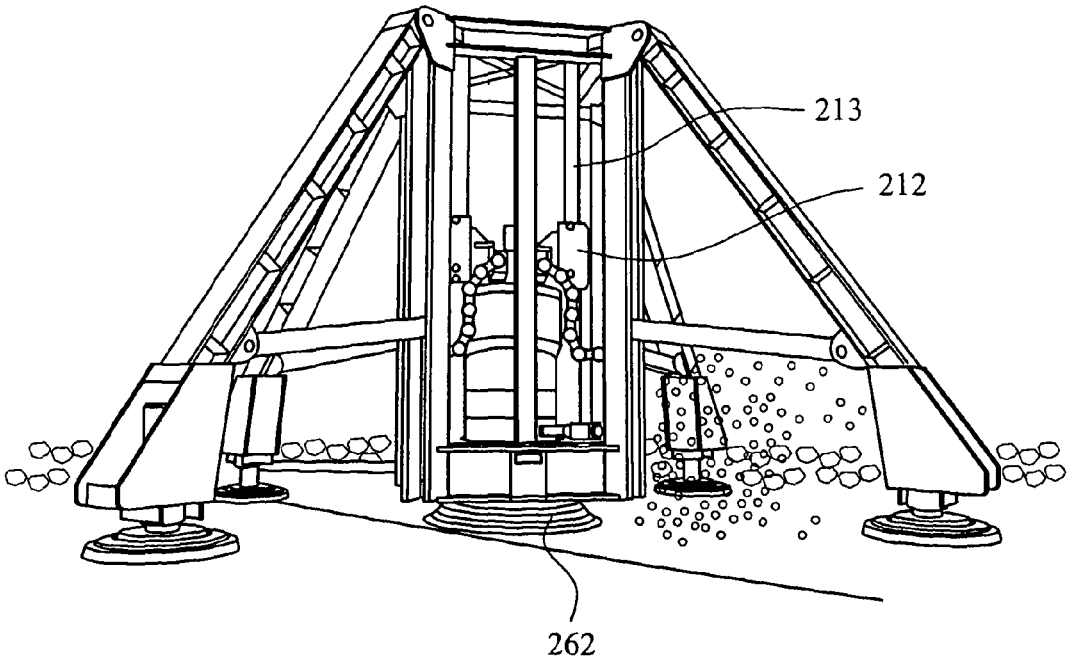
FIG. 40 is a perspective view from the side showing the second stage of drilling.
Figure 41:
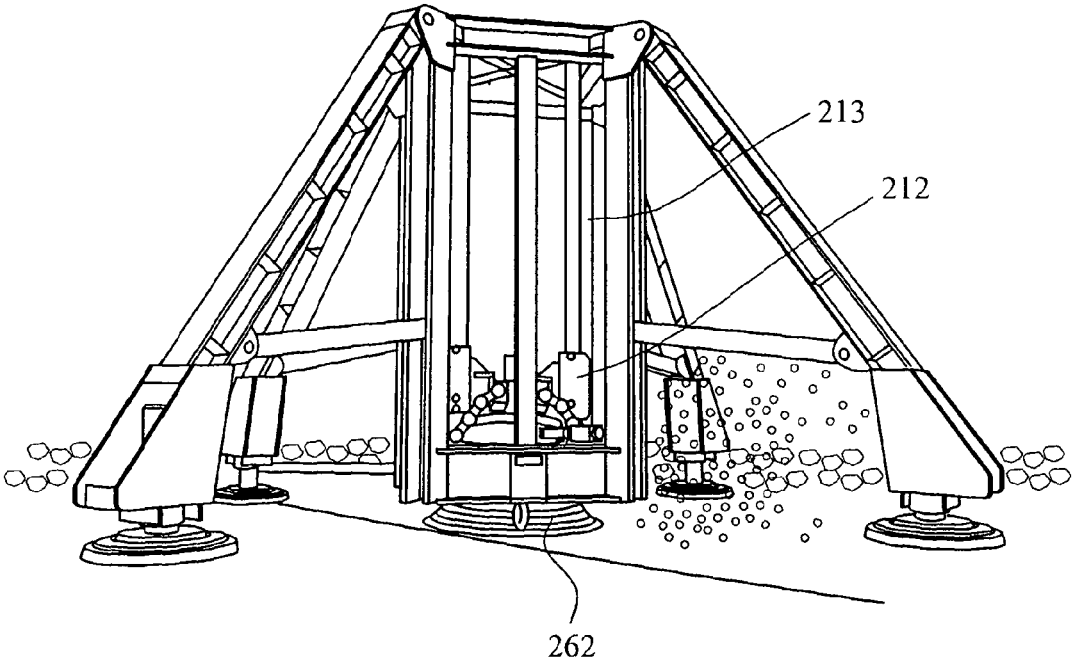
FIG. 41 is a perspective view from the side showing the final stage of drilling.
Figure 42:
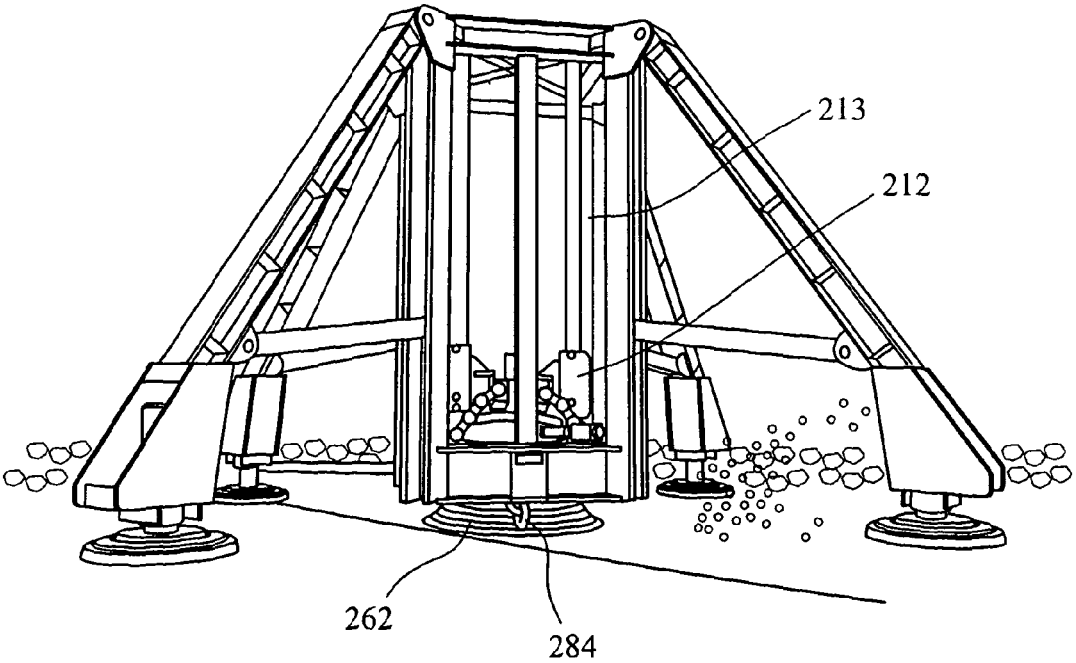
FIG. 42 is a perspective view from the side showing drilling completed.

An adjustable shoe portion 274 is disposed on the end of each leg 270. Shoe portions 274 are adjustable to change the length from which and/or the angle at which the respective shoe portion 274 extends from the corresponding leg 270. In the example shown, shoe portions 274 are mounted on the end of piston assemblies 276 to enable the shoe 274 to extend relative to the leg 270. For example, as shown in FIGS. 37 and 38, the shoe portion 274 closest to the front of the drawing is extended by piston 276 in order to level the drilling apparatus 206 to a condition in which the longitudinal axis of the annular pile 208 is substantially perpendicular to the floor of the body water 264 on which the drilling apparatus 206 rests. The pistons 276 can be controlled remotely from the surface under hydraulic and electrical power. Consequently, remotely operable drilling apparatus 276 does not require mounting to a submerged structure to provide a reaction force for drilling.

Figure 27:
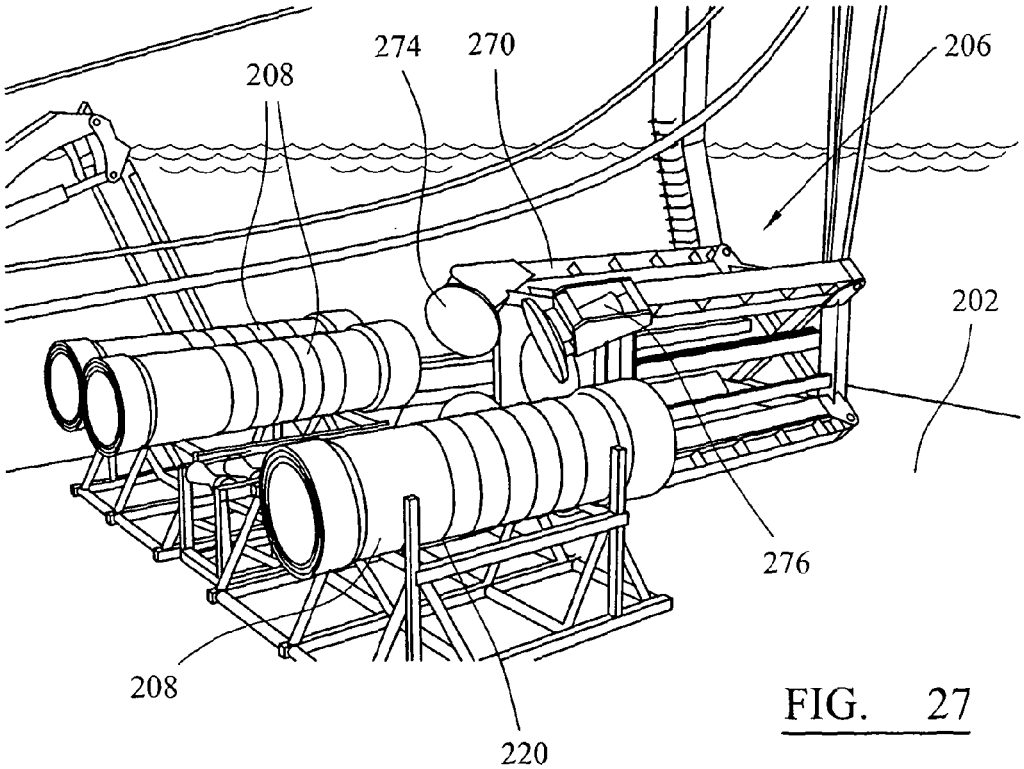
FIG. 27 is a perspective view of a remotely operable drilling apparatus and several anchor members of a third embodiment of the present invention.
Figure 45:
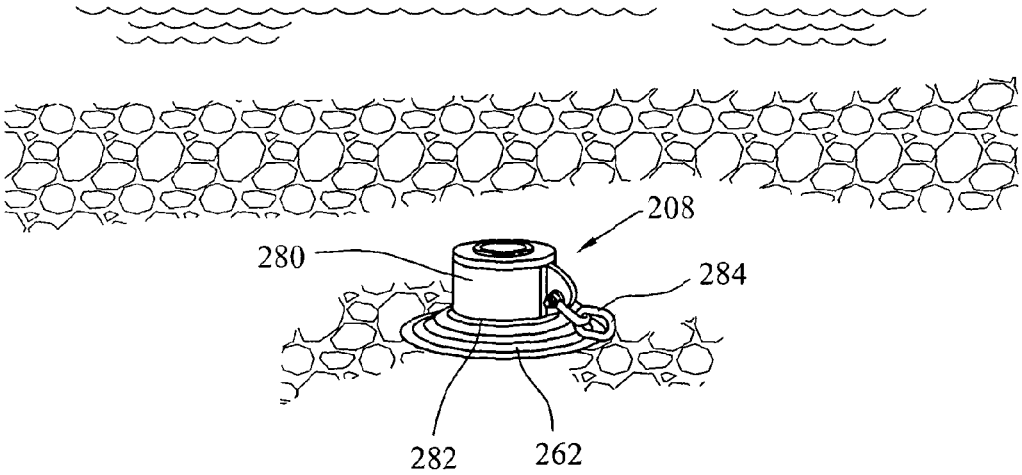
FIG. 45 is a second perspective view of the anchor member sealed in the floor of the body of water.
Figure 46:
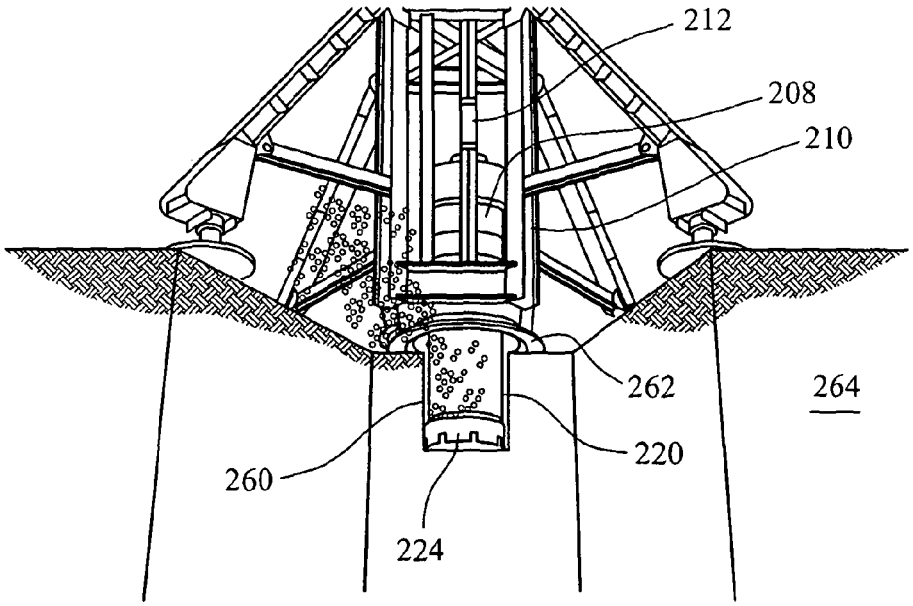
FIG. 46 is a perspective view from below showing a cut away portion of the floor of the body of water showing the stage of drilling corresponding to FIG. 40.
Figure 47:
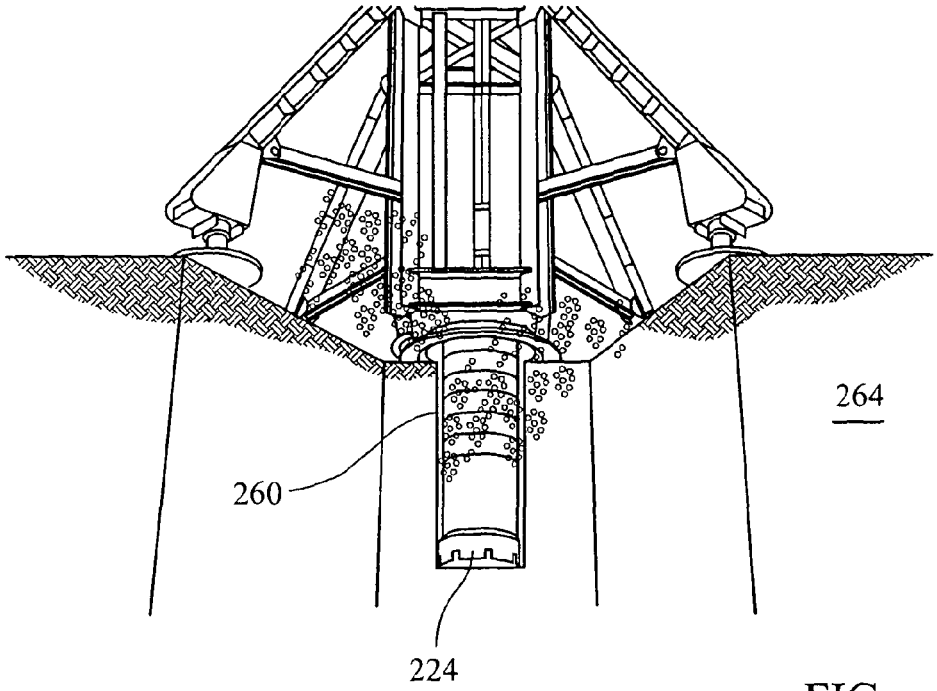
FIG. 47 is a second stage of drilling shown from below.
Figure 48:
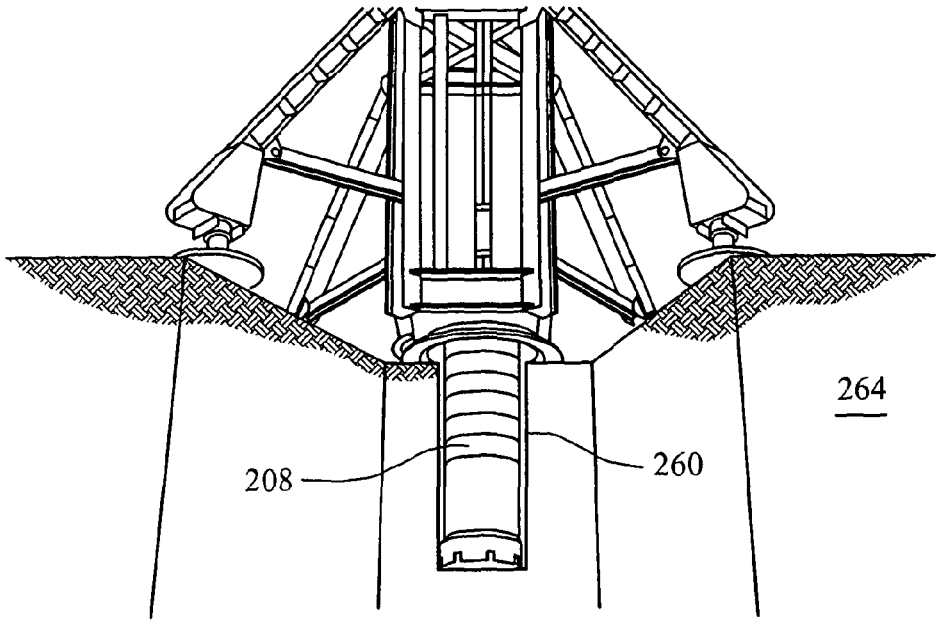
FIG. 48 shows drilling completed.
Figure 49:
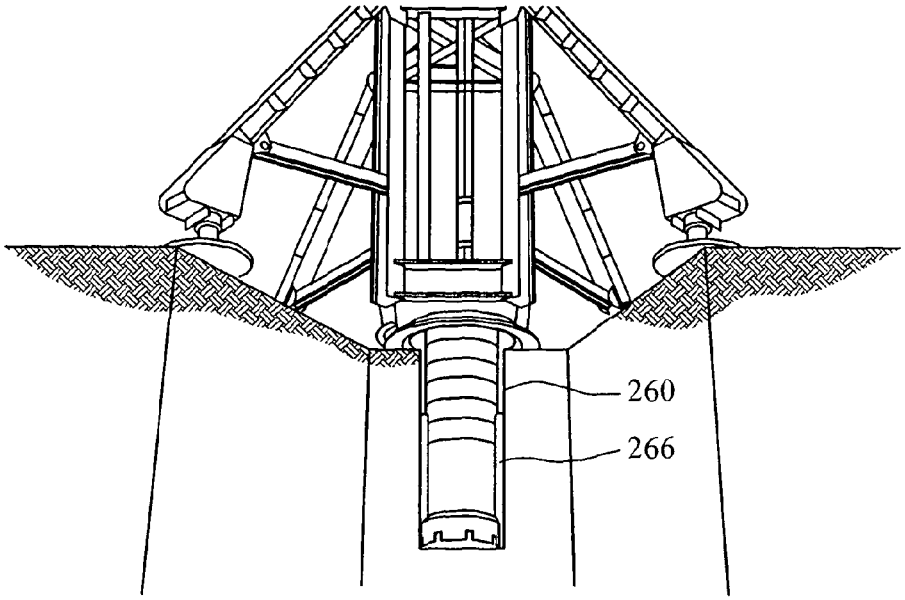
FIG. 49 is a perspective view from below showing grout being pumped into the drilled annulus.
Figure 50:
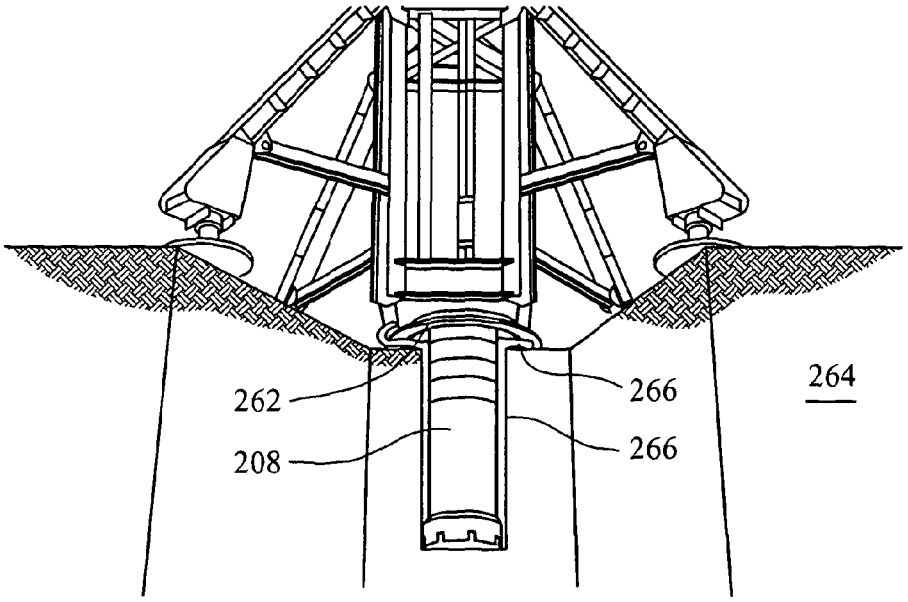
FIG. 50 shows the final stage of grouting the annular pile.

Referring to FIGS. 27, 45 and 46, the anchor member of the second embodiment, annular pile 208 comprises a substantially hollow shaft 220, an anchor means which in this embodiment comprises attachment means 280 at a first end of the shaft 220, the attachment means being suitable for attachment to a submerged structure, and an annular bit 224 at a second end of the shaft 220. Annular bit 224 is a hardened cutting shoe arranged to be able to drill into a hard rock formation and form an annulus.

Referring to FIG. 45, attachment means 280 comprises a sleeve 282 rotatably mounted on shaft 220. At least one eye 284 is attached to the sleeve 280 to enable a submerged or floating structure to be tethered to the attachment means 280. A flexible skirt 262 is also provided to assist during the grouting operation in the same manner as described in accordance with the first embodiment. Consequently, the anchor member 208 of the second embodiment may be drilled and grouted into the floor of a body of water by remotely operable drilling apparatus 206 and then left in the floor of the body of water to enable a submerged structure to be tethered to the eye 284 at a later point in time.

The method of attaching an anchor member 208 to a floor of a body of water in accordance with the second embodiment of the present invention will now be described with reference to FIG. 27 to 50.

Figure 29:
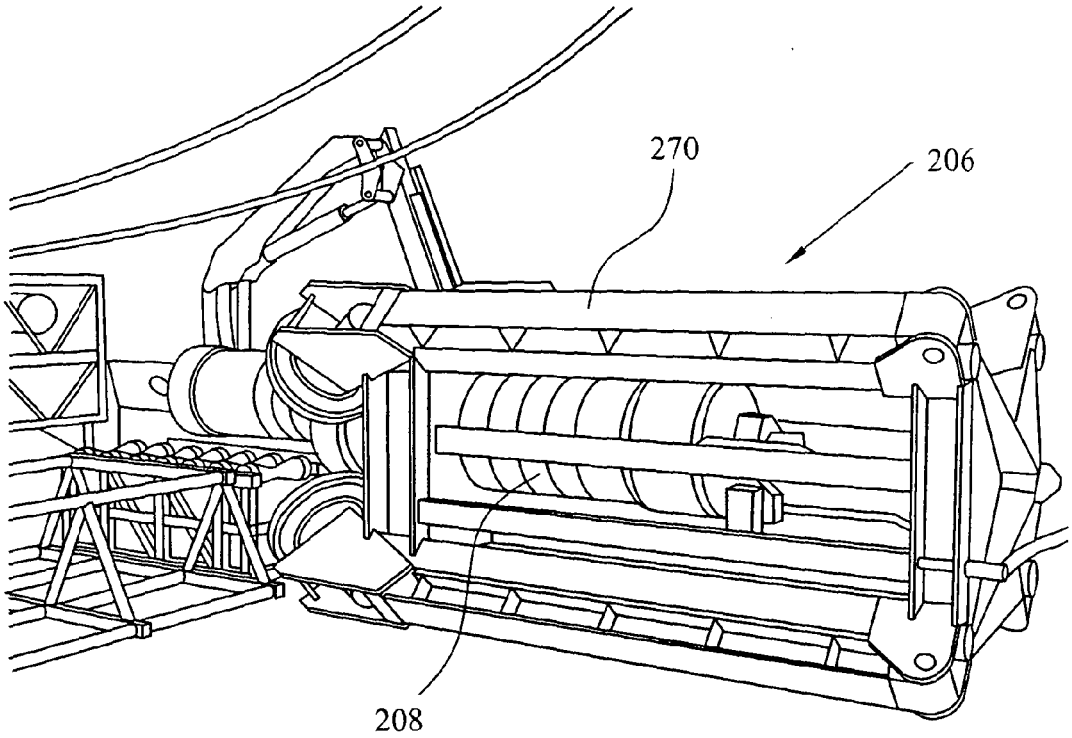
FIG. 29 is the next stage of loading the anchor member into the drilling apparatus of FIG. 28.

Firstly, referring to FIG. 27 to 29, the anchor member 208 is loaded into the remotely operable drilling apparatus 206 as shown in FIG. 27 to 29. This process is substantially the same as has been described in connection with the first embodiment and therefore will not be described in any further detail here. However, one difference is the attachment of flexible skirt 262 to the underside of the drilling apparatus 206 prior to deployment as described above.

Figure 32:
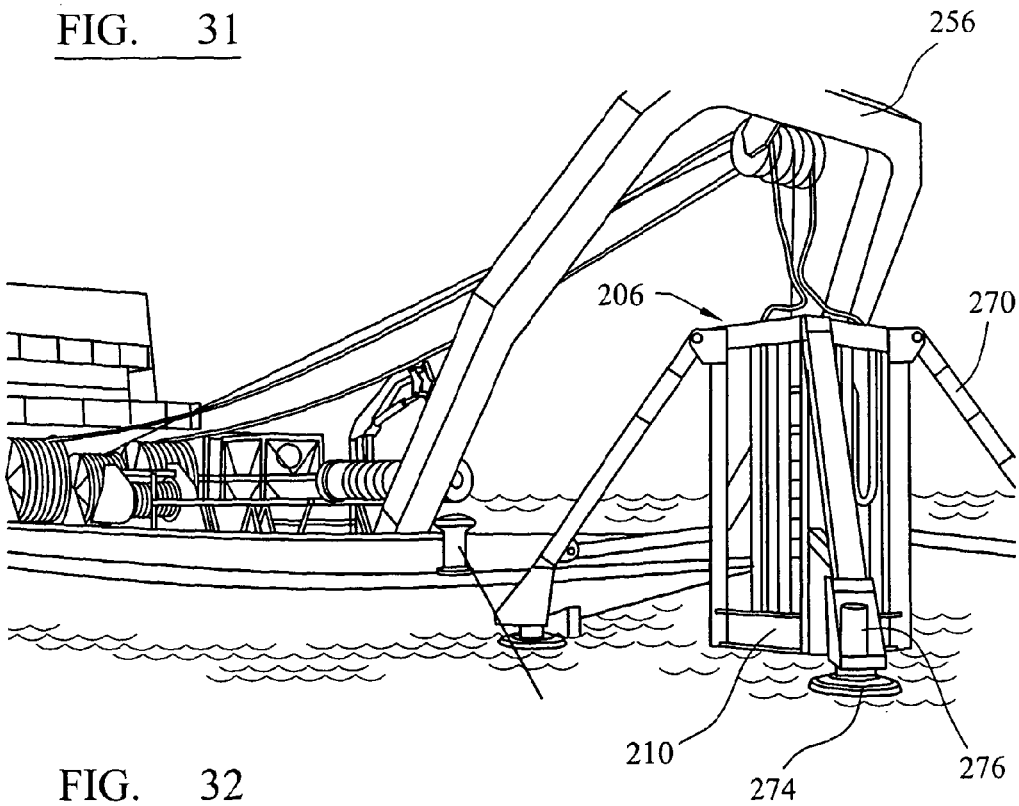
FIG. 32 is the next stage of the lowering the remotely operable drilling apparatus into a body of water compared with FIG. 31.

Referring to FIG. 30 to 32, A-frame assembly 256 is used to raise the remotely operable drilling apparatus 206 into a vertical condition and is then tilted over as shown in FIG. 32 to lower the remotely operable drilling apparatus 206 into the water. At the same time, retractable legs 270 are deployed to the outward condition as shown in FIGS. 31 and 32.

Figure 33:
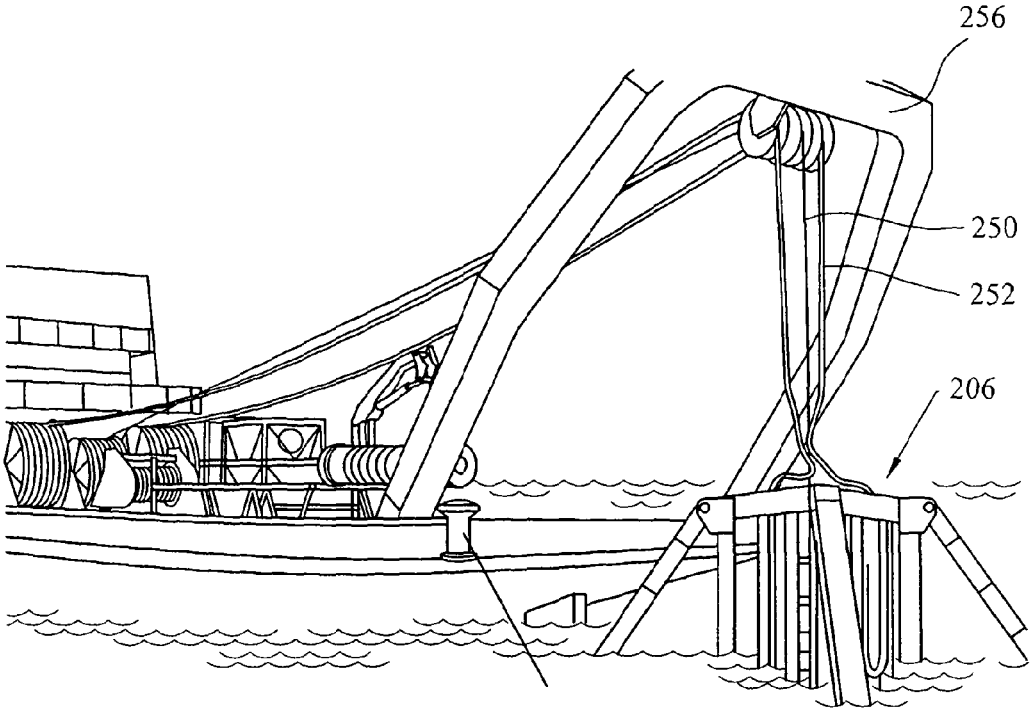
FIG. 33 shows the remotely operable drilling apparatus being submerged.
Figure 34:
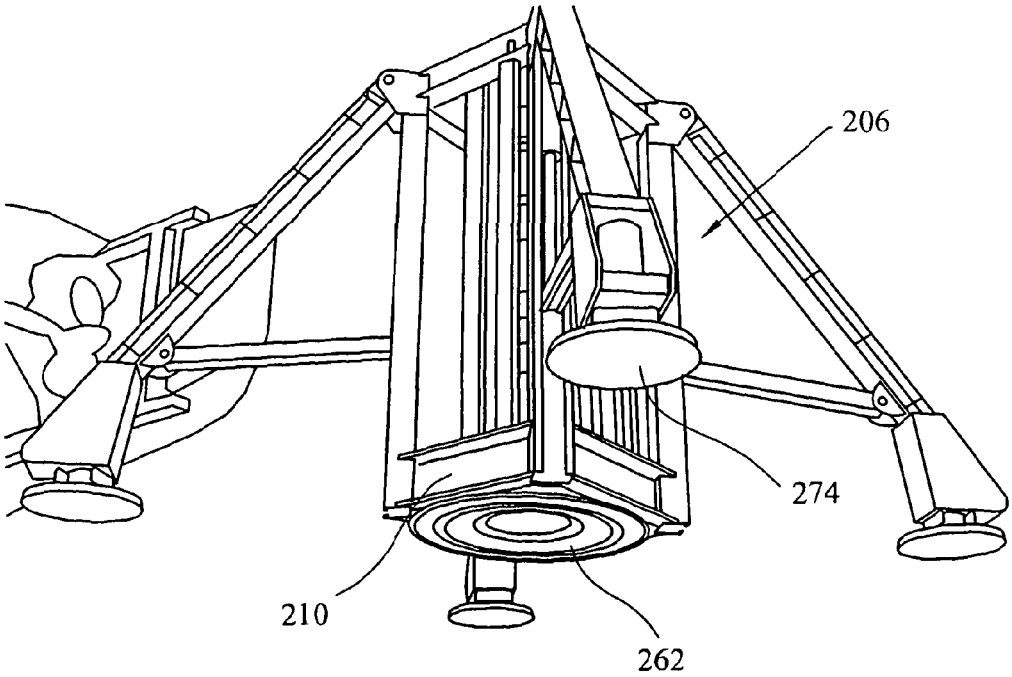
FIG. 34 is a perspective view from underneath the remotely operable drilling apparatus showing the drilling apparatus being lowered into a body of water.

Referring to FIG. 33 to 35, the drilling apparatus 206 is lowered on an umbilical comprising a cable 250 and at least one hose 252 to the floor 264 of the body of water.

Referring to FIGS. 37 and 38, the remotely operable drilling apparatus 206 is then levelled on the floor of the body of water such that the longitudinal axis of the anchor member 208 is substantially perpendicular to the floor 264 of the body of water. This is accomplished by adjusting pistons 276 and feet 274 as explained above. Consequently, any angle or undulation in the floor of the body of water can be accounted for.

Referring to FIG. 39 to 50, the drilling and grouting process will now be described. Power swivel 212 is operated to rotate annular pile 208. Power swivel 212 is then advanced downwardly along rack 213. This causes cutting shoe 224 to drill an annulus 260 (FIG. 45 to 50) in the floor of the body of water. At the same time, flushing fluid is supplied to power swivel 212 via delivery means to flush out debris from the annulus being cut.

As the annular pile 208 approaches total drilling depth, a shoulder (not shown) immediately below the anchor means engages the flexible skirt 262 forcing the breakaway attachments (not shown) to the drilling apparatus 206 to sever. As the flexible skirt 262 comes into contact with the seabed, the flexible skirt is compressed further assisting in providing a seal once grout is in place.

Figure 43:
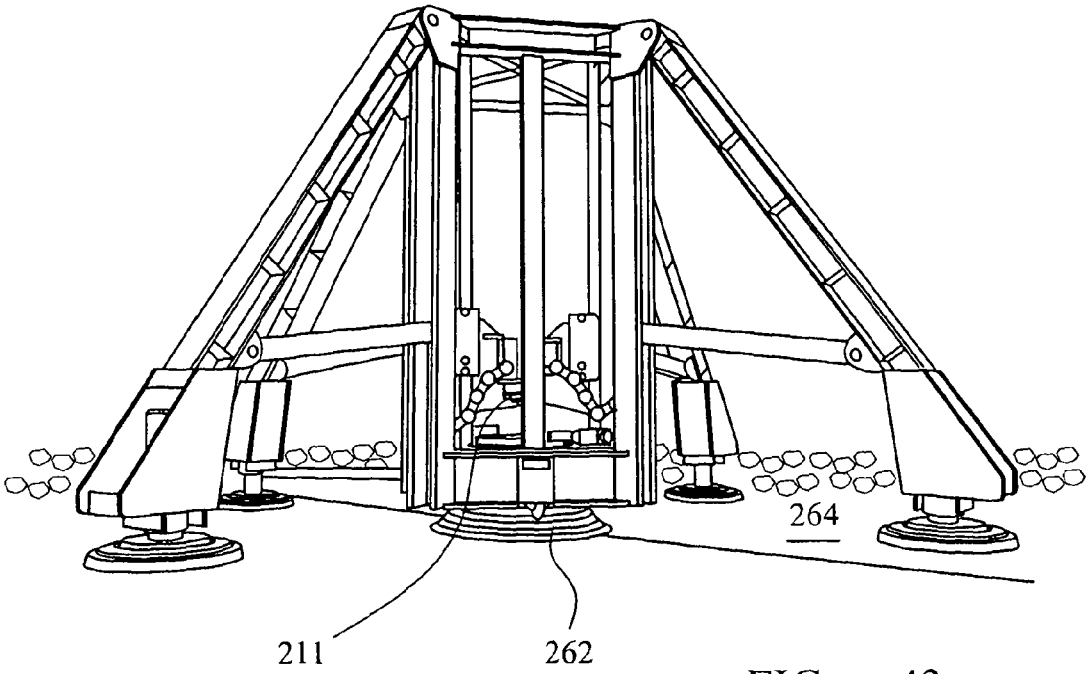
FIG. 43 is a perspective view from the side showing detachment of the drive means from the annular pile.
Figure 44:
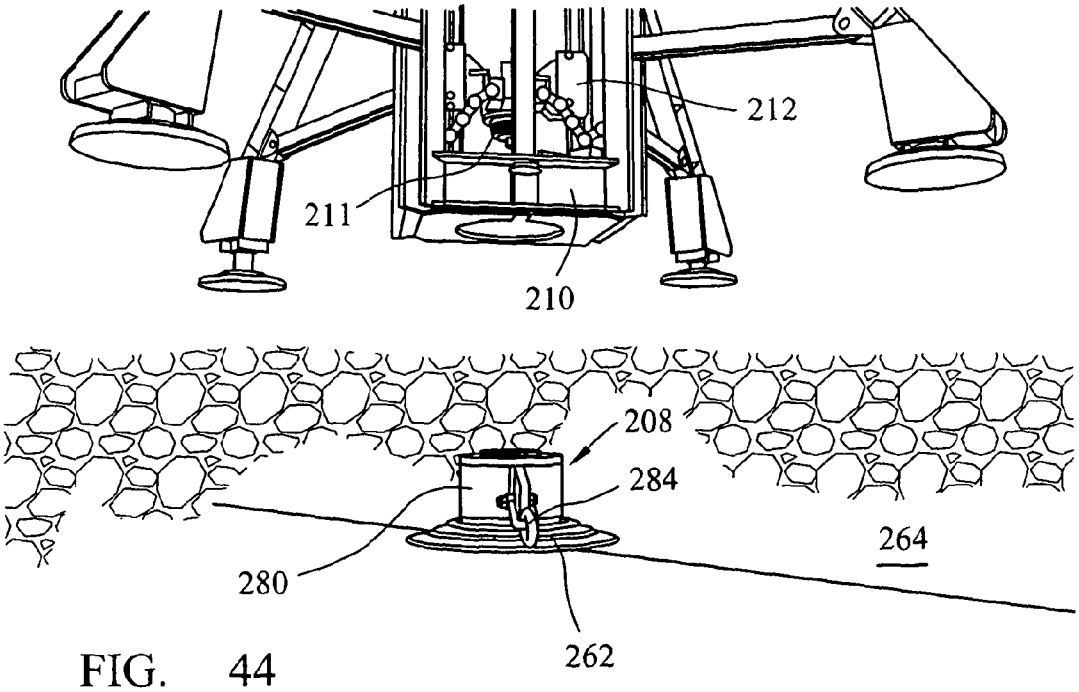
FIG. 44 shows the remotely operable drilling apparatus being raised away from the anchor member which is sealed in the floor of the body of water.

Once the annular pile 208 has been drilled to its full extent into the floor of the body of water (FIGS. 42, 48, 49 and 50), grout 266 is pumped into the annulus 260 to enable sealing of the annular pile 208 in the floor of the body of water 264. The drive head 211 is then disconnected as shown in FIGS. 43 and 44 and the drilling apparatus 206 is retrieved to the surface.

Figure 51:
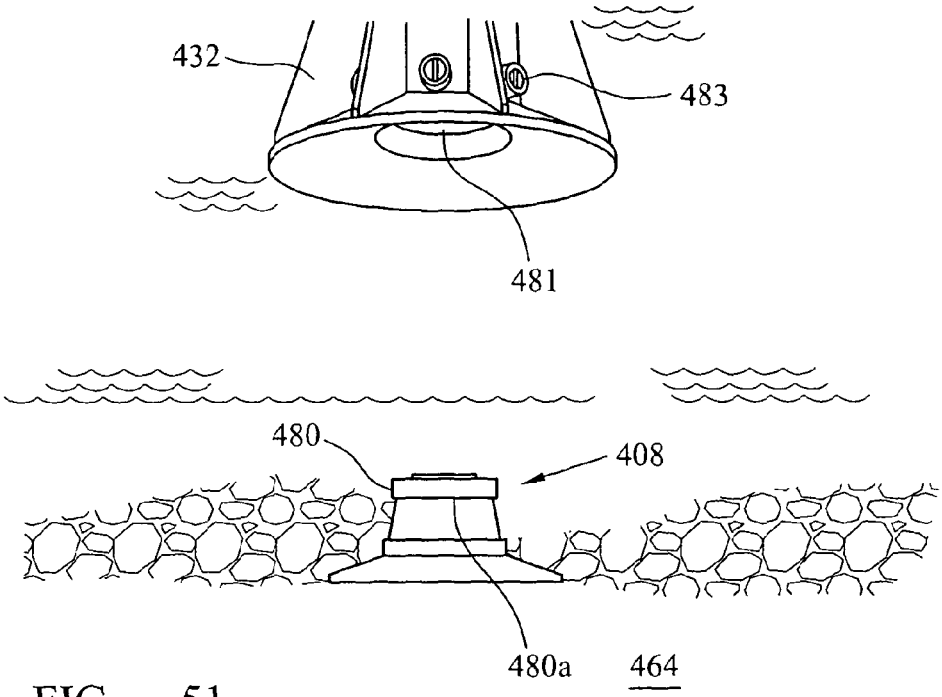
FIG. 51 shows a first stage of a method of anchoring a structure to a floor of a body of water of a fourth embodiment of the present invention.
Figure 52:
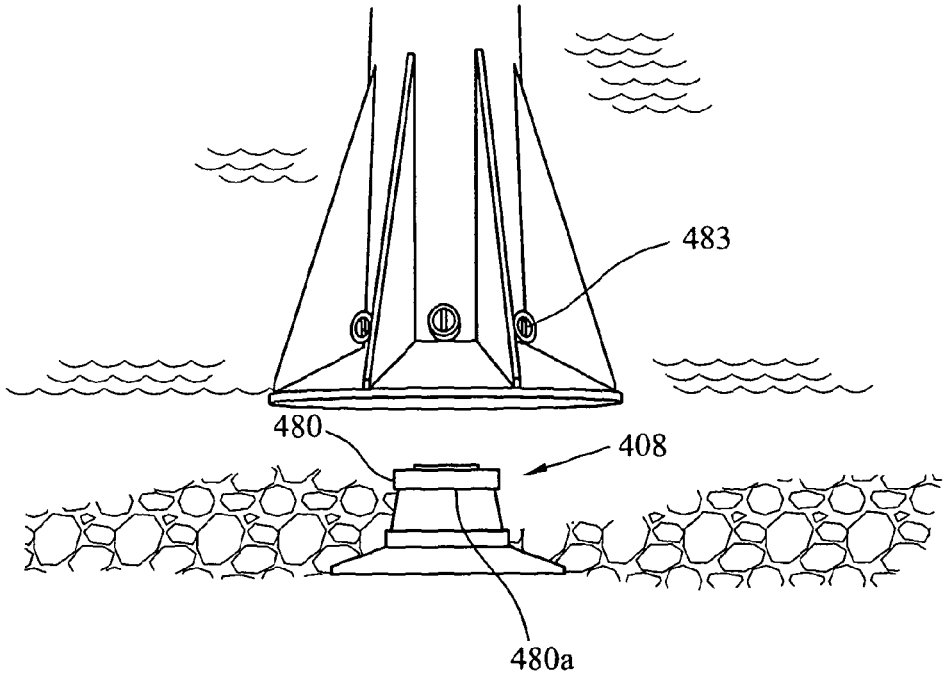
FIG. 52 shows a second stage of the method of FIG. 51.
Figure 53:
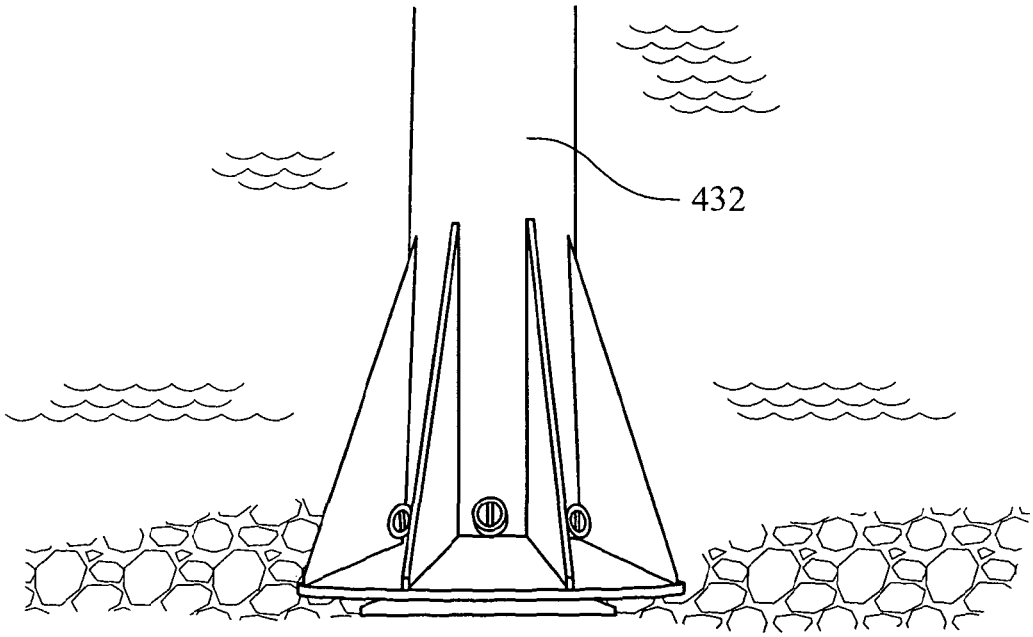
FIG. 53 shows a final stage of the method of FIGS. 51 and 52.
Figure 54:
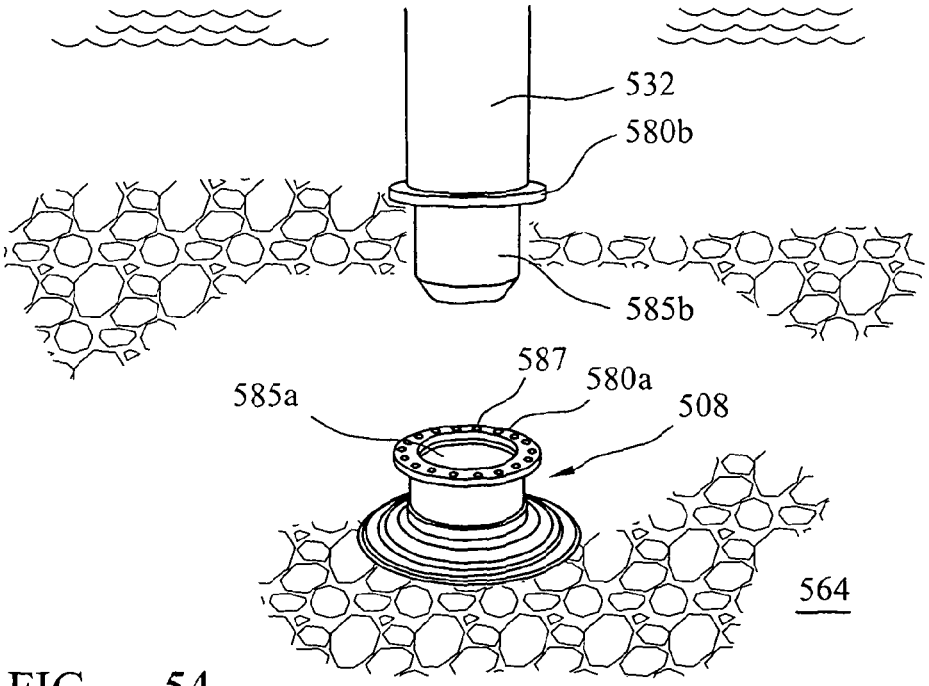
FIG. 54 shows a first stage of a method of anchoring a structure to a floor of a body of water of a fifth embodiment of the present invention.
Figure 55:
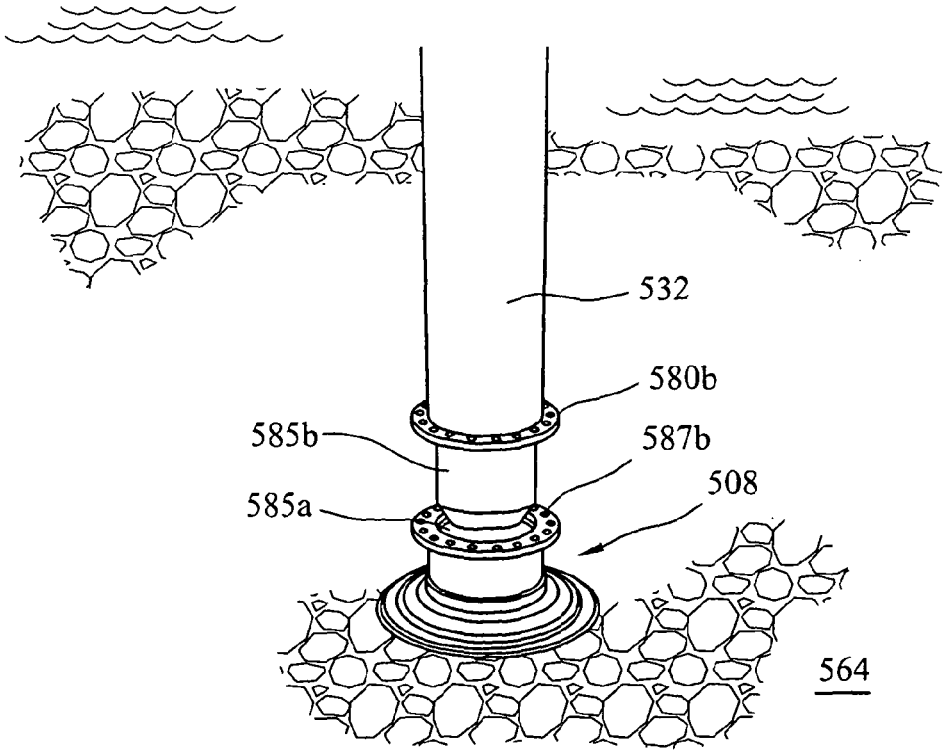
FIG. 55 shows a second stage of the method of FIG. 54.
Figure 56:
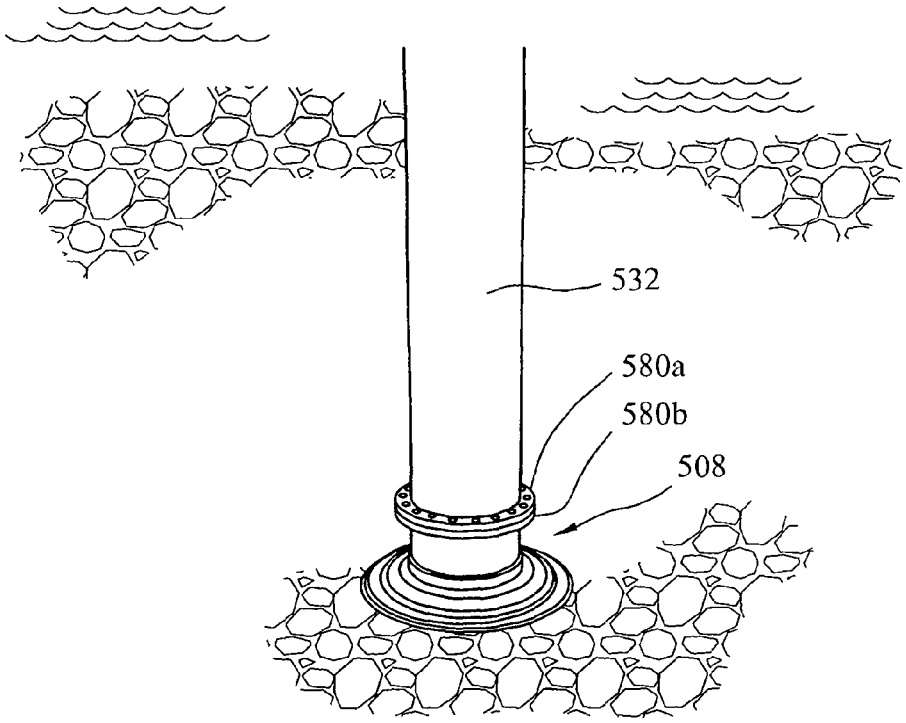
FIG. 56 shows a third stage of the method of FIGS. 54 and 55.

A method of anchoring a structure to an anchor member of a fourth embodiment of the invention is shown in FIG. 51 to 53, with parts common to the embodiment of FIG. 1 to 23 shown with like reference numerals but increased by 400.

Anchor member 408 is drilled into the seabed 464 using one of the three methods described above in the first, second and third embodiments. In this embodiment, attachment means 480 comprises first latching means 480A which is a collar for latching to second latching means (not shown). Second latching means may for example comprise spring loaded segments (not shown) disposed in the female connector portion 481 of a structure 432. Alternatively, spring loaded segments could be provided on the male attachment means 280. Once female connector 481 is lowered over attachment means 480, the spring loaded segments snap into place around first latching means 480A to hold the structure 432 in place and anchor it to the seabed. Locking bolts 483 are also provided and can be tightened to lock the structure 432 to the anchor member 408.

The connection can be hydraulically operated from the surface. The structure 432 is lowered over attachment means 480 and the segments are hydraulically operated using hydraulic pressure from a surface vessel causing the segments to engage collar 480A or alternatively, recesses (not shown) located around the circumference of attachment means 480. Bolts 483 can be operated by an ROV or diver.

Structure 432 in the embodiments shown is a pile extension that can be used as a mounting for a generator for the production of electricity using the motion of current as the power source. When the pile extension is installed onto anchor member 408, the generator can either already be installed on pile extension 432 or can be installed at a later time.

A method of anchoring a structure to an anchor member of a fifth embodiment of the invention is shown in FIG. 54 to 57, with parts common to the embodiment of FIG. 1 to 23 shown with like reference numerals but increased by 500.

Figure 57:
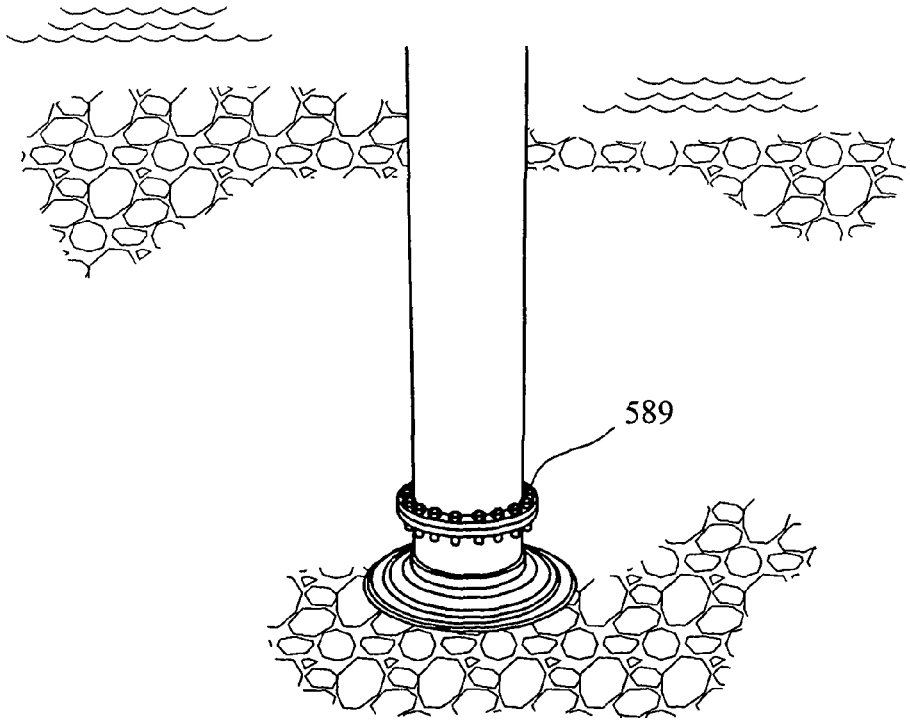
FIG. 57 shows the final stage of the method of FIG. 54 to 56 in which the first and second flanges are bolted together.

Anchor member 508 is drilled into the seabed 564 using one of the three methods described above in the first, second and third embodiments. In this embodiment, attachment means 580 comprises first flange 580*a* having a plurality of holes 587 for receiving bolts 589 (FIG. 57).

Structure 532 comprises a second flange 580*b* having a corresponding second plurality of bolt holes 587*b*. A female connector portion 585*a* disposed in the anchor means 580 is arranged to receive male connector portion 585*b* of structure 532 as shown moving from FIG. 54 to 56. Bolts 589 can then be used to bolt the structure 532 to the anchor member 508 and therefore the seabed 564.

Structure 532 is shown as a pile extension that can be used as a mounting for a generator for the production of electricity using the motion of current as the power source. When the pile extension is installed onto anchor member 508, the generator can either already be installed on pile extension 532 or can be installed at a later time.

A method of attaching an anchor member to a floor of a body of water, a remotely operable drilling apparatus, a system for attaching an anchor member to a floor of a body of water and an anchor member of a sixth embodiment of the invention is shown in FIG. 58 to 69.

Figure 58:
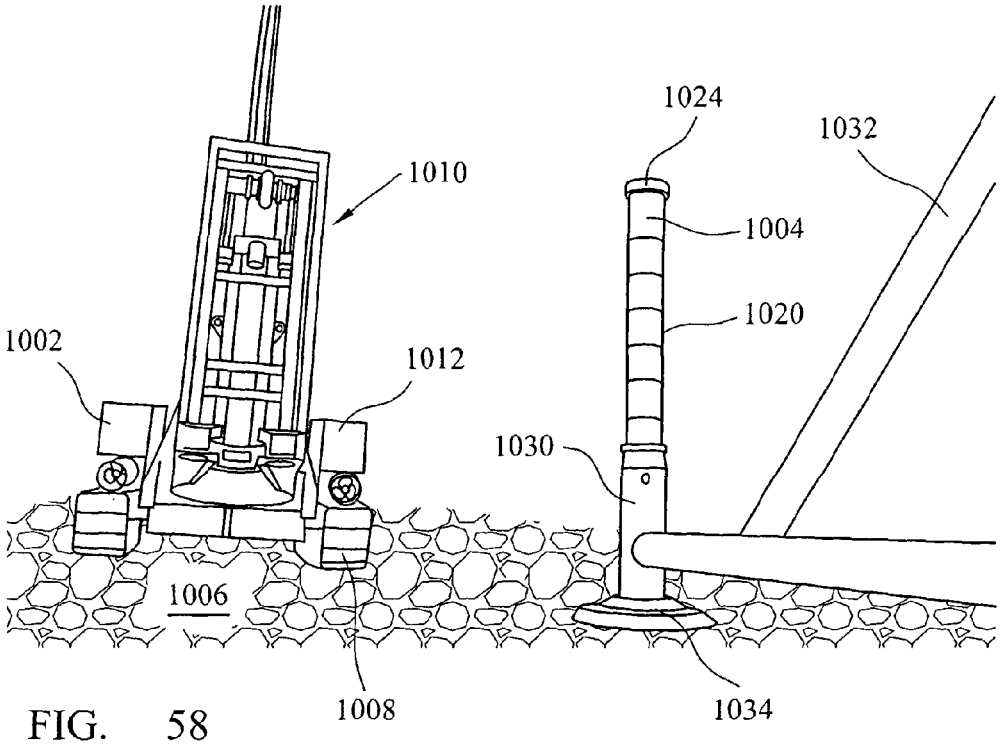
FIG. 58 is a perspective view of an apparatus of a sixth embodiment of the present invention that comprises a vehicle for attaching an anchor member to a floor of a body of water, the vehicle being shown alongside a support structure to be attached to the floor of the body of water.
Figure 59:
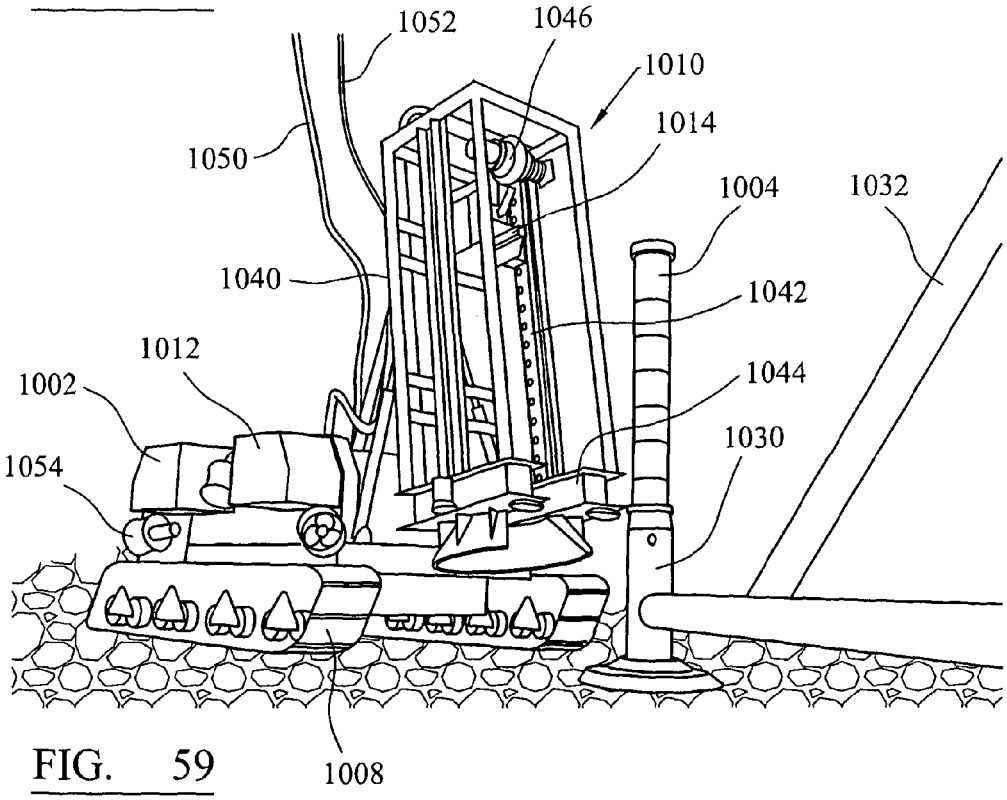
FIG. 59 is a perspective view of the vehicle of FIG. 58 showing the piling apparatus of the vehicle in a raised position ready to be interconnected with an annular pile held by a leg of the support structure.

Referring to FIGS. 58 and 59, a remotely operable drilling apparatus comprises a vehicle 1002 having a body 1012 arranged to be remotely located adjacent a floor of a body of water. Vehicle 1002 is adapted to attach an anchor member in the form of an annular pile 1004 to a floor of a body of water 1006. Vehicle 1002 is moveable along the floor of the body of water 1006 on traction means such as caterpillar tracks 1008 or wheels. A piling apparatus 1010, which is substantially the same as the drilling apparatus of the earlier embodiments is mounted to the body 1012 of the vehicle 1002 and comprises a drive means such as power swivel 1014 adapted to drill an anchor member into the floor 1006 of a body of water.

Figure 66:
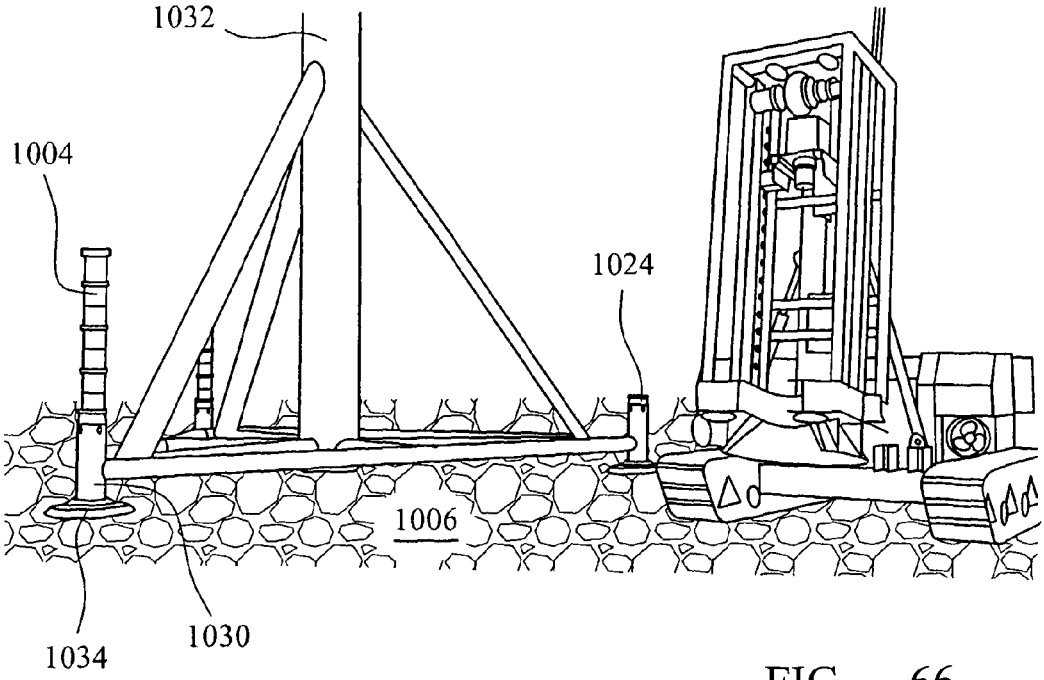
FIG. 66 shows the next stage of the vehicle manoeuvring between legs of the support structure.
Figure 67:
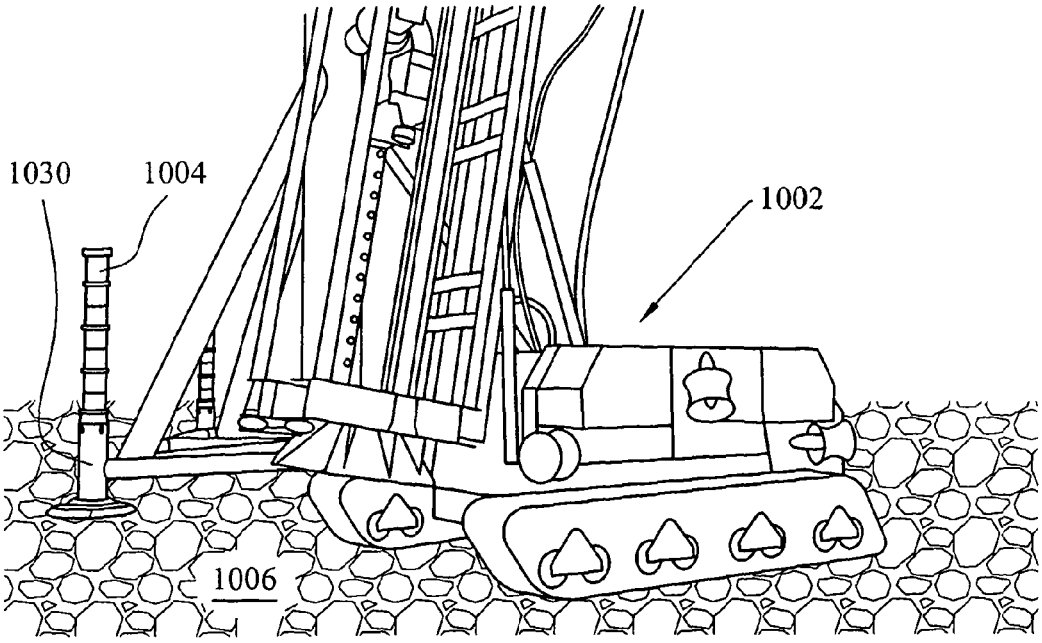
FIG. 67 shows the next stage of the vehicle manoeuvring between legs of the support structure.
Figure 68:
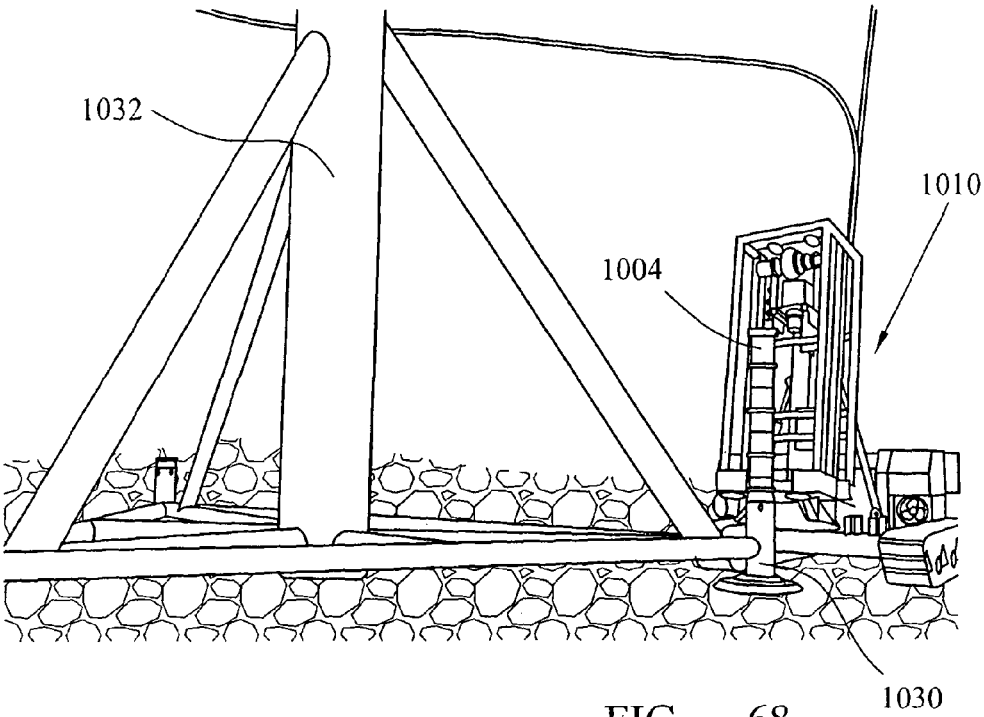
FIG. 68 shows the piling apparatus about to be mounted to a second annular pile.
Figure 69:
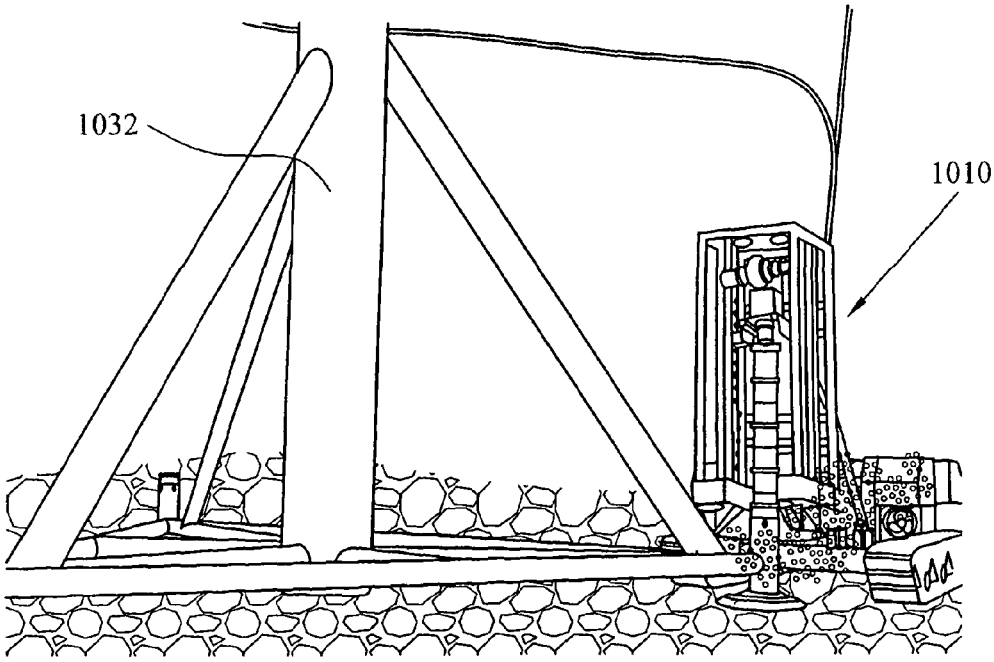
FIG. 69 shows the piling apparatus of the vehicle drilling a second annular pile into a floor of the body of water.
Figure 70:
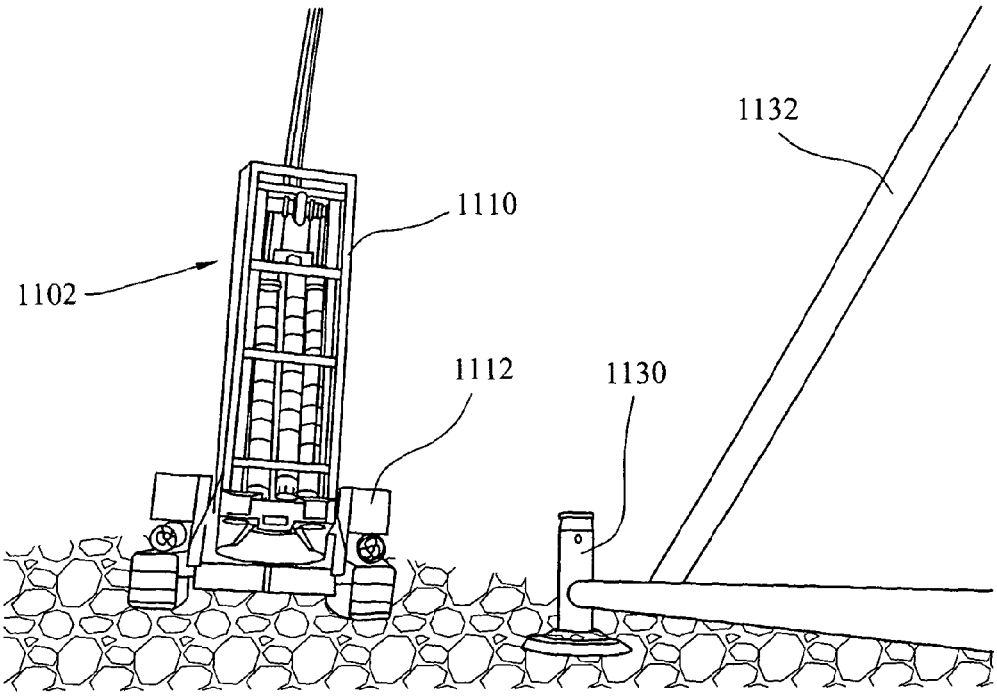
FIG. 70 is a perspective view of an apparatus comprising a vehicle for attaching an anchor member to a floor of a body of water of a seventh embodiment of the present invention.
Figure 71:
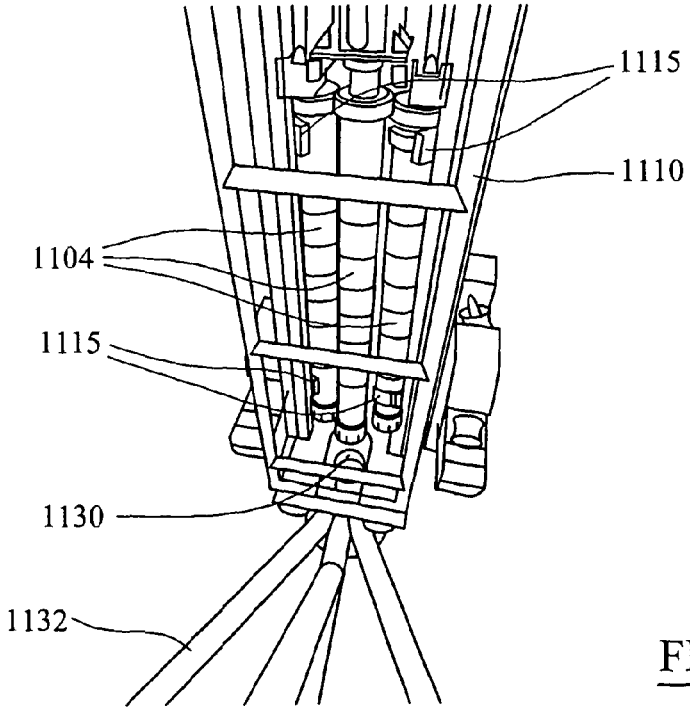
FIG. 71 is a perspective view from the front of the vehicle of FIG. 70 showing the piling apparatus adjacent a leg of the support structure.
Figure 72:
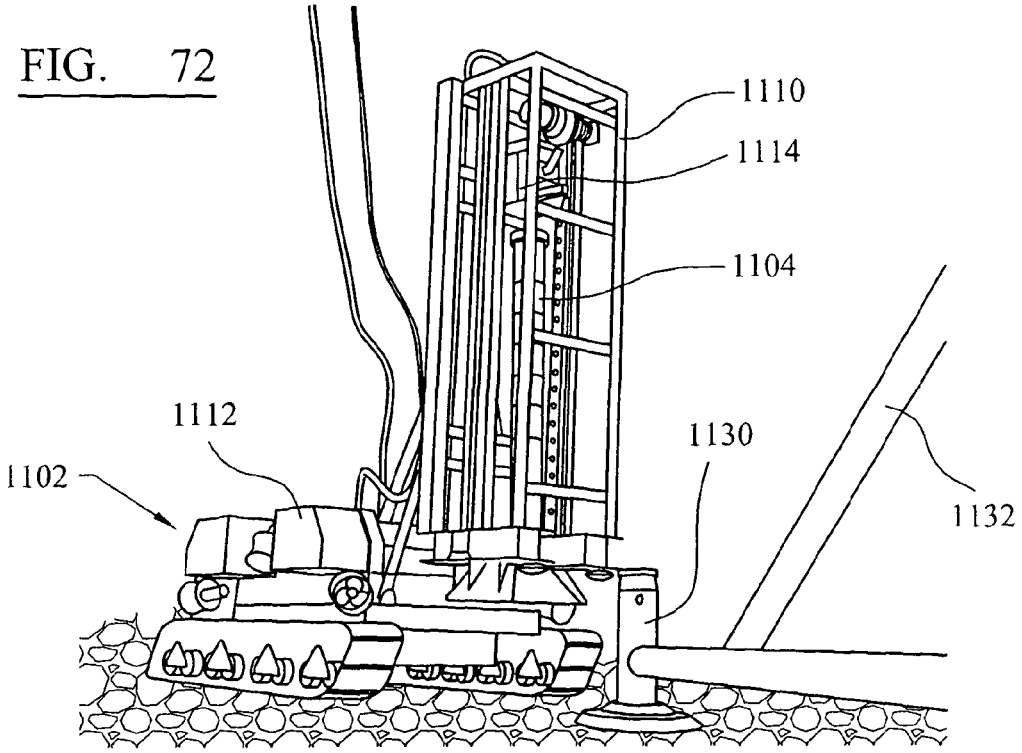
FIG. 72 is a perspective view from the side of FIG. 71.
Figure 73:
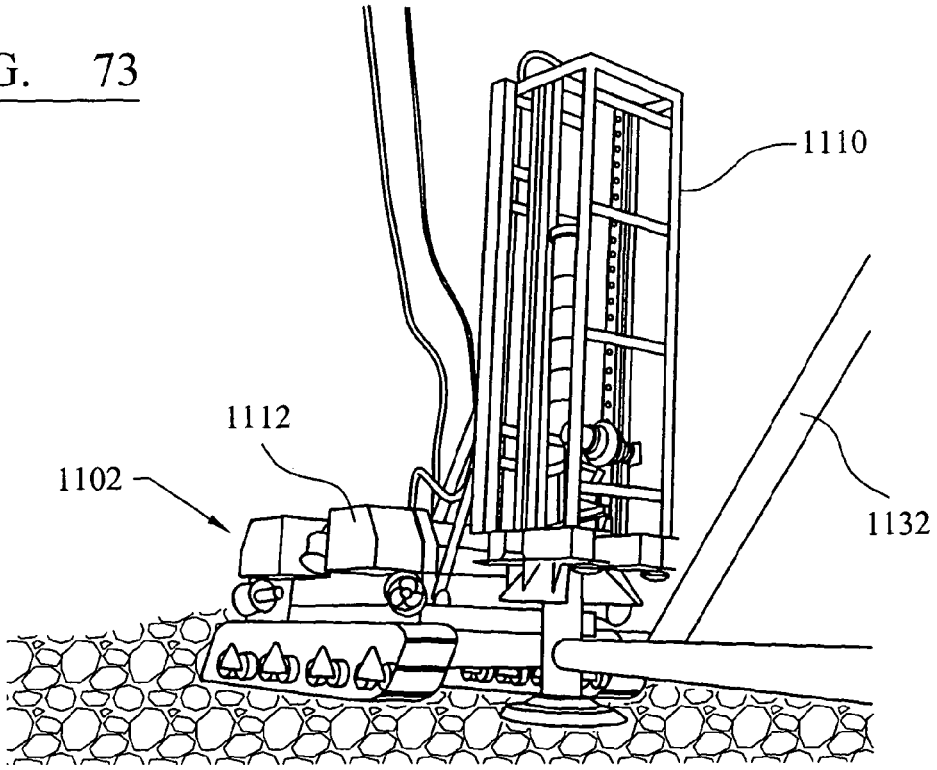
FIG. 73 is a perspective view of the vehicle of FIG. 70 to 72 drilling an annular pile through the leg of a support structure.

Referring to FIGS. 58, 59 and 66, support structure 1032 is generally in the form of a tripod and comprises three hollow legs 1030. The support structure is arranged on a floor of a body of water and is used to support a submerged power generating turbine (not shown) on the seabed 1006. A flexible skirt 1034 forms a cofferdam and is located at the end of each leg 1030. Flexible skirt 1034 is formed from rubber or a similar material that acts as a grout retention skirt during grouting. In order to secure the support structure 1032 to the seabed 1006, annular piles 1004 must be drilled down into the seabed 1006 and grouted in place as will be explained below.

Referring to FIGS. 58 and 59, a piling apparatus 1010 is pivotally mounted to body 1012 of vehicle 1002. The piling apparatus 1010 comprises a frame 1040 in which a drive means such as power swivel 1014 is mounted. The power swivel 1014 is able to advance downwardly along rack 1042 of a rack and pinion mechanism. Alternatively, at least one hydraulic cylinder could be used to move the power swivel 1014 downwardly. The frame 1040 and base portion 1044 form a guide means in which annular pile 1004 can be located. The power swivel 1014 can then be connected to the annular pile. Delivery means 1046 is also provided to enable flushing fluid during drilling and grout to be pumped through the annular pile 1004. The piling apparatus 1010 is pivotally mounted to the body 1012 to enable the drilling of piles on uneven surfaces and also to facilitate the location of the guide means on to the annular pile 1004.

A grout hose 1050 and integrated hoisting, power and signalling cable 1052 connects the vehicle 1002 to a surface vessel. This enables electrical power and control signals to be provided from a surface vessel. Grout is pumped down hose 1050 from the surface vessel after drilling. A CCTV system (not shown) is also provided to enable controllers to control vehicle 1002. A plurality of thrusters 1054 is provided on the body 1012 to facilitate submersion and movement of the vehicle 1002 prior to landing on the seabed and additionally to provide thrust to maintain the excess grout exhausting from the structure not forming around the vehicle. Clamping means (not shown) is also provided in order to clamp the piling apparatus 1010 to an annular pile 1004. The clamping means may take the form of a pair of retractable jaws adapted to be removable clamped around cylindrical shaft 1020 of pile 1004.

A method of attaching a support structure to a floor of a body of water such as a seabed 1006 using vehicle 1002 will now be described. Firstly, the support structure is located on a surface vessel. Annular piles 1004 are then located in each leg 1030 of the support structure and the support structure is lowered to the seabed 1006. Referring to FIG. 58, vehicle 1002 is then lowered to the seabed 1006 from a surface vessel which may be a smaller vessel than that used to lower support structure 1032.

Figure 60:
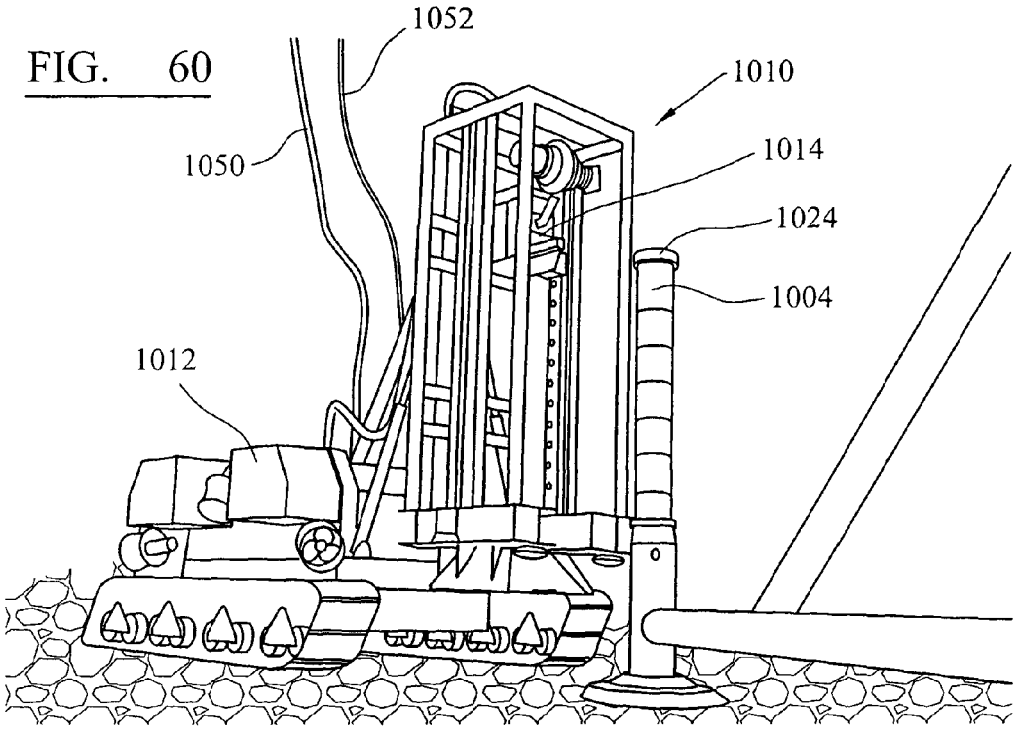
FIG. 60 shows the next stage of interconnecting the piling apparatus with an annular pile.

Referring to FIGS. 59 and 60, controllers on the surface vessel operate vehicle 1002 via cable 1052 to tilt the piling apparatus 1010 relative to vehicle body 1012 to ensure that the piling apparatus 1010 is in the correct orientation for drilling. Once the correct orientation has been attained, vehicle 1002 is moved forward and power swivel 1014 is connected to collar 1024 of the annular pile.

Figure 61:
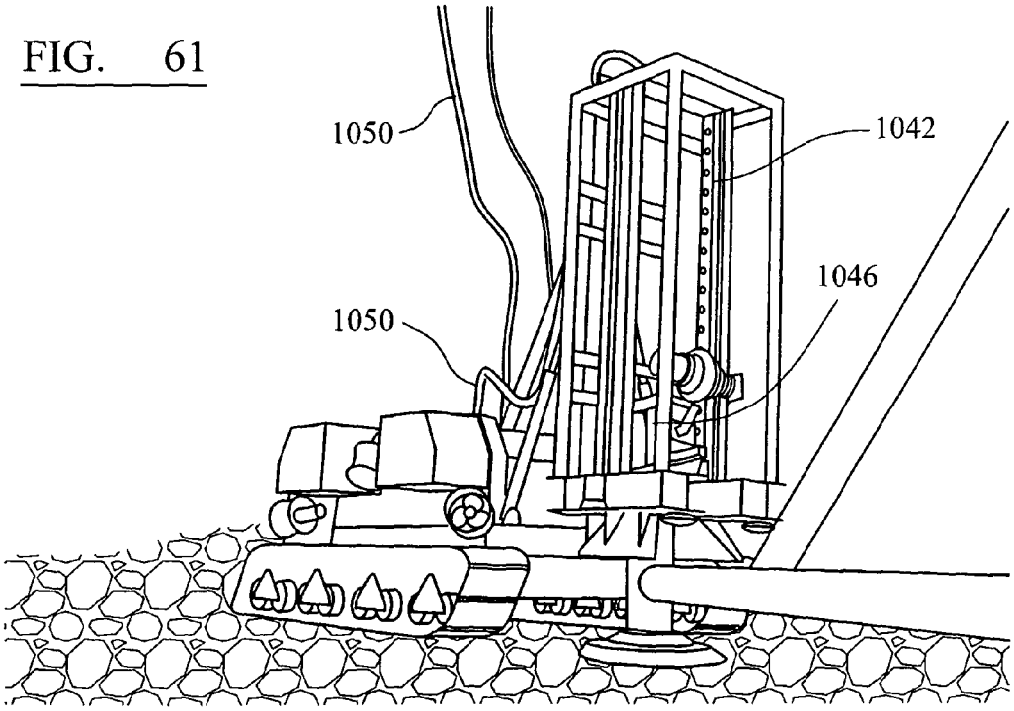
FIG. 61 shows the drilling of the annular pile by the piling apparatus.
Figure 62:
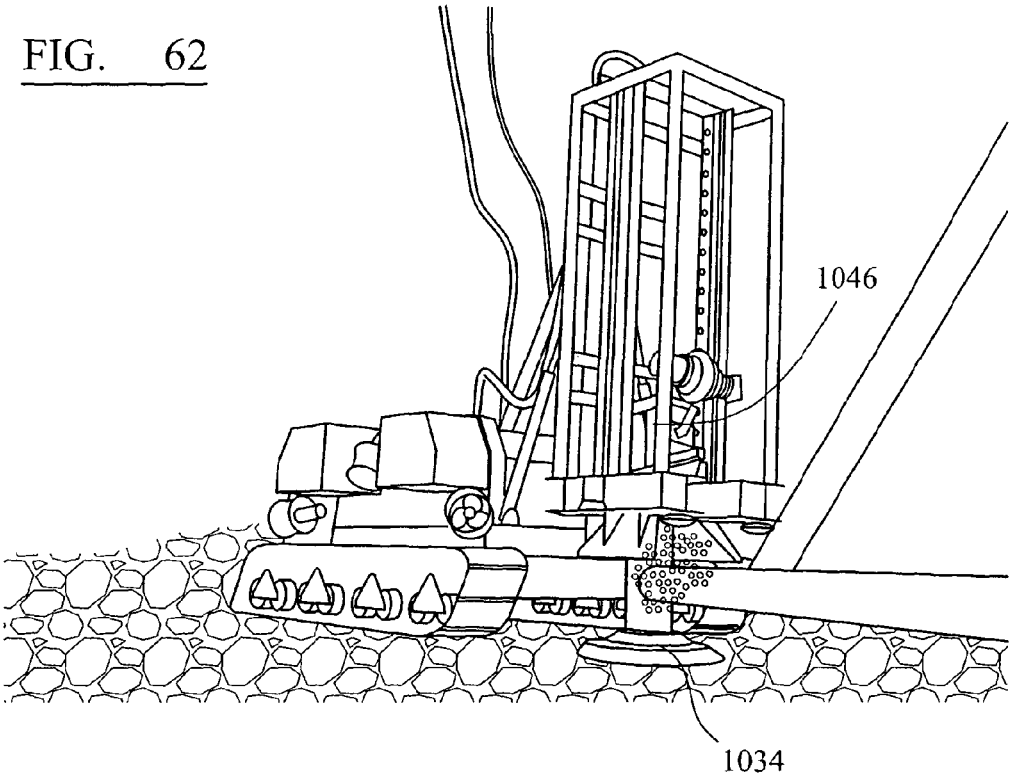
FIG. 62 shows the grouting of the annular pile.
Figure 63:
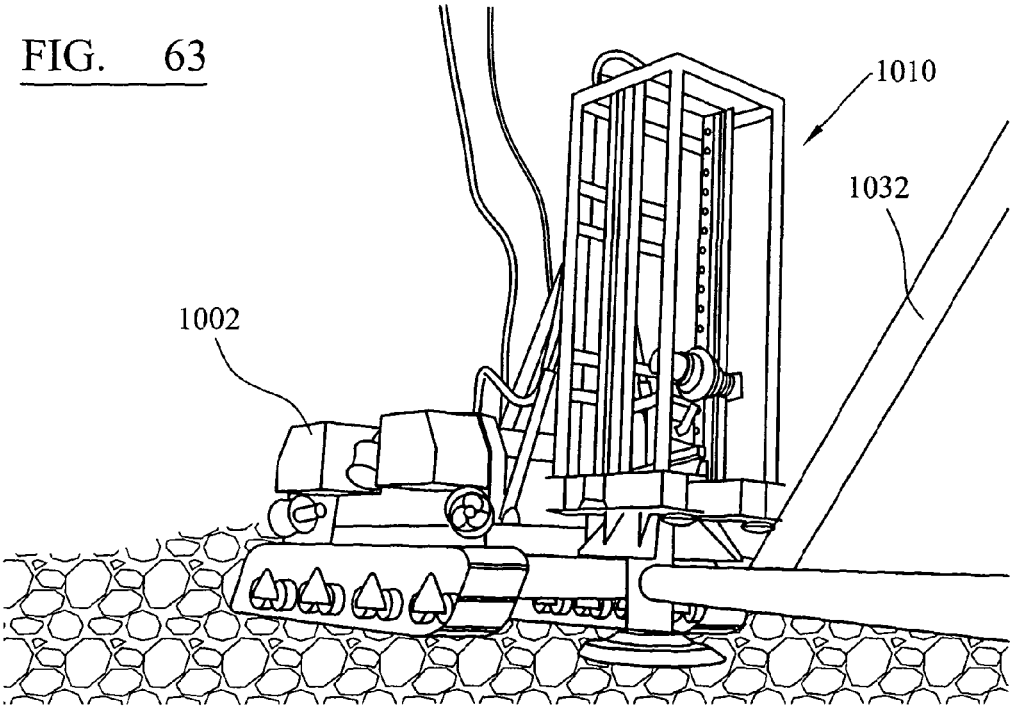
FIG. 63 shows the first stage of disconnection of the piling apparatus from the annular pile.
Figure 64:
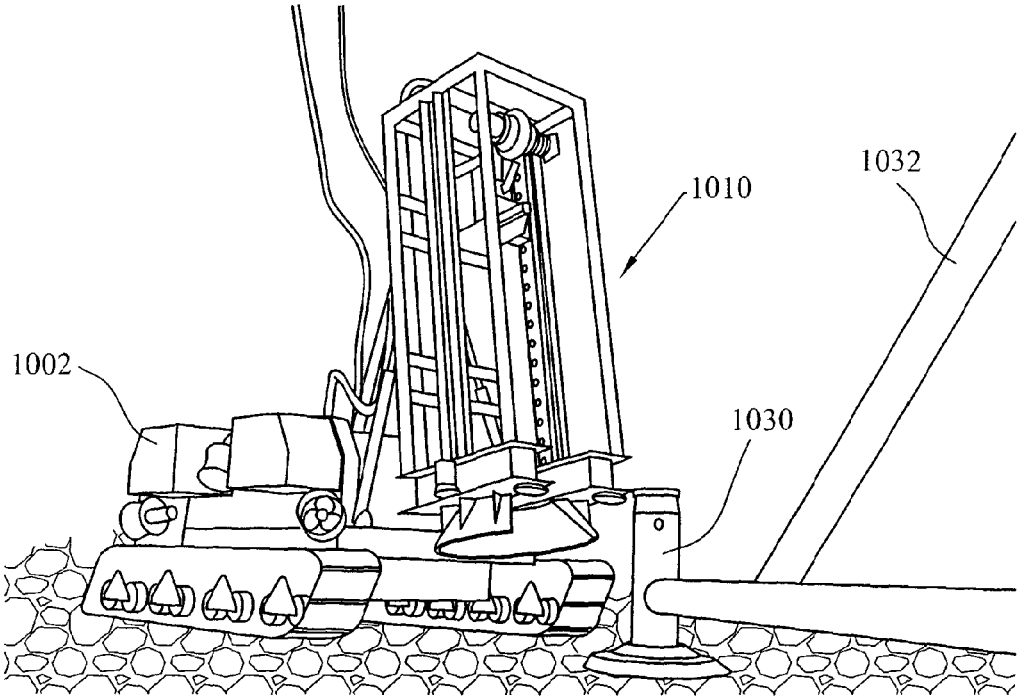
FIG. 64 shows disconnection of the piling apparatus from the support structure.
Figure 65:
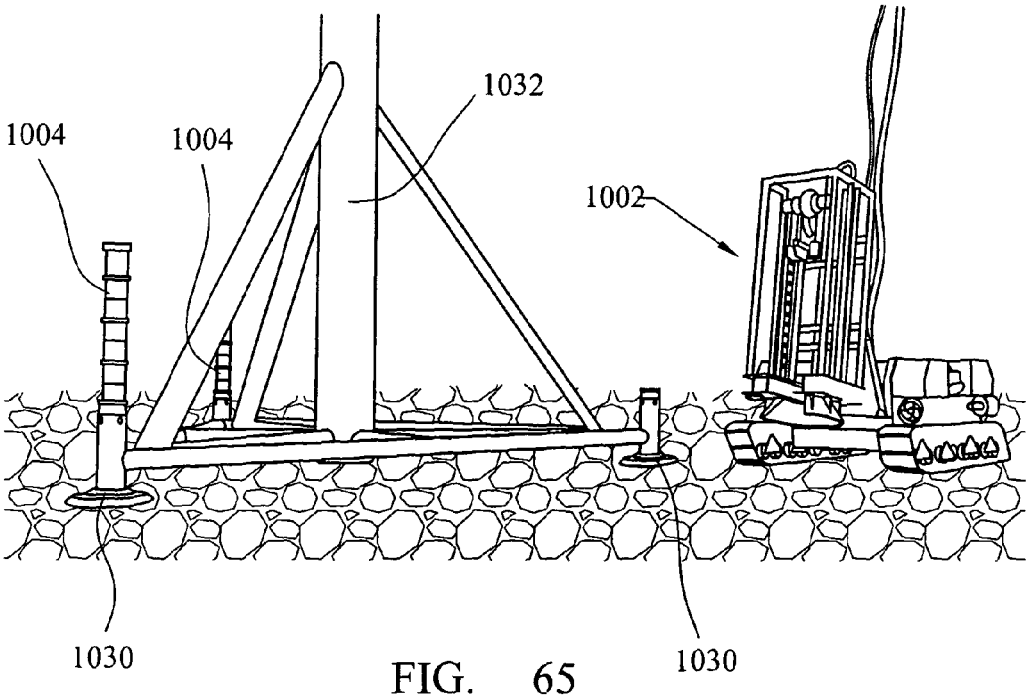

Referring to FIGS. 61 and 62, the power swivel is then operated to rotate annular pile 1004. Power swivel 1014 is advanced down rack 1042 to drill the annular pile into the seabed 1006. This is achieved by cutting shoe 1026 drilling an annulus into the floor of the body of water 1006 as described in connection with the earlier embodiments. During drilling, flushing fluid can be pumped from delivery means 1046 through the annulus to flush debris out from under skirt 1034.

FIG. 64 to 69 show the vehicle 1002 manoeuvring to a second leg 1030 and annular pile 1004 of support structure 1032 to repeat the drilling process. Once all three legs 1030 have been piled and grouted to the seabed 1006, the structure 1032 is pinned to the seabed 1006 and ready to support a turbine or the like.

A remotely operable drilling apparatus for attaching an anchor member to a floor of a body of water of a seventh embodiment of the invention is shown in FIG. 70 to 73 with parts common to the embodiment of FIG. 58 to 69 denoted by like reference numerals but increased by 100. In the embodiment of FIG. 70 to 73, the piling apparatus is arranged to be loaded with a plurality of annular piles.

Vehicle 1102 comprises a body 1112 to which a piling apparatus 1110 is interconnected. In this embodiment, three piles 1104 are carried in the piling apparatus 1110. The piles are pre-loaded on the surface. Consequently, vehicle 1102 uses a carousel system to enable multiple piles 1104 to be carried by the vehicle and mounted and drilled through legs 1130 of support structure 1132.

The vehicle 1102 is deployed from the surface with one pile 1104 loaded and connected to the power swivel 1114 ready for drilling. Two additional piles 1104 are carried by piling apparatus 1110 and are moveable under the action of hydraulic arms 1115 to be centralised in drilling apparatus 1110 and aligned with power swivel 1114 and with the aperture of a leg 1130 ready for drilling.

In this embodiment, the vehicle 1102 can be used to drill anchor members in the floor of a body of water without a support structure being present. For example, piling apparatus 1110 can be used to drill annular piles directly in to the seabed. The annular piles may have anchoring portions such as rotatable eyes to enable interconnection with a support structure that is submerged some time after drilling of the piles.

It will be appreciated by person skilled in the art that the above embodiments have been described by way of example only and not in any limitative sense, and that various alterations and modifications are possible without departure from the scope of the invention as defined by the appended claims.

The invention claimed is:

1. A method of attaching an anchor member to a floor of a body of water, the method characterised by:

locating a remotely operable drilling apparatus adjacent the floor of the body of water, wherein the remotely operable drilling apparatus is adapted to drive the anchor member comprising an annular pile having a substantially hollow shaft portion, an annular bit at a first end thereof and at least one anchor device at a second end thereof, the annular bit being arranged to drill an annulus into the floor into which the annular pile is to be driven and at least one said anchor device being adapted to restrict movement of a structure relative to the anchor member;

operating the remotely operable drilling apparatus to drill said annular pile into the floor of the body of water by the annular bit cutting the annulus into the floor of the body of water such that at least one said anchor device projects above the floor of the body of water; and filling said annulus with grout in order to retain the annular pile in said annulus and resist removal of the annular pile from the floor of the body of water.

2. The method according to claim 1, wherein the step of locating the remotely operable drilling apparatus adjacent the floor of the body of water comprises locating the remotely operable drilling apparatus adjacent an aperture formed on a submerged structure, wherein the aperture is arranged to receive a pile; and wherein the step of operating the remotely operable drilling apparatus includes driving said annular pile through the aperture and into the floor of the body of water by the annular bit cutting an annulus into the floor of the body of water to an extent to which at least one said anchor device, which comprises a respective locking member, is driven against a portion of the submerged structure around said aperture to resist removal of the submerged structure from the floor of the body of water.

3. The method according to claim 2, wherein the step of locating the remotely operable drilling apparatus on the submerged structure adjacent the aperture arranged to receive the pile comprises one or more of the following steps:

a) slidably interconnecting the remotely operable drilling apparatus to at least one guide line, wherein at least one said guideline is attached to the submerged structure at a location adjacent the aperture arranged to receive the pile, and lowering the remotely operable drilling apparatus along at least one said guideline whilst the at least one said guide line is pulled taut;

b) moving at least one guide device disposed on a base of the remotely operable drilling apparatus into contact with a portion of the submerged structure adjacent the aperture arranged to receive the pile to align said annular bit with said aperture; or c) operating at least one first clamping device to clamp said remotely operable drilling apparatus to the submerged structure adjacent said aperture.

4. The method according to claim 1, wherein the step of locating the remotely operable drilling apparatus adjacent the floor of the body of water comprises contacting the floor of the body of water with at least one support device of the remotely operable drilling apparatus, wherein at least one said support device is adjustable to enable levelling of the remotely operable drilling apparatus to a condition in which a longitudinal axis of the annular pile is substantially perpendicular to the floor of the body of water.

5. The method according to claim 4, wherein the step of operating the remotely operable drilling apparatus includes drilling said annular pile into the floor of the body of water by the annular bit cutting an annulus into the floor of the body of water such that at least one said anchor device, which comprises at least one respective attachment device for attachment to a submerged structure, projects above the floor of the body of water.

6. The method according to claim 1, wherein the step of locating the remotely operable drilling apparatus adjacent the floor of the body of water comprises operating at least one fraction device of the remotely operable drilling apparatus to move the remotely operable drilling apparatus along the floor of the body of water to a location to which an anchor member is to be drilled into the floor of the body of water.

7. The method according to claim 1, wherein the step of operating the remotely operable drilling apparatus to drill said annular pile into the floor of the body of water comprises one or more of the following steps:

d) attaching at least one drive device of the remotely operable drilling apparatus to the annular pile and operating the drive device to rotate and push the annular pile into the floor of the body of water; or e) pumping flushing fluid through said annular pile to remove cuttings from a drilled annulus and provide lubrication and cooling to said annular bit.

8. The method according to claim 1, wherein the step of filling said annulus with grout in order to retain the annular pile in said annulus comprises operating at least one delivery device of the remotely operable drilling apparatus to fill said annulus with grout.

9. The method according to claim 1, further comprising one or more of the following steps:

f) disconnecting the remotely operable drilling apparatus from the submerged structure and retrieving the remotely operable drilling apparatus to a surface vessel;

g) loading a further annular pile on said remotely operable drilling apparatus and repeating the method of claim 1.

10. A method of anchoring a structure to a floor of a body of water, the method comprising:

locating a remotely operable drilling apparatus adjacent the floor of the body of water, wherein the remotely operable drilling apparatus is adapted to drive an anchor member comprising an annular pile having a substantially hollow shaft portion, an annular bit at a first end thereof and at least one anchor device at a second end thereof, the annular bit being arranged to drill an annulus into the floor into which the annular pile is to be driven and at least one said anchor device being adapted to restrict movement of a structure relative to the anchor member;

operating the remotely operable drilling apparatus to drill said annular pile into the floor of the body of water by the annular bit cutting the annulus into the floor of the body of water such that at least one said anchor device projects above the floor of the body of water; and filling said annulus with grout in order to retain the annular pile in said annulus and resist removal of the annular pile from the floor of the body of water; and attaching the structure to at least one said anchor device of the anchor member.

11. The method according to claim 10, wherein at least one said anchor device comprises at least one respective attachment device having at least one respective first latching device and the structure comprises at least one second latching device arranged to latch with a respective said first latching device, and wherein the step of attaching the structure to at least one said anchor device of the anchor member comprises latching at least one said first latching device with a respective said second latching device.

12. A remotely operable drilling apparatus characterised by:

a body arranged to be remotely located adjacent a floor of a body of water;

an anchor member comprising an annular pile having a substantially hollow shaft portion, an annular bit at a first end of said shaft portion and integral with said shaft portion, and at least one anchor device at a second end of said shaft portion, the annular bit being arranged to drill an annulus into the floor into which the annular pile is to be drilled and at least one said anchor device being adapted to restrict movement of a structure relative to the anchor member; and at least one drive device arranged to drill said anchor member into the floor of the body of water.

13. The apparatus according to claim 12, further comprising at least one delivery device arranged to fill said annulus with grout in order to retain the annular pile in said annulus and resist removal of the structure from the floor of the body of water.

14. The apparatus according to claim 12, further comprising one or more of the following features:

h) at least one guide device disposed on a base of the remotely operable drilling apparatus, at least one said guide device arranged to align said annular bit with an aperture of a submerged structure, wherein the aperture is arranged to receive the pile; or i) at least one clamping device for clamping said remotely operable drilling apparatus to a submerged structure adjacent an aperture arranged to receive a pile.

15. The apparatus according to claim 14, wherein at least one said guide device comprises a respective female conical portion arranged to abut a corresponding male conical portion disposed around said aperture arranged to receive the pile.

16. The apparatus according to claim 12, further comprising at least one support device arranged to contact the floor of a body of water, wherein at least one said support device is adjustable to enable levelling of the remotely operable drilling apparatus to a condition in which a longitudinal axis of the annular pile is substantially perpendicular to the floor of the body of water.

17. The apparatus according to claim 16, wherein at least one said support device comprises a respective plurality of retractable legs, each said retractable leg comprising a shoe portion that is adjustable to change a length from which and/or the angle at which the respective shoe extends from the corresponding leg.

18. The apparatus according to claim 12, further comprising at least one traction device adapted to move the body along the floor of a body of water.

19. The apparatus according to claim 18, wherein at least one said drive device is pivotable relative to the body.

20. The apparatus according to claim 18, wherein the piling apparatus is arranged to be loaded with a plurality of annular piles.

21. The apparatus according to claim 20, further comprising at least one hydraulic arm arranged to move an annular pile into alignment with at least one said drive device.

22. The apparatus according to claim 12, wherein at least one said drive device comprises one or more of the following features:

j) a power swivel comprising a drive head arranged to releasably engage with and rotate said annular pile;

k) at least one rack and pinion device or at least one hydraulic cylinder arranged to move said power swivel towards the floor of a body of water; or l) at least one retractable support clamping device arranged to hold said annular pile in the remotely operable drilling apparatus before drilling and provide stability during drilling.

23. A system for attaching an anchor member to a floor of a body of water, the system characterised by:

a remotely operable drilling apparatus according to claim 12; and at least one umbilical device arranged to provide hydraulic and/or electrical power from a surface vessel to said remotely operable drilling apparatus and to provide flushing fluid and/or grout to at least one delivery device from the surface vessel.

24. The system according to claim 23, further comprising one or more of the following features:

m) at least one adapter device arranged to enable at least one said umbilical device to be disconnected from the surface vessel and attached to a buoy;

n) at least one pumping device arranged to pump flushing fluid and/or grout to at least one said delivery device via at least one said umbilical device; or o) at least one guide line attached to the submerged structure at a location adjacent an aperture arranged to receive a pile, at least one said guide line arranged to be interconnected to said remotely operable drilling apparatus to guide the remotely operable drilling apparatus to a location on said submerged structure adjacent an aperture arranged to receive a pile whilst the at least one said guide line is pulled taut.

25. The system according to claim 24, further comprising at least one tensioning device arranged to pull at least one guide line taut.

26. An anchor member characterised by:

an annular pile having a substantially hollow shaft portion, an annular bit at a first end of said shaft portion and integral with said shaft portion, and at least one anchor device at a second end thereof, the annular bit being arranged to drill an annulus into a floor into which the annular pile is to be drilled and at least one said anchor device being adapted to restrict movement of a structure relative to the anchor member.

27. The anchor member according to claim 26, wherein said substantially hollow shaft portion comprises a shaft having outer and inner concentric cylindrical sleeves defining an annular channel therebetween, and wherein the annular bit is mounted to a first end of the shaft and at least one said anchor device is mounted to a second end of the shaft; and wherein a path for fluid flow is defined from a first opening in at least one said anchor device, through said annular channel and through a second opening defined by said inner sleeve.

28. The anchor member according to claim 27, wherein said annular bit is mounted to said outer sleeve and the second opening is defined by an end of the inner sleeve.

29. The anchor member according to claim 26, wherein at least one said anchor device comprises a respective locking member arranged to be driven against a portion of a submerged structure around an aperture to resist removal of the submerged structure from the floor of the body of water.

30. The anchor member according to claim 26, wherein at least one said anchor device comprises at least one attachment device for attachment to an at least partially submerged structure.

31. The anchor member according to claim 30, wherein at least one said attachment device comprises a sleeve rotatably mounted on the anchor member, wherein the sleeve comprises at least one eye.

32. The anchor member according to claim 30, wherein at least one said attachment device comprises at least one respective first latching means arranged to be latched with at least one respective second latching means of a structure attachable to at least one said attachment device.

33. The anchor member according to claim 30, wherein at least one said attachment device comprises a first flange arranged to be bolted to a second flange of a structure attachable to at least one said attachment device.

34. An assembly comprising the structure attached to at least one said anchor device of an anchor member according to claim 26.

35. The assembly according to claim 34, further comprising a flexible skirt located adjacent a drilled annulus, the flexible skirt being arranged to prevent removal of grout from the annulus during and after drilling.

* * * * *

UNITED STATES PATENT AND TRADEMARK OFFICE

CERTIFICATE OF CORRECTION

PATENT NO. : 8,998,540 B2
APPLICATION NO. : 13/395785
DATED : April 7, 2015
INVENTOR(S) : John Swingler and Neil McNaughton It is certified that error appears in the above-identified patent and that said Letters Patent is hereby corrected as shown below:

In the Specification

Col. 13, Line 57, "bit forms" should be --bit 24 forms--

In the Claims

Col. 22, Line 41, Claim 6 "fraction" should be --traction--

Signed and Sealed this
Twenty-eighth Day of July, 2015

Michelle K. Lee

Michelle K. Lee
*Director of the United States Patent and Trademark Office*